US012577709B2

(12) United States Patent
Poegl et al.

(10) Patent No.: US 12,577,709 B2
(45) Date of Patent: Mar. 17, 2026

(54) ARTICLE COMPRISING A KNIT ELEMENT

(71) Applicant: adidas AG, Herzogenaurach (DE)

(72) Inventors: Florian Poegl, Fuerth (DE); Wolfgang R. Rempp, Gammertingen (DE); Roland Jenter, Balingen-Endingen (DE); Matthias Linz, Scheinfeld (DE); Florin Filipescu, Herzogenaurach (DE); Stefan Tamm, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 85 days.

(21) Appl. No.: 18/480,908

(22) Filed: Oct. 4, 2023

(65) Prior Publication Data

US 2024/0044054 A1 Feb. 8, 2024

Related U.S. Application Data

(63) Continuation of application No. 17/468,333, filed on Sep. 7, 2021, now Pat. No. 11,821,117.

(30) Foreign Application Priority Data

Sep. 8, 2020 (DE) ..... 102020211263.0

(51) Int. Cl.
*D04B 1/24* (2006.01)
*A43B 1/04* (2022.01)
(Continued)

(52) U.S. Cl.
CPC ..... *D04B 1/24* (2013.01); *A43B 1/04* (2013.01); *D04B 1/12* (2013.01); *D04B 15/48* (2013.01)

(58) Field of Classification Search
CPC . D04B 1/22; D04B 1/123; D04B 1/14; D04B 19/42; A41B 1/04
See application file for complete search history.

(56) References Cited

U.S. PATENT DOCUMENTS 11,716 A 9/1854 Brown
74,962 A 2/1868 Wesson
(Continued)

FOREIGN PATENT DOCUMENTS

CN 108685277 A 10/2018
DE 103 16 979 A1 11/2004
(Continued)

OTHER PUBLICATIONS

Rokolee Diy: "How to Knit: 2-Colour Floats: A Fun Knitting Technique to Try: Make Yarn Strands Across Your Work", Apr. 25, 2019 (Sep. 4, 2025), XP055881910, Retrieved from the Internet: URL:https://www.youtube.com/watch?v=DbJfOh n84E.

*Primary Examiner* — Danny Worrell
(74) *Attorney, Agent, or Firm* — Sterne, Kessler, Goldstein & Fox P.L.L.C.

(57) ABSTRACT

A customized, flat-knit multi-zonal element for a shoe upper and a method of producing such an element that allows for continuous knitting while controlling positioning of individual threads. One or more carriages may move continuously along the needle bed while threads are provided to the needles for a complete stroke. Knit elements may include multiple zones with differing properties. Threads may alter positions within knit structures from zone to zone. A knit element may include a first zone in a first plane that includes at least two merged threads to form a merged knit structure and a second zone in a second plane connected to the first zone seamlessly. Some knit structures may be positioned throughout the knit element such that they control a position of zones relative to each other.

20 Claims, 34 Drawing Sheets

(51) Int. Cl.
*D04B 1/12* (2006.01)
*D04B 15/48* (2006.01)

(56) References Cited

U.S. PATENT DOCUMENTS

| | | | |
|---|---|---|---|
| 124,525 | A | 3/1872 | Wild |
| 266,614 | A | 10/1882 | Douglass |
| 296,119 | A | 4/1884 | Bourn |
| 299,934 | A | 6/1884 | Müller |
| 311,123 | A | 1/1885 | Hall |
| 367,333 | A | 7/1887 | Beiger et al. |
| 376,373 | A | 1/1888 | Dodge et al. |
| 2,467,237 | A | 4/1949 | Sherman et al. |
| 7,474,314 | B2 | 1/2009 | Minchew et al. |
| 8,959,959 | B1 | 2/2015 | Podhajny |
| 9,878,574 | B2 | 1/2018 | Merchant |
| 10,145,042 | B2 | 12/2018 | Diaz et al. |
| 10,326,914 | B2 | 6/2019 | Rich et al. |
| 10,415,164 | B2 | 9/2019 | Diaz et al. |
| 10,871,884 | B1 | 12/2020 | Cole et al. |
| 2005/0193592 | A1 | 9/2005 | Dua et al. |
| 2012/0233882 | A1 | 9/2012 | Huffa et al. |
| 2012/0234051 | A1 | 9/2012 | Huffa |
| 2012/0279260 | A1 | 11/2012 | Dua et al. |
| 2014/0208484 | A1 | 7/2014 | Huff et al. |
| 2014/0237861 | A1 | 8/2014 | Podhajny |
| 2014/0245633 | A1 | 9/2014 | Podhajny |
| 2018/0055137 | A1 | 3/2018 | Fraser et al. |
| 2020/0121019 | A1 | 4/2020 | Bartys et al. |
| 2021/0071326 | A1 | 3/2021 | Tibbits et al. |

FOREIGN PATENT DOCUMENTS

| | | | |
|---|---|---|---|
| EP | 0 854 947 | A1 | 7/1998 |
| EP | 1 916 323 | A2 | 10/2007 |
| EP | 2 649 898 | A1 | 3/2013 |
| EP | 2 792 260 | A2 | 4/2014 |
| EP | 2 792 261 | A1 | 4/2014 |
| EP | 2 792 265 | A2 | 4/2014 |
| EP | 2 843 095 | A1 | 3/2015 |
| EP | 3 001 920 | A1 | 10/2015 |
| WO | WO 2015/011148 | A1 | 1/2015 |

ARTICLE COMPRISING A KNIT ELEMENT

CROSS-REFERENCE TO RELATED APPLICATIONS

The present application is a continuation of U.S. patent application Ser. No. 17/468,333, filed Sep. 7, 2021, which claims the benefit of priority from German Patent Application No. 102020211263.0, filed Sep. 8, 2020. Each of these prior-filed applications is incorporated herein by reference in its entirety.

TECHNICAL FIELD

The present disclosure is directed to knitwear, and in particular to an article comprising a knit element and to a method of manufacturing a knitted component for an article, such as a shoe upper.

BACKGROUND

Parts of articles such as apparel and in particular parts of footwear, for example, an upper, a vamp, a toe portion, a collar, a heel portion, a tongue, or an entire piece of footwear, especially sports shoes, can be manufactured on knitting machines.

In fact, knit uppers or elements for knit uppers have been described in the patent literature since at least the 1800s. In particular, U.S. Pat. No. 11,716 (issued Sep. 26, 1854) described using knit materials as portions of the upper on a boot which may be "knitted in the form of the article to be produced."

Knits have also been used to form substantially complete uppers for boots and/or shoes while minimizing waste. In 1887 (U.S. Pat. No. 367,333), Beiger and Eberhart stated, "(o)ur knitted boots are made of uniform thickness and rigidity and so accurately as to size and shape that no cutting or waste is involved."

In addition, Mueller described in 1884 (U.S. Pat. No. 299,934) in her first claim "(a) shoe having its upper and sole formed of knitted material, the stitches of the upper being united by knitting to those of the sole . . . ."

Multilayered knits were described in 1868 by Wesson in U.S. Pat. No. 74,962 for use in a shoe having a quarter and vamp made of knit "to form the outside and the lining in one piece."

U.S. Pat. No. 376,373 (Jan. 10, 1888) stated when describing a method of knitting material for a boot on a circular knitting machine (FIG. 1), "A is a weft-thread knitting-machine, taking two or more ordinary loosely-twisted yarns, b, singly and knitting them together in a multiple way in a single fabric, as shown in FIG. 2."

It is often the desire of manufacturers to provide articles, in particular footwear, with specific functions at targeted locations. An early example of this is found in U.S. Pat. No. 124,525 which describes, "the upper of which consists of two pieces cut out of a plain piece of an elastic, knitted or woven fabric, in the manner described, so that the lines of elasticity of the upper will run longitudinally in the quarter and transversely in the vamp."

Further, zones within a knit material having different properties are shown in U.S. Pat. No. 296,119 (Apr. 1, 1884) which describes, "(h)owever said fabric may be manufactured, it must be provided with the integral longitudinal ribs a, in which the yarn is so massed as to render them much thicker and heavier than the fabric at the intervening spaces, b, thus radically differing from ordinary knit ribbed fabrics, which are practically uniform in thickness and have ribs which are alternately thrown to the front and to the rear of the fabric, and which, therefore, are ribbed on both sides, instead of being ribbed on the front side only, as shown in the drawings, wherein the rear surface or back of the fabric c is smooth or plain."

In the construction of shoes, some sections, often the toe and heel portions of a shoe upper are reinforced to account for the loads which occur while wearing the shoe. In 1949, U.S. Pat. No. 2,467,237 described the use of "a seamless woolen tube stock" to which "the counter strip 25 and counter 26 secured thereon, also the sole 27 and heel 28" to form a boot.

Water repellency is often desired, especially with respect to outdoor shoes. U.S. Pat. No. 266,614 described in 1882 an invention that included "knitted fabric is covered with india-rubber or other pliable material not affected by water" to form a bathing stocking. Further, U.S. Pat. No. 311,123 (Jan. 20, 1835) describes "the entire boot of knit or woven fabric" which the inventor "saturate(s) with water-proof substance, so as to render the whole impervious to water."

Further examples of corresponding manufacturing methods and articles, such as footwear are disclosed for example in EP 2 649 898, EP 2 792 260, EP 2 792 261, EP 2 792 265 and EP 3 001 920, all of which are assigned to the present applicant.

With known manufacturing methods for knitted articles, additional components or material layers often need to be attached in post-processing to ensure that the predetermined properties required for the shoe are met. For example, a heel counter or a skin layer may be added.

Knitting is a flexible method of creating elements for shoe uppers, shoe uppers, and/or matched pairs of shoe uppers. However, depending on the knitting machine, knit program, materials, and/or structures used, the knitting times for various knitted components may vary greatly. Reducing knitting time of knitted components greatly affects production costs and is highly sought after.

Historically, to control positioning yarns within knit elements, knitting machines may utilize multiple types of feeders to enable various stitch types such as knit, plait, inlay, and/or to create intarsia. Further, kickback may be used to control positioning during the knitting process. However, when kickback is used, the knitting process may be slowed significantly and results in longer knitting times, and thereby increases production costs. Kickback increases production costs in such a manner that it may not be desirable to control the positioning of strands in this manner.

Generally, customized articles that require different structures and/or yarns may increase the knitting time. In particular, this may be the case when complicated patterns requiring multiple yarns and/or different structures are desired.

Structural limitations of knitting machines may also affect the ability of a knitter to precisely control positioning of particular yarns. This may lead to increased materials costs as yarns may cover larger areas of the knit than necessary to impart the desired functionality to the specific sections of the knit.

Creating knit elements for uppers, complete uppers or paired uppers that include zones having yarns placed such that placement can be controlled down to a stitch increases functionality of the upper while potentially decreasing cost of the materials. Using standard knitting techniques and/or machines to achieve this functionality (i.e., flexibility of positioning the yarns at an individual stitch level) would result in increased knit times that likely prove cost prohibitive for knit elements, knit uppers, and/or paired knit uppers.

BRIEF SUMMARY

It is, therefore, an object of the present disclosure to overcome, at least in part, the disadvantages of known knitted articles, such as footwear and apparel.

This object is in particular met by a customized, flat-knit multi-zonal element for a shoe upper including a plurality of knit structures having a first zone of the knit element in a first plane having at least two merged threads to form at least one merged knit structure of the plurality of knit structures and a second zone of the knit element in a second plane connected to the first zone seamlessly. In some embodiments, the plurality of knit structures include one or more positioning knit structures positioned such that the one or more positioning knit structures control a position of the first zone relative to the second zone.

In some embodiments, knit elements may include knit structures formed on either layer of a double layer knit element and/or in the interstitial space between the layers. For a single layer fabric, for example, a first knit structure may be a loop or tuck and the second structure may be a float insertion. The float insertion may be secured in part by loops or tucks being created on differing needle beds. Thus, the float insertion sits in the interstitial space between the stitches.

In some embodiments of a shoe upper knit element, a third section is integrally knit with one or more of the sections where the merged yarns are exchanged. For example, in some embodiments, the first yarn may be positioned such that it sits on the backside of the loop while the second yarn may be positioned such that it sits on the front side of the stitch in the third section.

In some embodiments, an example of a shoe upper may include a flat-knit element having a first section in a first knit row that includes a first yarn and a second yarn. The first and second yarns may be merged and form one or more knit structures. In these knit structures the positioning of the yarns may be controlled. A second section of the knit element may include a knit structure formed from the first yarn of the merged yarns and a knit structure formed from the second yarn of the merged yarns separate from the first knit structure.

In some embodiments, the knit element may include one or more sections having a jacquard knit sequence or pattern. For example, any section or group of sections may combine jacquard with merger, divergence, and/or inverse plating. These sections may be coupled together using knit structures, such as positioning knit structures.

In some embodiments, the knit element for a shoe upper may be a double-layer. Each of merged knit structures and/or separated knit structures may include a loop, a tuck stitch, or a float insertion. These knit structures may be positioned on an external layer, an internal layer, or in an interstitial space between the layers.

In some embodiments, a flat-knit element for a shoe upper may include a double layer having one of the separated knit structures positioned in an interstitial space between a first layer and a second layer of the knit element (e.g., a float insertion) based on a characteristic of the first yarn that is desired in that space. Further, a knit structure formed from another separated yarn may be knit in the first or second layer of the knit element.

In some embodiments, knit structures, in particular those formed from the separated merged yarns may be positioned at predetermined locations of the article. These predetermined locations may be based on the needs or desires of a designer, developer, and/or an end-user. The positioning of the separated yarns may allow specific characteristics of the individual yarns to enhance properties of the sections or zones on the shoe upper.

In some embodiments, the first and second yarns may be positioned after separation along a knitted row as two or more knit structures such that when a portion of one and/or both of the yarns is pulled, the knit structures inhibit snagging and/or unravelling of the knitted row in which the yarns are positioned.

In some embodiments, a first knit structure formed from a formerly merged yarn may include a vertical float insertion such that the first yarn forms a third merged knit structure in a second row of the first section of the knit element such that the first yarn is substantially limited to a first zone having at least one predetermined characteristic.

Yarns selected for use in the knit element of a shoe upper may be selected for a characteristic that is desired in the shoe upper. For example, yarns may be selected based on their processability or particular characteristics that aid in the manufacture of a shoe upper. Yarns used together may each be selected for a different characteristic. In some embodiments, the first yarn may be selected for a first predetermined characteristic and the second yarn may be selected for a second predetermined characteristic. Characteristics that may be used to select yarn may include, but are not limited to, elasticity, melt temperature, thermal regulation, antistatic, antibacterial, abrasion resistance, cut resistance, heat resistance, water resistance, chemical resistance, flame resistance, grip, thermal conductivity, electrical conductivity, data transmission, strength, weight, breathability, moisture wicking capability, water-repellence, compression, shrinkability, cushioning, reflectivity, insulation, durability, washability, reactivity, capability to absorb energy, and/or luminescence.

In some embodiments, a shoe upper may include multiple different merged knit structures that include different yarns. For example, a merged knit structure may be formed from any combination of yarns delivered to the flat-bed knitting machine. Thus, a third yarn and a fourth yarn may be merged to knit a merged structure and the second and fourth yarns may be merged to form another merged knit structure either in the same section of the knit element or different sections.

In some embodiments, shoe uppers having a predetermined design including a flat-knit element having multiple sections may include a section of one or more loops formed from two yarns and another section where the positions of the same two yarns in the loops are reversed. The yarns may extend continuously throughout the sections.

In some embodiments, the yarns may alternate in at least some loops of the knit element such that the predetermined design is created in the knit element.

In some embodiments, shoe uppers may include multiple sections including, for example, a merger section where multiple threads are knit or placed as one and a divergence section where the merged threads are separated. The positioning of each of the threads may be controlled in part by use of an automated or independently movable feeder. In the divergence section, there may be at least one first knit structure that is formed from the first thread of the merged threads and at least one second knit structure formed from the second thread of the merged threads.

In some embodiments, a shoe upper may include a knit structure formed from a first thread that is a vertical float insertion. The first thread may form a merged knit structure in a second row of the first or second sections of the knit element such that the first yarn is substantially limited to a first zone having at least one predetermined characteristic.

In some embodiments, a shoe upper may include multiple sections that include one or more jacquard knit patterns that include at least one of the first and second threads. At least some of the sections may be coupled to each other using knit structures. For example, a first section, a second section, and a third section may include jacquard knit patterns that include at least one of the first and second threads. Sections may be coupled to another section using knit structures.

An embodiment of a shoe upper may include multiple strands, for example, a first strand, a second strand, and a third strand. Each section of the knit may include at least two threads of the first, second, or third threads in a jacquard knit structure such that at least a portion of a predetermined design is formed.

In some embodiments, shoe uppers may be constructed as described herein such that a pair of matched shoe uppers are formed. The threads of the matched shoe uppers may be positioned using exchanging, merger, divergence, and jacquard knitting to create the paired predetermined design.

In some embodiments, a method of producing paired knit shoe uppers on a flat-knitting machine may include knitting a first thread having a first characteristic and a second thread having a second characteristic as merged threads to form a first section wherein the first thread is a first body yarn and the second thread is a first plate yarn. In some embodiments, the method includes positioning of the first and second threads in a second section of the shoe upper by adjusting a position of the threads by using a first independent feeder and a second independent feeder, respectively. Further, in some embodiments the method includes knitting the first yarn and the second threads as merged yarns to form a second section wherein the first yarn is a second plate yarn and the second yarn is a second body yarn; wherein the position of the yarns generates a first predetermined design in a first of the shoe uppers and a paired predetermined design in a second of the shoe uppers.

In some embodiments, a knit element may include first and second sections and a further third section in which positioning of threads is controlled by adjusting a position of the threads by controlled positioning of the first independent feeder and the second independent feeder. After positioning of the feeders as required, the method may include knitting the first yarn and the second yarn using separate cam systems such that the first yarn forms a first knit structure and the second yarn forms a second knit structure.

In some knit elements, three or more threads (e.g., yarns) may be used to create a double-layer knit element in multiple sections. At least one of the sections may include a jacquard pattern using at least two yarns. For example, a shoe upper may include a first section, second section, third section, and/or a fourth section constructed from three or more threads (e.g., yarns). The shoe upper may include a double-layer knit element in multiple sections and have a jacquard pattern using at least two yarns in the at least one of the first, second, third and fourth sections.

In some embodiments, a method for creating a knit element may include executing a knitting program based on a predetermined design for the knit element in a controller for a flat-knitting machine. Some methods may include executing a knitting program based on predetermined designs for knit elements for a pair of shoe uppers in a controller for a flat-knitting machine. In some embodiments, this may include adjusting a first knit pattern for the first predetermined design of the first shoe upper to generate a paired knit pattern that determines the paired predetermined design.

In any of the embodiments described herein, the knit elements and/or the uppers may be designed and constructed such that one or more zones having predetermined properties are formed. These zones may be formed from threads including yarns having a predetermined characteristic including, but not limited to elasticity, melt temperature, thermal regulation, antistatic, antibacterial, abrasion resistance, cut resistance, heat resistance, water resistance, chemical resistance, flame resistance, grip, thermal conductivity, electrical conductivity, data transmission, strength, weight, breathability, moisture wicking capability, water-repellence, compression, shrinkability, cushioning, reflectivity, insulation, durability, washability, reactivity, predetermined energy absorption and/or luminescence.

Knit structures may be located at specific locations of a knit article, knit element, or knit upper to impart specific properties and/or specific functionalities, where needed. For example, knit elements that may be used on lateral and/or medial sides of a shoe upper, may include merged threads such as multiple yarns. In sections of an upper, threads may be separated to selectively introduce threads such as yarns to predetermined positions of a knit element. Further, selective placement of threads may allow for the creation of tight knit structures to increase stability. For example, in some embodiments a temperature regulation yarn may be positioned on the inside of the article, whereas a water-repellent yarn may be positioned on the outside of the article.

Such a construction may be useful for footwear where the footwear may, for example, be equipped with different functions on the inside and the outside of the footwear.

Utilizing knitting machines that have independently controlled feeders (e.g., Stoll ADF knitting machines) that allow for feeding of threads (e.g., yarns) directly may significantly reduce knitting times depending on the materials, designs, stitch types, etc. Reducing knitting times for complex knit elements may also reduce production costs associated with a given knit element.

Further, the development of knitting machine configurations that allow for feeding of threads (e.g., yarns) from a position above the needle bed to the feeder to the needle may allow for a more consistent delivery of threads to the needle. Such a configuration reduces a length of the path of threads from the spool to the needle and thus the risk of breakage is reduced. In addition, tension in the threads has to be maintained over a shorter distance, thus tension loss may be reduced. In particular, such a configuration may allow the threads to be delivered to the needle having a pre-determined tension.

In some embodiments, machines may include feeders, needles, and/or needle beds that are capable of moving in 2 or more planes. In some embodiments, feeders, needles and/or the needle beds may move in 3 planes.

Feeders may be selected for use based on their ability to be used to form multiple types of knit structures. For example, in some embodiments, a multi-use feeder may be selected based on its ability to knit, plait, inlay, and/or create intarsia.

Use of independently controlled feeders that are multi-use, may allow for an increased control of the positioning of yarns, increase flexibility in the designs, and/or reduce knitting time.

For example, in some embodiments, an article includes a knit element, wherein the knit element includes a first section comprising at least two merged threads, both threads forming at least one loop, and a second section in which the threads diverge to include: (a) at least one first knit structure formed from a first thread of the merged yarns; and (b) at least one second knit structure formed from a second thread of the merged threads separate from the first knit structure.

Threads may be selectively positioned within a knit to create areas having predetermined physical properties. In some embodiments, the positioning of the threads (e.g., yarns, filaments, or wires) may be controlled such that any transition in physical properties in the knit occurs gradually.

In some embodiments, elongated materials such as threads, yarns, plies, fibers, filaments, wires, or the like may be fed to a knitting machine using one or more feeders. Multiple threads may be knit together as merged yarns in some embodiments. Merging and/or diverging of yarns allows for high flexibility of the yarns and/or physical properties of sections of the knit. Controlling the positioning of one or more threads, such as yarns, fibers, and/or filaments may allow for the merging and diverging of these threads throughout a knit element. For example, a merged yarn may be positioned within a knit or knit element such that it forms a stitch and/or knit structure. Merging and/or diverging of yarns may allow for controlling of the amount of a particular material placed in a knit and/or knit element by controlling the number of threads, such as yarns, fibers, filaments and/or plies, that are available for positioning in the knit.

Controlling whether a thread is available for positioning within the knit may include controlling the movement of one or more feeders, one or more needles, and/or the needle bed. Further, the types of needle used and the method of use may affect the positioning of the yarns in the knit.

Positioning of individual yarns, threads, strands, or groups of strands may be used to control properties of a knit, for example, a knit used in the creation of a shoe. For example, some knit elements may include zones having specific predetermined properties useful for various shoe elements.

Controlling the positioning of the yarns may include controlling how the yarns are provided to the needles of the knitting machine. Use of multiple feeders increases the flexibility by allowing the order in which the yarns are placed in the needles to be controlled on a needle by needle basis. This in turn affects placement of the yarns within the individual stitches.

For example, use of merging and/or diverging yarns may allow for the creation of multiaxial and multilayer knitted reinforced structures with a single needle accuracy. The ability to control placement of the yarns in the needle increases flexibility of placement of the yarns in the knit and further allows for enhancements in functionality.

Placement of yarns using single needle accuracy allows for the production of knits and/or knit elements that are fully customizable or designed for a particular user, sport and/or visual effect. This allows the designs to be flexible with respect to placement of materials as well as improves the ability of a design to meet functional needs.

In some embodiments, the threads (such as yarns) may be dosed depending on the desired properties in that section of the knit. The textile characteristics can be controlled in a detailed way since it is possible to use a broad variety of base materials on a stitch-by-stitch basis. For example, by utilizing specific inlay sequences it is possible to "dose" the knit or knit element such that specific product properties are achieved.

Due to the ability to control positioning of the yarns on a single needle level it is possible to create various inlay shapes. For example, there are few limitations, if any, on rectangular or curved pattern elements. Thus, it is possible to create sporty silhouettes, fading effects, and other visual effects.

The use of merging and/or diverging yarns allows for seamless transitions between areas of the knit having different properties. These seamless transitions reduce interruptions and/or irregularities in knit.

Controlling the positioning of the yarns in the manner described herein reduces the forces applied to the elongated materials, for example yarns, during the loop formation. Thus, it is possible to use a broader range of materials in the knit, for example, materials which are not easy to process. For example, materials such as stiff padding materials, conductive yarns, thick multifilament blends, non-stretchable yarns, metal yarns, reflective yarns, high strength yarns, etc.

Utilizing the methods described herein to control positioning of the yarns allows for additional degrees of freedom. For example, it allows individual yarn materials to be transformed into highly complex textile products. In addition, superimposed knit structures may be used in combination with existing knit styles.

As described herein, controlling the positioning of the yarns at the level of a single stitch and/or within a single stitch allows design features to be handled individually.

Knitting machines may be set and/or controlled in such a manner to allow yarns to be positioned within knit elements such that the knit elements have specific pre-determined properties.

For example, in some embodiments, needles may be selected based on their ability to create specific stitch types, sizes of stitches, stitches or inlays that include a predetermined plurality of strands, and/or desired properties determined by the product designer and/or selected by the user. In particular, needles may include but are not limited to compound needles, latch needles, etc. For example, the gauge of needle used may be selected based on the design for the knit element.

Position of needles may be controlled to influence the stitches. Needle positions include but are not limited to open, closed, half-open and/or half-closed.

In some embodiments, the movement of a needle and/or multiple needles may be controlled to control the positioning and/or tensioning of the yarns. For example, needles may be moved in a single plane, for instance, in a specific particular direction. Needles may be moved left, right, up, down, toward the front, and/or toward the back.

In some embodiments, a needle bed may be moved. Moving the needle bed may allow for additional control over the positioning of strands or yarns and/or the size, shape, and/or functional properties of knit structures.

The movement of feeders in one or more planes may allow for additional control of the positioning of yarns, strands, threads, filaments and/or any elongated materials that may be positioned using a knitting machine. For example, feeders and/or portions thereof may be moved in three planes to adjust the positioning of any elongated materials used in the formation of a knitted element. Independently controlled feeders allow for enhanced flexibility and reduced knitting times.

Further, some embodiments employ moving parts of the cam system in one or more planes to adjust the positioning of the yarns.

Elongated materials may be fed to a knitting machine using one or more feeders. Individual feeders may be positioned such that predetermined elongated materials are picked up by one or more needles. In some embodiments, individual feeders may be moved to allow one or more elongated materials to be positioned, for example, as at a float insertion. Multiple feeders may be used to deliver multiple elongated materials used to create knit structures and/or stitches.

Traditionally, yarns may be joined or commingled prior to entering the feeder. Commingled yarns are hybrid structures in which two different materials in the form of fibers are mixed to form continuous-filament yarns. Commingling techniques may use air jets to blend two types of filaments together at the filament level.

Stitches may include any constructions that may be formed using yarns, threads, or filaments on a knitting machine. For example, loops, floats, float insertions, tucks, transfers, etc. are examples of stitches which may be used to create various knit structures. In some embodiments, a knit structure may include a single stitch. Sometimes, however, a knit structure is a combination of multiple stitches.

Stitches may be formed as a result of controlling various aspects of the machine including but not limited to, for example, needles, cams, guides, sinkers, carriage, feeders, and/or tensioners.

The present disclosure allows a knitted element to have zones of functionality by merging and/or diverging yarns. For example, a knitted footwear can be constructed such that it has certain functions in specific areas by diverging two yarns into separate sections. Thus, the two yarns form loops in the first section, whereas in the second section, the two yarns diverge, such that the first yarn forms a first knit structure, whereas the second yarn forms a second knit structure separate from the first knit structure. In this way, the first section may have significantly different properties than the second section. Examples will be given below.

For further control of the positioning of the materials in a multilayer knit element merging and/or diverging of yarns may be combined with exchange and jacquard, for example, on a flat knitting machine. For example, yarns having different properties or colors may be selectively placed in a double layer knit element to customize the knit element for the needs of the end use. In particular, multiple yarns may be knit together to create an area having one or more predetermined properties. The yarns may then be separated from each other such that the yarns diverge, and the subsequent formation of loops may be controlled such that one yarn forms a knit structure on a back needle bed while a second yarn forms a structure on a front needle bed. In some embodiments, after the divergence there may be three knit structures formed, one on the front needle bed (e.g., loop, tuck, etc.), one on the back needle bed (e.g., loop, tuck, etc.), and knit structures formed between the beds (e.g., float, etc.).

Merger and/or divergence of threads may include controlling settings on a knitting machine in order to position yarns, including for example, to separate the merged yarns. For example, the carriage and/or feeders may be controlled such that a predetermined number of stitches using multiple yarns are formed in a sequence. In particular, the carriage of the knitting machine may travel in a first direction for the predetermined number of stitches. The carriage and/or feeders may then reverse and move in the opposite direction for a predetermined number of stitches.

In some embodiments, for example, a knit structure may be created on one side of a fabric knit on a double bed machine while the machine carriage travels in a first direction. Feeders may be moved independently of the carriage. After creating the knit structure, the machine may reverse and travel in a second direction creating additional knit structures on the original side, the other side of the fabric, and/or on both sides of the fabric.

According to the present disclosure, cams, sinkers and needles of a knitting machine can be used in a cooperative manner. The sinkers may mainly cover or protect the movement of the needle especially when the needles move to catch the new yarns. Sinkers and needles may operate in the same manner when utilizing merger and/or divergence, however, the resulting knitting technique and/or knit structure may be different. The merger and/or divergence techniques described herein allows for the separating of at least two yarn ends after they have been knitted on a given needle together. The two or even more yarn ends can then be systematically separated (e.g., divergence) and each fed to another further needle. These techniques carried out in a knitting system enables a wide variety of new binding structures including also float insertion technology.

In some embodiments, yarns which have previously been knit separately may be merged to be knit together. For example, merged yarns which diverged from each other for one or more stitches may later be merged and knit together. This greatly increases the ability to selectively place yarns and thereby control the properties of the resulting knit element. In some embodiments, yarns which have previously been knitted separately may be merged and knit together as merged yarns.

Generally, merger and/or divergence allows a designer, developer, and/or end-user to create patterns, textures and to modify the wearing and/or technical properties of a knit structure.

Further advantages of the present disclosure include the ability to determine on which layer of a multilayered knit element particular yarns, threads, plies, or filaments are knit. By diverging yarns, each yarn can form separate and distinct knit structures with the next stitch. For example, after the yarns are separated a first knit structure can be formed in a first layer and a second yarn may form a second knit structure in a second layer.

Another advantage is that merger and/or divergence of yarns allows for the creation of very precise sections or zones. Thus, the first section has a very sharp border with the second section, which allows for the creation of very precise knit patterns.

Furthermore, controlling the placement through the methods described herein allows for precise placement of yarns to a level that was previously not available. For example, yarns may be selectively placed on a stitch-by-stitch basis. Thus, unique connections between areas of knit sections are possible.

Further, the use of merger and/or divergence further enables the manufacturing and design of customized knit elements having precise configurations for yarn placement. This level of control in the yarn placement may allow the material cost, in particular costs of yarns to be reduced. In some embodiments, merger and/or divergence increases the capability to selectively place yarns having predetermined physical properties in very precise configurations. Predetermined physical properties of interest may include, for example, elasticity, melt characteristics, resistance (e.g., abrasion, cut, heat, fire, water, chemical), thermal regulation, grip, conductivity (e.g., thermal and/or electrical), strength (e.g., tensile strength), weight, breathability, moisture wicking capability, water-repellence, compression, shrinkability, cushioning, reflectivity, insulation, durability, washability, reactivity (e.g., to chemicals, environmental conditions, including moisture, and/or energy, in particular, light, heat or cold), luminescence, etc.

Specific predetermined properties of interest and the positioning of yarns either having and/or able to impart these characteristics on the final article may be determined by an end user, a designer, a developer, and/or the requirements of the article. By utilizing merger and divergence of yarns, a designer, a developer, and/or an end user can control placement of yarns in order to create customizable shoes. For example, it may be beneficial for a football (i.e., soccer) shoe upper to have particular yarn types positioned on the external surface of the key striking areas of the shoe to enhance grip, for example, while having a cushioning yarn placed proximate to predetermined portions of the foot during use. Controlled positioning of yarns through merger and/or divergence may be used to position a yarn with grip properties and a yarn with cushioning properties in such a manner to create specific zones on a shoe. In some embodiments of a multilayer knit upper, these zones may be selectively positioned on individual layers using a combination of merger and divergence.

Further, the disclosed technique also allows for tighter knitting, such that, for example, footwear with improved stability can be manufactured. By allowing the merged yarns to diverge into separate yarns, there are more possibilities to connect the front side to the back side of the knit element or even to connect "sections" of knit having different properties. This allows for a knit element with less stretch which is often desirable in certain positions. For example, an increase in stability may be desired in a shoe upper in the medial and/or lateral sides of a shoe upper, a heel portion, in the toe cap, surrounding laces holes and/or other openings. Particular configurations may depend upon the type of shoe or article of apparel.

Furthermore, the techniques of the present disclosure provide a knit material that is less likely to snag and unravel (similar to warp knitting in anti-snag, as materials do not affect the entire row when pulled). For example, yarns are secured individually within the knit as well as when they are merged which allows for additional and separate connections which increase the connectivity between the materials and reduces the likelihood that any snag would cause the knit element to unravel.

According to the present disclosure, the article may be an article of footwear, a shoe upper, an element for use on a shoe, apparel, or any other article that may be worn on the body or that may be carried, such as a bag.

In some embodiments, the first and/or second knit structures may comprise loops, tuck stitches, or float insertions. Thus, a wide variety of knit structures can be manufactured using merged yarns.

The knit element comprises a front side and a back side, wherein at least one of the first and second knit structures is positioned in the interstitial space between the front side and back side of the knit element.

A double-layer knit element may include a front side and a back side, wherein the first knit structure is formed on the front side of the knit element and, wherein the second knit structure is formed on the back side of the knit element. This configuration allows the front side and the back side of the knit element to have different functions in the second section as compared to the first section. Thus, in the first section, both merged yarns are on one side (or face) of the knit element (for example the back side), whereas in the second section, the first yarn may be on a first side of the knit element and the second yarn may be on a second side of the knit element.

In some embodiments, the knit structure on the back side may contain at least one held stitch to create at least one three-dimensional effect in the knitwear. In this way, a 3D-effect may be achieved, i.e. the knit element obtains a three-dimensional appearance instead of a flat knitwear. At the same time, the knit structure on the front side, formed by a first yarn may provide a certain function, for example water-repellence, abrasion resistance, and stiffness. Furthermore, holding a stitch of a second yarn on the backside allows, for example, a single-jersey upper to be formed merger, divergence or a combination thereof to create three-dimensional structures. The single-jersey upper may be seamless and while the first yarn continues on with loops, the second yarn may form float or tuck stitches.

In some embodiments, the first yarn may form loops and the second yarn may be used as a floating yarn. In this way, a plurality of different functions can be provided. For example, in some embodiments, an inelastic float yarn may reduce the elasticity of the knit element. An elastic float yarn may create stretch and/or create different compressions. This flexibility allows for more discrete and tailored positioning of yarns in the upper.

In some embodiments, the first yarn may form loops and the second yarn may form tuck stitches. This may create a three-dimensional wavy structure. Furthermore, the stretch of the knit element is reduced.

In some embodiments, the knit element may further comprise a second section knitted as an intarsia, wherein the first section and the second section are connected by knit stitches. This allows for the formation of different zones in the knit element.

A further aspect of the present disclosure relates to a method of manufacturing a knitted component for an article including knitting a first section comprising at least two merged yarns, both yarns forming at least one loop, separating the at least two merged yarns, and knitting a second section including: (a) knitting at least one first knitting stitch formed from a first yarn of the merged yarns; and (b) knitting at least one second knitting stitch formed from a second yarn of the merged yarns separate from the first knitting stitch.

In some embodiments, the separated yarns may be held using a thread holding element, for example, a feeder, a needle and/or a sinker.

Another aspect of the present disclosure relates to a method of manufacturing a knitted component for an article of footwear, the method including: (a) knitting at least a portion of an upper with a knitting machine; (b) holding the portion of the upper on needles of the knitting machine; (c) knitting a heel portion with the knitting machine while the portion of the upper is held on the needles; and (d) joining the heel portion to the first portion of the knit element.

This aspect of the present disclosure allows a knit upper with a three-dimensional shape to be formed in a single production step. An additional step of joining the heel portion to the rest of the upper can be omitted which saves production time and costs.

In some embodiments, the portion of the upper may be the forefoot portion, vamp, midfoot portion or a combination thereof. Thus, an entire upper or just a part can be formed together with the heel portion in a single production step.

The knitting machine may comprise at least two needle beds and the portion of the upper may be held on a first needle bed. Machines with two needle beds are common, such that the method according to the present disclosure can be performed on a variety of different knitting machines. While a portion of the upper is held on the first needle bed, the heel portion can be formed on the second needle bed of the same machine.

The heel portion may be knitted from a bottom portion to a top portion. Knitting in this direction may allow for additional flexibility when creating uppers with a mid or high-cut upper.

BRIEF DESCRIPTION OF THE FIGURES

Aspects of the present disclosure will be described in more detail with reference to the accompanying figures in the following. These figures show.

DETAILED DESCRIPTION

Figure 1A:
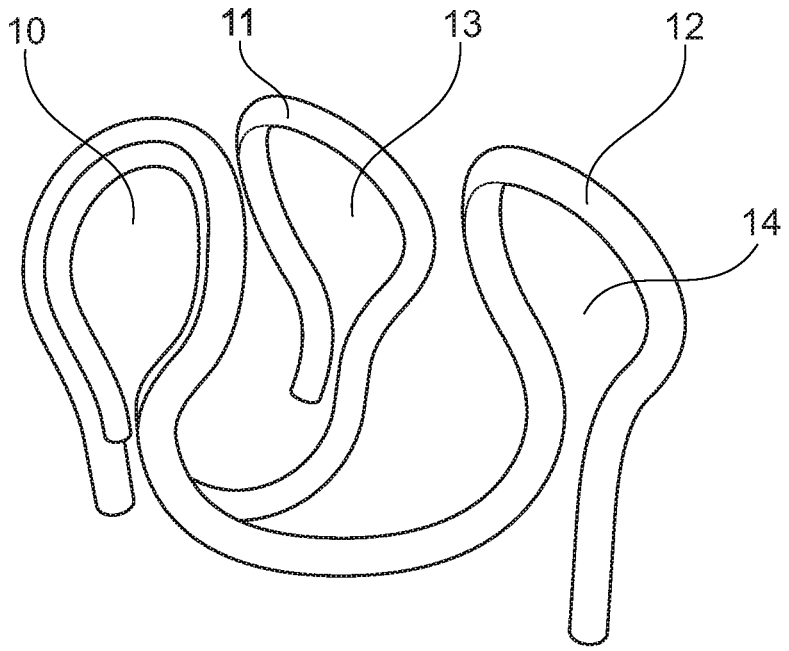
FIG. 1A shows a perspective view of the general concept of merger and divergence underlying the present disclosure according to some embodiments.

In the following, embodiments and variations of the present disclosure are described in more detail.

Threads as used herein may refer to elongated materials being delivered to a knitting machine. In particular, threads may be delivered from a feeder. Threads as used herein refer to one or more elongated materials including, but not limited to plies, plies of yarn, strands, filaments, wires, or yarns, delivered via a single feeder. Yarns may refer to elongated materials including but not limited to a structure of one or several fibers which is long in relation to its diameter and/or extruded materials.

Different functions may be achieved for example by using different types of merged threads, in particular various functional yarns. Functional yarns may include, for example, thermal regulating yarns, water repellant yarns, waterproof yarns, moisture wicking yarns, hydrophobic yarns, flame resistant yarns, cut resistant yarns, insulating yarns, antistatic yarns, hybrid yarns, hydrophilic yarns, absorption yarns, bulk yarns, monofilament yarns, multifilament yarns, any specialty yarns which have properties that are desired to be on an exterior surface of the knitted element, in particular an external surface of a shoe upper, and/or combinations thereof.

Threads used may be made from materials including but not limited to cotton, carbon, ceramics (e.g., bioceramics), polypropylene, polyester, acrylic, wool (e.g., merino, cashmere), mohair, viscose, silk, cellulosic fibers, casein fibers, thermoplastic polyurethane "TPU", polyester, polyamide, phenoxy, copolyester "CoPES", copolyamide "CoPA", metals including but not limited to silver, copper, nickel, titanium, or combinations thereof such as a nickel-titanium filament, and/or combinations thereof. In some embodiments, threads may be formed from multiple materials. In particular, a polyester yarn may be blended and extruded with additives, for example, including but not limited to titanium dioxide, silicon dioxide, aluminum oxide, zinc oxide, fibers such as carbon fiber, and/or other additives known in the art.

Further, threads of different types may be used in a knit element to impart specific properties to the element. In some embodiments, threads may be provided to a needle using different feeders. Alternatively, threads may be combined prior to the feeder such that they are provided to a needle from a single feeder.

A plurality of different threads, such as yarns may be used for the manufacture of knitwear according to certain embodiments in the present disclosure. For example, a temperature regulation yarn and a water-repellent yarn may be used in combination. Temperature regulation yarns may take many forms and have structural and material differences from standard polyester yarns. For example, a flat profile may be preferred over a traditionally spun yarn. In addition, some yarns used for temperature regulation may include natural materials, such as wool and/or synthetics, such as polypropylene.

Functional threads may be capable of transporting moisture and/or absorbing moisture, such as sweat. Functional threads may be electrically conducting, self-cleaning, thermally regulating, such as infrared sensitive threads, insulating, flame resistant, ultraviolet-absorbing, ultraviolet-stable, antibacterial, or some combination thereof. They may be suitable for sensors. Antibacterial yarns, such as silver yarns, for example, prevent odor formation.

Stainless steel yarn may include fibers made of natural materials such as wool, synthetic materials such as synthetic fibers (e.g., polyester), nylon, polyester, blends of nylon and polyester, and stainless steel. Properties of stainless steel yarn include temperature resistance, corrosion resistance, abrasion resistance, cut resistance, thermal abrasion, thermal conductivity, electrical conductivity, tensile strength, antistatic properties, ability to shield from EMI ("electromagnetic interference"), and ability to sterilize. In some embodiments, properties of the yarn such as conductivity of the yarn may be controlled by varying the composition. Stainless steel yarns for use herein may be constructed of one or more filaments. When multifilaments are used twist configurations may be used to control properties of the yarns.

In some embodiments, threads may be coated with materials to impart desired properties to a zone, knit element or upper. For example, some threads may be coated with carbon nanotubes. In some embodiments, yarns may be coated with polytetrafluoroethylene or a material with a melting point within a desired range.

In textiles made from knitwear, electrically conducting yarns may be used for the integration of electronic devices. These yarns may, for example, forward impulses from sensors to devices for processing the impulses, or the yarns may function as sensors themselves, and measure electric streams on the skin or physiological magnetic fields, for example. Examples for the use of textile-based electrodes may be found in European patent application EP 1 916 323.

In some embodiments, yarns that change phases based on application of energy may be used for example, bonding yarns, melt yarns, including materials such as thermoplastic polyurethane "TPU", copolyester "CoPES", copolyamide "CoPA", polyester, polyamide, phenoxy, and/or combinations thereof.

Melt yarns may be a mixture of a thermoplastic yarn and a non-thermoplastic yarn. There are substantially three types of melt yarns: a thermoplastic yarn surrounded by a non-thermoplastic yarn; a non-thermoplastic yarn surrounded by thermoplastic yarn; and pure melt yarn of a thermoplastic material. After being heated to the melting temperature, thermoplastic yarn fuses with the non-thermoplastic yarn (e.g. polyester or nylon), stiffening the knitwear.

The melting temperature of the thermoplastic yarn is determined according to standard practice known in the art and it is usually lower than that of the non-thermoplastic yarn in case of a mixed yarn.

Controlled positioning of elongated materials, such as threads, yarns, filaments, plies, strands, or the like, either having and/or being able to impart specific characteristics based on predetermined knit configurations may be desired to create a knit for a particular use. For example, a knit for use on an article may be designed by an end user, a designer, a developer, and/or based on the requirements of the article. By utilizing merger and divergence, a designer, a developer, and/or an end user can control placement of yarns in order to create customizable shoes. This may reduce an amount of total materials required for a specific design, as it allows for the controlled placement of materials.

Utilizing knitting machines that have independently controlled feeders (e.g., Stoll ADF knitting machines) that allow for feeding of threads directly may significantly reduce knitting times depending on the materials, designs, stitch types, etc. Further, the development of knitting machine configurations that allow for feeding of threads from a position above the needle bed to the feeder to the needle may allow for a more consistent delivery of yarns to the needle. Such a configuration described reduces a length of the path of threads from the spool to the needle and thus the risk of breakage is reduced. In addition, tension in the threads has to be maintained over a shorter distance, thus tension loss may be reduced.

In some embodiments, threads may be provided to feeders from feeding devices capable of providing threads at a predetermined tension to feeders and/or needles. Tensions of threads provided to the feeders may be controlled within a range from about 0.5 cN to about 40 cN. In some embodiments, tensions of threads may be controlled such that threads enter the feeders with tensions in a range from about 0.5 cN to about 20 cN. Threads may be provided to feeders at a predetermined tension based on design requirements for a particular application, for example, a particular type of sport shoe. For example, a design for footwear may involve controlling tension of threads provided such that a first zone of the shoe upper is constructed while a tension of the threads is in a range from about 0.5 cN to about 2.5 cN and a second zone may be knit while the tension in the threads used in the second zone is held in a range from about 0.8 cN to about 1.5 cN. Designs, functionality desired, and/or properties of the threads may determine the tensions used.

Controlling tension of threads may allow for the consistency in the size of stitches within an upper and/or knit element. Further, controlling tension of a thread provided to a feeder and/or a needle may improve design consistency across different sizes. For example, tension may be controlled such that stitch size remains within a pre-determined tolerance for a particular design across the sizes.

In addition, controlling tension of a thread provided to a feeder and/or a needle may increase consistency of stitch sizes throughout a production run. By controlling the tension in threads provided to feeders and/or needles quality of individual knit elements, uppers, as well as an entire production run may be improved such that production costs are reduced due to, for example, lower rejection rates. In some embodiments, tension may be controlled such that stitch size remains within a pre-determined tolerance for a particular design across a production run.

In some embodiments, controlling tension in threads may allow for production of a series of knit elements, such as shoe uppers, such that all of the knit elements are produced using threads at substantially the same tension. By controlling the tension in this manner, it is possible to have consistency in production. For example, controlling tension in threads may ensure that stretch in knit elements is consistent.

Further, controlling tension of threads may, in some embodiments, ensure that the design appears consistent across multiple and different sizes as well as throughout the production run. This may improve the quality assurance metrics for a production run. For example, controlling tension may allow for a lower rejection rate, ensure that surfaces of the knit element are consistent such that finishing processes to be applied to a surface of the knit can be consistently applied. In some embodiments, stretch and/or surface consistency may also be controlled by external elements, such as a skin layer.

Feeding devices may include, but are not limited to Memminger devices (e.g., EFS 700, EFS 800, EFS 920, MSF 3, SFE), LGL devices, and the like that provide threads to a knitting machine. Use of feeding devices may allow one or more threads to be delivered to the feeder and/or the needle having a pre-determined tension.

In some embodiments, knitting systems may include feeders, needles, and/or needle beds that are capable of moving. For example, one or more needles and/or feeders may be moved in one or more directions. In some embodiments, feeders, needles, and/or the needle beds may move in two or more planes.

The needles and/or feeders may be capable of moving along in multiple planes or axes. For example, in some cases needle movement may occur in two or more planes. In particular, needles may be moved along the needle bed (e.g., transversally, left-right), between the needle beds (i.e., front-back), up/down relative to the needle bed, and/or a combination of these. In some embodiments, the movement may occur in two planes at once, for example, a needle may be moved toward the space between the needle beds while also being moved up and away from the needle bed such that the movement of the needle is substantially at an angle relative to the needle bed.

Positioning of threads within a knit element may be affected, for example, by movement of the needle bed and/or needles (e.g., horizontal positioning, vertical positioning, front-back positioning), the type of needles, movement of the feeders, and/or movement of the carriage.

Merger in the context of the present disclosure is understood as feeding at least two elongated materials such as threads (i.e., filaments, plies, strands, wires, and/or yarns) simultaneously to a needle position of a knitting machine. For example, two threads fed from different feeders may be positioned with a single needle such that they are knit together to form a single loop.

Positioning of feeders may be used to control the positioning of the threads in a needle which determines the position of the thread in a loop. For example, in a fabric section in which two yarns are used, one thread or yarn may appear upon the back of the loop, while the other appears upon the face of the loop. It is possible to exchange these yarns by switching the positioning of the feeders delivering the yarns to a knitting machine.

Further, the use of merger and/or divergence further enables the manufacturing and design of customized knit elements having precise configurations for yarn placement. This level of control in the yarn placement may allow the material cost, in particular costs of yarns to be reduced. In some embodiments, merger and/or divergence increases the capability to selectively place yarns having predetermined physical properties in very precise configurations. Predetermined physical properties of interest may include, for example, elasticity, melt characteristics, resistance (e.g., abrasion, cut, heat, fire, water, chemical), thermal regulation, grip, conductivity (e.g., thermal and/or electrical), strength (e.g., tensile strength), weight, breathability, moisture wicking capability, water-repellence, compression, shrinkability, cushioning, reflectivity, insulation, durability, washability, reactivity (e.g., to chemicals, environmental conditions, including moisture, and/or energy, in particular, light, heat or cold), luminescence, etc.

In some embodiments, yarns having different melt temperatures may be used. Using controlled positioning of the yarns, for example by using merger, divergence or a combination thereof, one could control the activation temperature of particular areas of an article, such as a knitted upper by selectively placing yarns based on their melt temperatures. For example, a melt yarn having a lower melt temperature may be used in areas where it is difficult to provide energy to melt the yarns. Alternatively, it may be desired to use yarns having a higher melt temperature in areas that undergo high friction or are in close proximity to the foot. For example, melt yarns with a higher melt temperature may be used in areas of increased friction, such as laces holes where interaction between the laces and the article, such as an upper may generate heat.

In particular, zones of varying stability may be placed throughout a knitted element corresponding to, for example, an instep, a heel counter, and/or a toe box. A further example may include melt yarns with a higher melt temperature used in the toe box and/or heel counter. Use of merger and/or divergence in combination with the melt yarns, may allow for customized solutions allowing for placement of melt yarns in very precise configurations. In some embodiments, a lower melt temperature yarn may be used in the tongue while a higher melt temperature yarn may be used in the heel and/or toe box. Such combinations may be used throughout a knitted element to create zones having different physical properties depending upon the use of the knitted element.

A shrinking yarn may be a dual-component yarn. The outer component is a shrinking material, which shrinks when a defined temperature is exceeded. The inner component is a non-shrinking yarn, such as polyester or nylon. Shrinking increases the stiffness of the textile material.

A further yarn for use in knitwear are luminescent or reflecting yarns and so-called "intelligent" yarns. Examples of intelligent yarns include nanotech yarns and/or yarns that react to humidity, heat, cold, application of energy or other environmental conditions and alter their properties accordingly, e.g. contracting or expanding.

In some embodiments, stitches may become smaller or change their volume based on the environmental conditions. Temperature and/or humidity may affect threads such as yarns and any knits created therefrom such as knit elements or uppers. For example, a yarn may contract after experiencing a specific environmental condition and thus increase the permeability to the knitted component. Further, some yarns might be constructed such that the diameter of the yarn swells while the length of the yarn decreases when exposed to a specific environmental condition or a set of environmental conditions. For example, yarns may be affected by the presence of water.

In some embodiments, threads such as yarns may be transformed by application of energy. For example, yarn that includes carbon nanotubes and/or extruded hollow yarns may include an energy sensitive material that transforms upon application of energy. For example, a yarn that incorporates carbon nanotubes and/or extruded hollow yarns may have hollow areas filled with an energy sensitive material that transforms (e.g., swells) upon application of energy.

Yarns made from piezo fibers or yarn coated with a piezo-electrical substance are able to convert kinetic energy or changes in pressure into electricity, which may provide energy to sensors, transmitters or accumulators, for example.

In some embodiments, dissolvable yarns may be used during knitting using controlled positioning of yarns, for example by merger and/or divergence. This may allow for construction of a piece of knitwear that has zones or geometries that will be altered during or before use. For example, during knitting it may be useful to have a yarn as a placeholder capable of affecting the structure of the stitches and/or the structure of the knitwear which is subsequently removed in the final product. These dissolvable yarns may be placed with far greater specificity using merger and/or divergence.

In some embodiments, yarns may be treated, for example, washed, coated, treated with heat, steamed, annealed, and/or other treatments known in the art to produce a yarn having predetermined properties. Use of controlled positioning of yarns, for example, by merger, divergence or a combination thereof, allows for greater specificity in placing the yarns in a piece of knitwear, in particular an article of apparel and/or an element used in footwear. The first knit structure and the second knit structure may at least partially overlap. Thus, the knit element may have for example two different functions in the overlapping area, such as water-repellence and insulation.

Controlling positioning of yarns in a knit element may be achieved by controlling one or more of the elements of a knitting machine including but not limited to feeders, carriages, needles, needle beds, and/or cam systems.

Knitting systems that include individually controlled feeders may allow for controlled positioning of elongated materials such as yarns. Individually controlled feeders may allow knitting machine elements such as carriages to operate in a continuous manner. Continuous operation of carriages in a knitting machine may reduce overall knitting time for a given knit element. In turn, controlling and/or reducing the knit time for a custom knit element may reduce production costs when compared to conventional methods.

Use of independently controlled feeders may allow for complex, customized knitting elements that include custom knit structures will control production costs by minimizing knit times.

In some embodiments, kickback of a carriage may be used to control the location of yarns in the knit. For example, kickback refers to the movement of a carriage in a first direction and then a slight movement of the carriage in the reverse direction. Generally, knitting then continues in the first direction. However, kickback generally increases the knitting time and thus production costs. It has been estimated that kickback may increase knitting times by at least 50% or more. Further, kickback may require the use of a cam system to ensure that the yarns are accurately placed.

In some embodiments, independently movable feeders may be used to control the positioning of strands such as yarns.

Merger in the context of the present disclosure is understood as feeding at least two elongated materials (i.e., filaments, plies, threads and/or yarns) simultaneously to a needle position of a knitting machine. For example, two threads fed from different feeders may be positioned with a single needle such that they are knit together to form a single loop.

Positioning of feeders may be used to control the positioning of the threads in a needle which determines the position of the yarn in a loop. For example, in a fabric section in which two yarns are used one thread or yarn may appear upon the back of the loop, while the other appears upon the face of the loop. It is possible to exchange these threads by switching the positioning of the feeders delivering the threads to a knitting machine. As used herein exchanging the positions of the threads in a loop or other knit structure and knitting a section is referred to as exchanging.

FIG. 1A illustrates the general concept of controlled positioning of yarns, for example, merger and divergence underlying the present disclosure. Generally, feeding at least two threads such as yarns simultaneously to the needles of a knitting machine causes them to be knit together, but in such a way that one thread or yarn always appears upon the back of the layer, while the other appears upon the face of the layer. It is possible to exchange the position of these threads in the next knit structure by switching the position of the feeders on the knitting machine, this is an example of exchanging.

FIG. 1A depicts a portion of a textile knit on a double bed machine. Loop 10 includes two strands 11, 12 knit on a front needle bed. Strands 11, 12 are then separated from each other and transferred to a back needle bed were loops 13 and 14 are formed. Strands 11, 12 form loop 10 in a first section of the knit element. As further illustrated in FIG. 1A, the strands 11, 12 diverge and then each forms separate loops 13 and 14, respectively, on the second knitted layer which would be formed on the back needle bed. The loop 13 can be part of a first knitting element formed by the first strand 11, whereas the loop 14 can be part of a second knitting element formed by the second strand 12. As depicted in FIG. 1A, the first knitting element and the second knitting element are formed in different sections of the knit element, for example a knit element of a shoe.

In FIG. 1A, the strands 11, 12 may be merged together in the first section on a front side of the knit element as illustrated on the left side of FIG. 1A to form loop 10. Then, both merged yarns are separated and knit in the second section of the knit element. Both strands 11, 12 are sent to the back side to form distinct and separate knit structures. In some embodiments, it is also possible that both strands 11, 12 diverge and then form separate and distinct knit structure on different sides (layers or faces) of the knit element, i.e. on either the front side or the back side.

Figure 27:
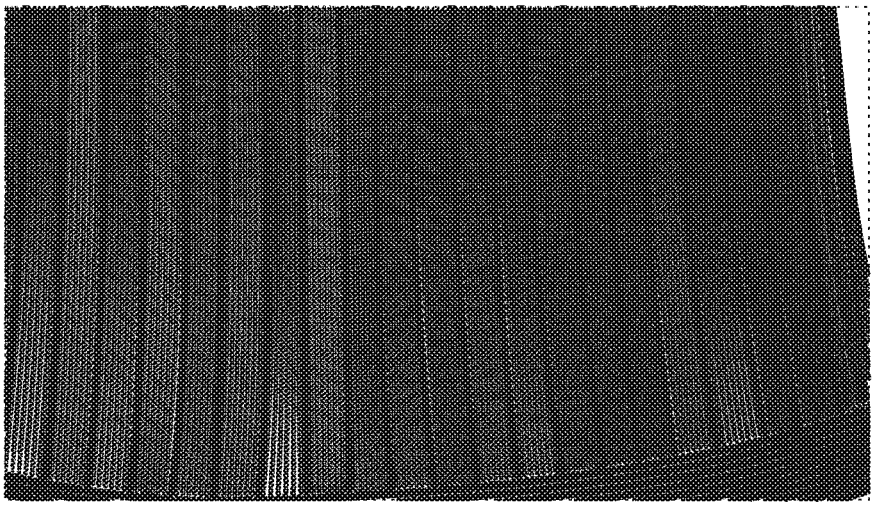
FIG. 27 shows a knit element that combines merger and divergence with a single jersey fabric according to some embodiments.

As depicted in FIG. 1A, the material is a double layer fabric knitted on two needle beds. In some embodiments, it may be possible for merger and/or divergence to be used on single layer fabrics (e.g., single jersey) as shown in FIG. 27.

To summarize, FIG. 1A shows a basic knitting procedure where the yarns are separated after knitting a first loop together on a given needle and forming individual loops on individual needles after that.

In addition, on machines having two needle beds, yarns may be positioned within the needle such that their position in the loop is controlled. In particular, when two (2) yarns are merged and knit to form a loop there are two positions in the loop for the yarns and two positions in the fabric for the loops. Therefore, for any given combination of two merged yarns, there would be potentially four constructions. For example, loops may be positioned on the front needle bed with yarn positioned in the loops at AB, BA and/or loops may be positioned on the back needle bed with yarn positioned in the loops at AB, BA.

According to an embodiment and as shown in FIG. 1A two merged yarns are knit in a first section as true merged yarns. In the second section, after the merged yarns diverge, or are separated from each other, each of the yarns may form a different knit structure at a different position within the knit.

Figure 1B:
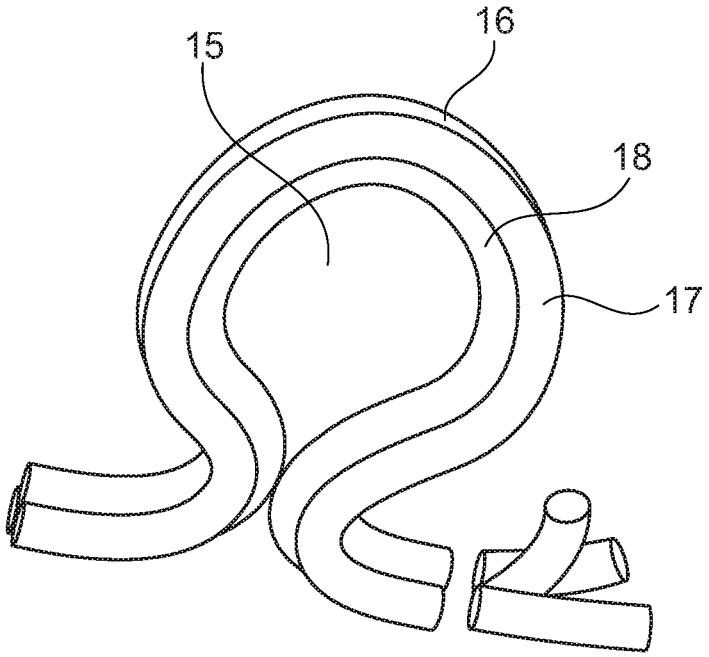
FIG. 1B shows divergence of three merged yarns into separate yarns according to some embodiments.
Figure 1C:
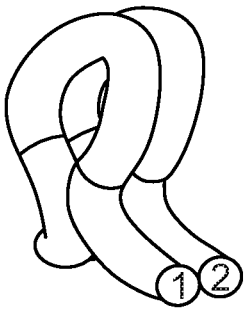
FIG. 1C shows a perspective view of two merged yarns according to some embodiments.
Figure 1D:
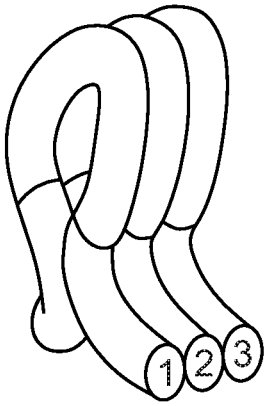
FIG. 1D shows a perspective view of three merged yarns in a loop according to some embodiments.

FIG. 1B shows a loop 15 knitted out of three ends of yarns 16, 17, and 18. After the loop 15 has been made, the yarn 16 may do a stitch, the yarn 18 may be used to create float insertion (e.g., in the warp direction), and the yarn 17 may do a tuck to another layer, for example. This combination is an example only and different combinations may be used in other embodiments. FIGS. 1C-1D depict merged threads 1, 2, 3 in a loop formation.

Figure 2:
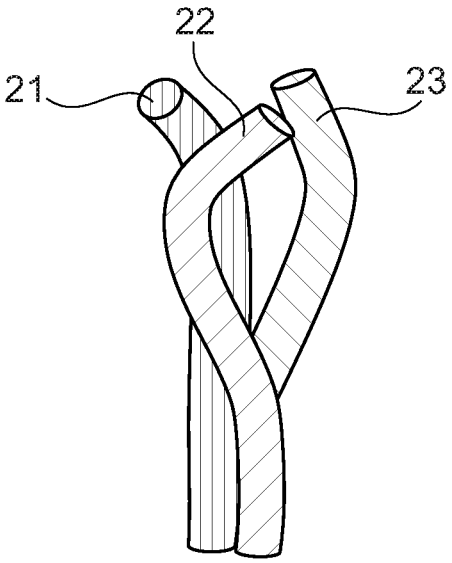
FIG. 2 shows a configuration with three merged yarns that are being separated, for example, to form distinct knit structures according to some embodiments.

It should be noted that the present disclosure is not limited to using two yarns. Any number of yarns may be merged together in a first section of a knit element and at least one of those merged yarns diverges in a second section of the knit element. For example, FIG. 2 illustrates a configuration with three merged yarns 21, 22, and 23. These merged yarns may form loops together in a first section of a knit element (as illustrated in the lower part of FIG. 2) and then diverge in a second section of the knit element, so that each of the formerly merged yarns 21, 22 and 23 forms a separate knit structure. However, it is also possible that only one of the merged yarns 21, 22, and 23 diverges from the two remaining merged yarns in the second section. For example, yarn 21 may diverge to form a first knit structure, whereas merged yarns 22 and 23 together form a second knit structure. When using three merged yarns, one yarn can, for example, diverge to the front of a knit element, one yarn can diverge such that it forms a structure on the back of the knit element, and one yarn can be used as a floating yarn. In some embodiments, further combinations may utilize any configuration of these stitches. Further, additional configurations may include using one of the yarns in any way possible in a knit, for example, as a vertical or warp float.

Using the techniques disclosed herein for controlled positioning of yarns may allow for tighter knitting, such that, for example, footwear with improved stability can be manufactured. By allowing the merged yarns to diverge into separate yarns, for example, there are more possibilities to connect the front side to the back side of the knit element or even to connect "sections" of knit having different properties. This allows for a knit element with less stretch which is often desirable in certain positions on a knit shoe upper or knit element for a shoe upper. For example, an increase in stability may be desired in a shoe upper in the medial and/or lateral sides of a shoe upper, a heel portion, in the toe cap, surrounding laces holes, and/or other openings. Particular configurations may depend upon the type of shoe or article of apparel.

Figure 3A:
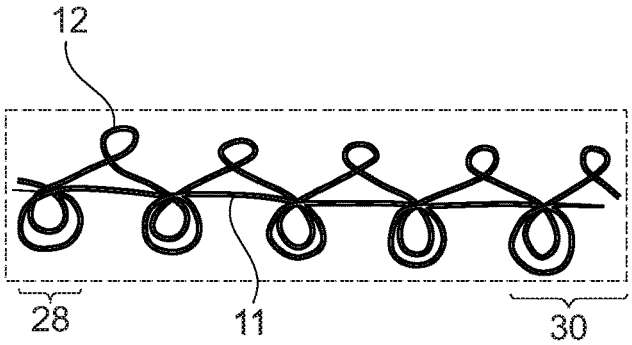
FIG. 3A shows a knitting sequence for at least a portion of a knit element according to some embodiments.

FIG. 3A shows an illustrative example of a knitting sequence for at least a portion of the knit element for a double needle bed knitting machine. Areas 30 delineate knitting activity for a pair of needles, one on a first needle bed and one on a second needle bed. Strand 11 and strand 12 are shown in FIG. 3A. At the first position 28 on the front layer of the knit element the strands 11, 12 are merged and knit together, such that that strand 11 is more visible on the front layer of the knit element. While strand 11 floats on the front layer strand 12 diverges and is sent to the back layer, such that it is visible on the back layer. In some embodiments, the stitches may be reversed so that the stitches on the front needle bed in FIG. 3A appear on the back needle instead and those on the back needle bed are formed on the front needle bed.

Figure 3B:
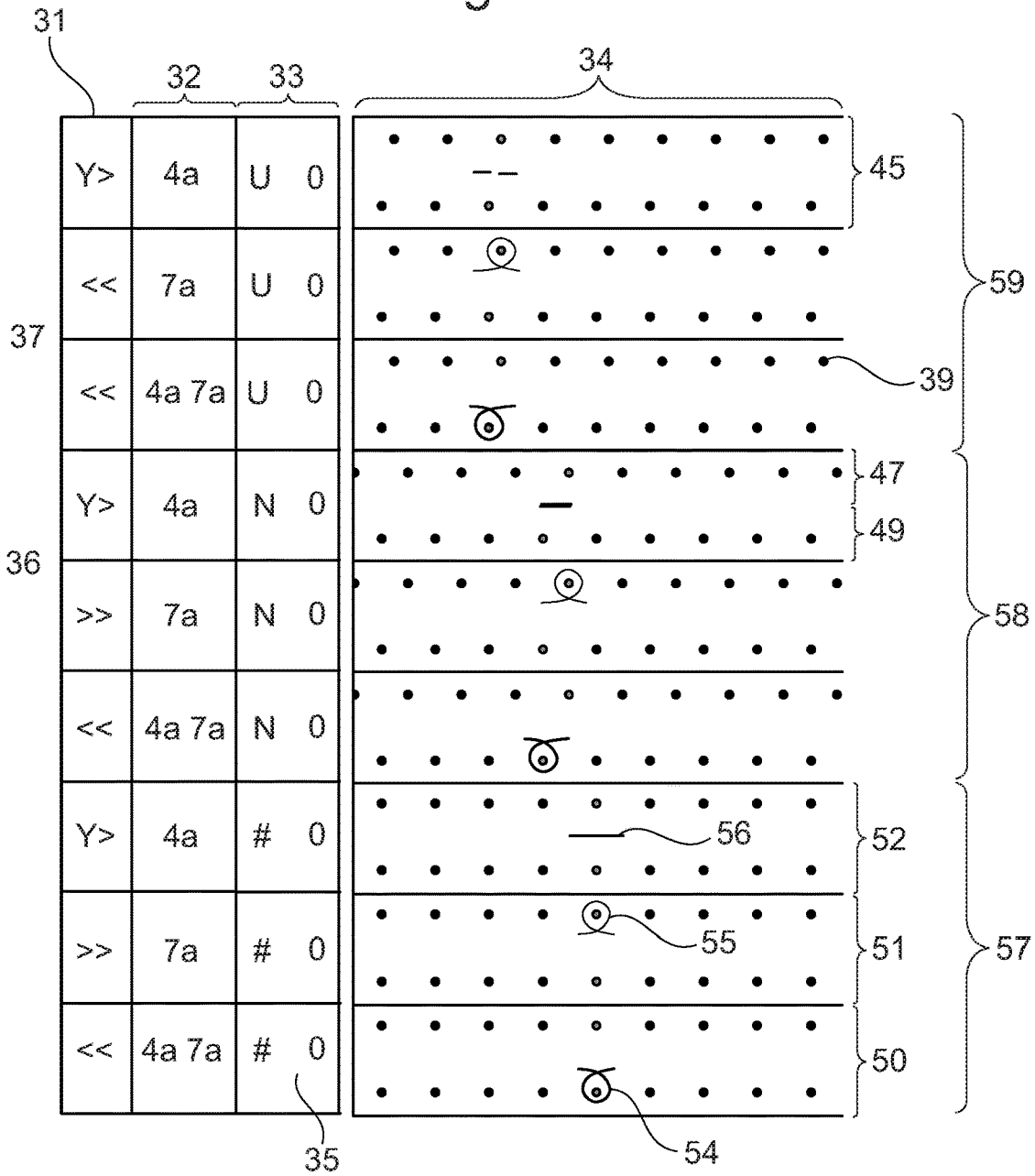
FIG. 3B shows a portion of a machine knitting sequence for at least a portion of a knit element according to some embodiments.
Figure 4A:
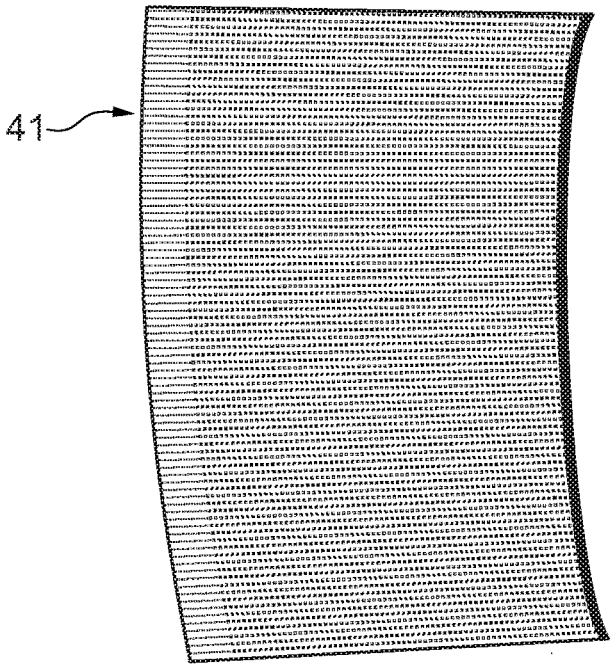
FIG. 4A shows a back side view of a knit element according to some embodiments.
Figure 4B:
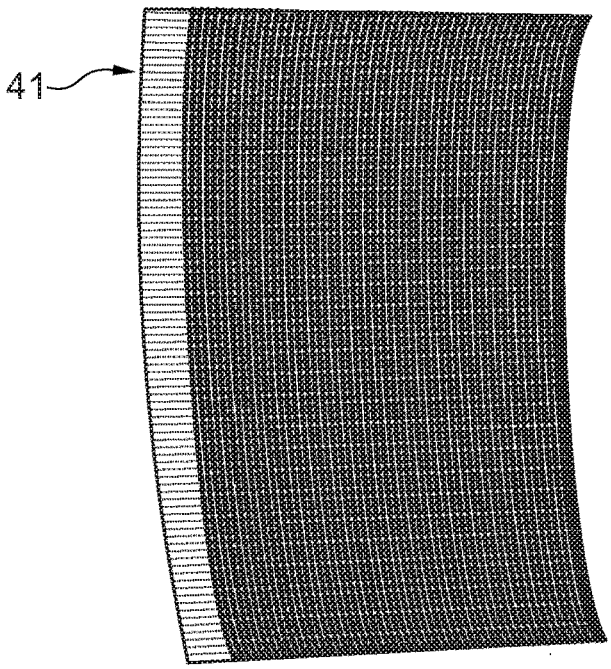
FIG. 4B shows a front side view of a knit element according to some embodiments.

FIG. 3B depicts an illustrative example of a flat knitting machine sequence for the simplified knitting sequence shown in FIG. 3A which is used to create sample textiles shown in FIGS. 4A-4B. Depicted as a matrix, columns 31, 32, 33, 34 shown in FIG. 3B depict various aspects of the machine that are controlled to create the textiles. Each row represents the action of one or more yarns during a carriage stroke of the machine. A length of a knit movement, for example, a carriage stroke may be defined by the number of stitches being formed during the movement.

Figure 20A:
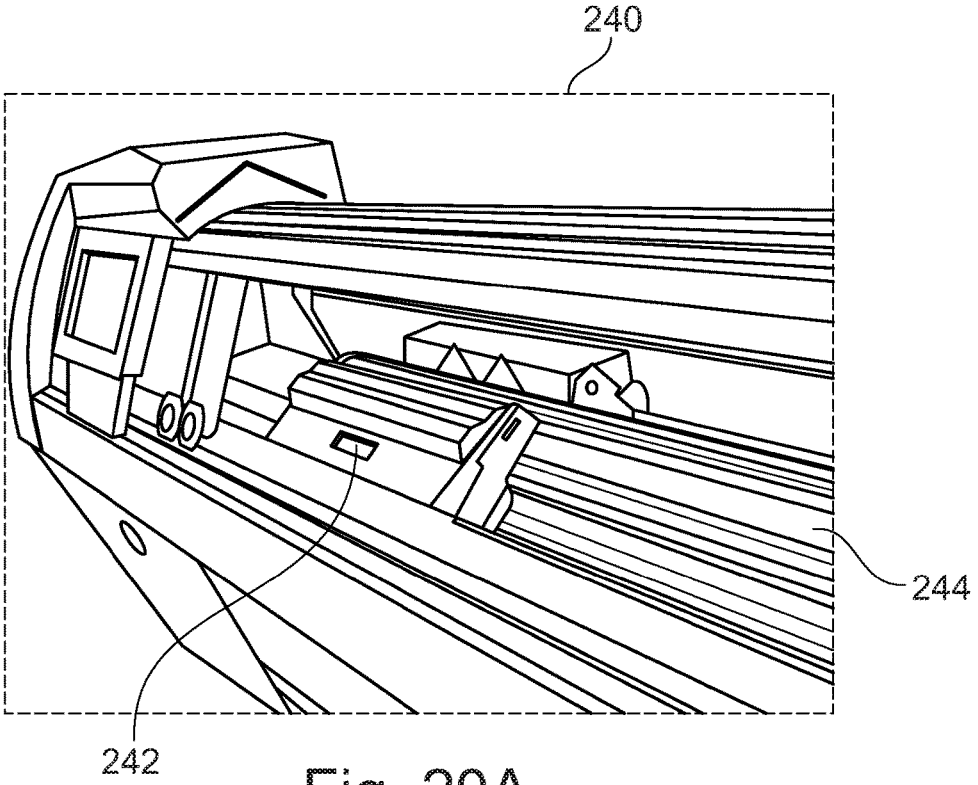
FIGS. 20A-B show images of a knitting machine according to some embodiments.
Figure 20B:
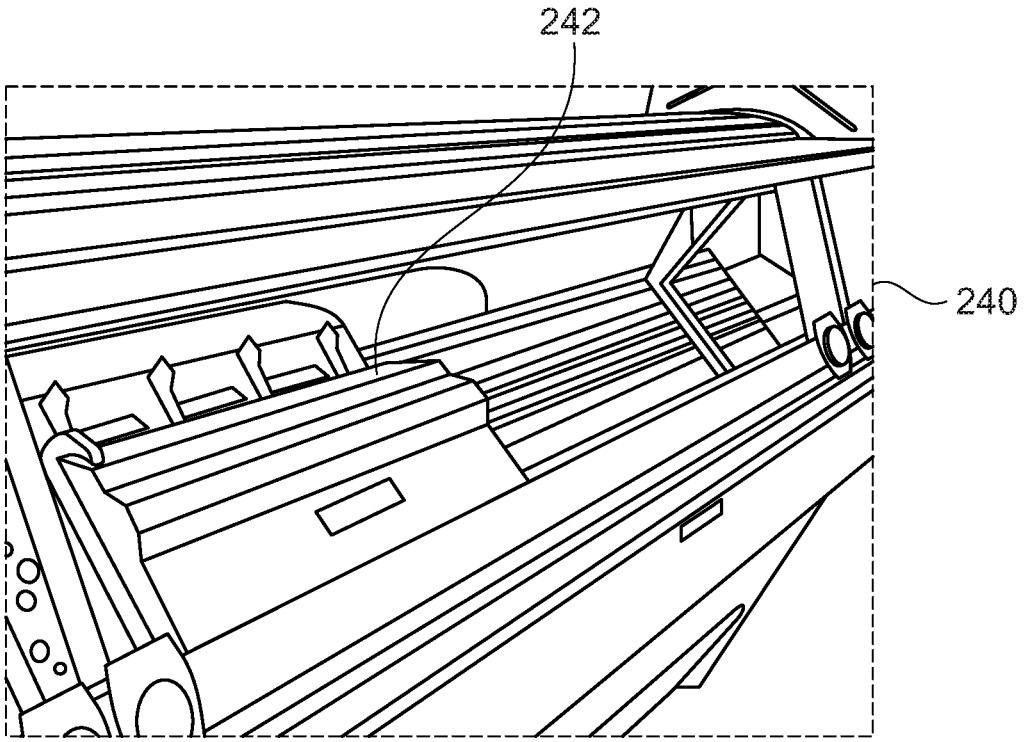
Figure 21:
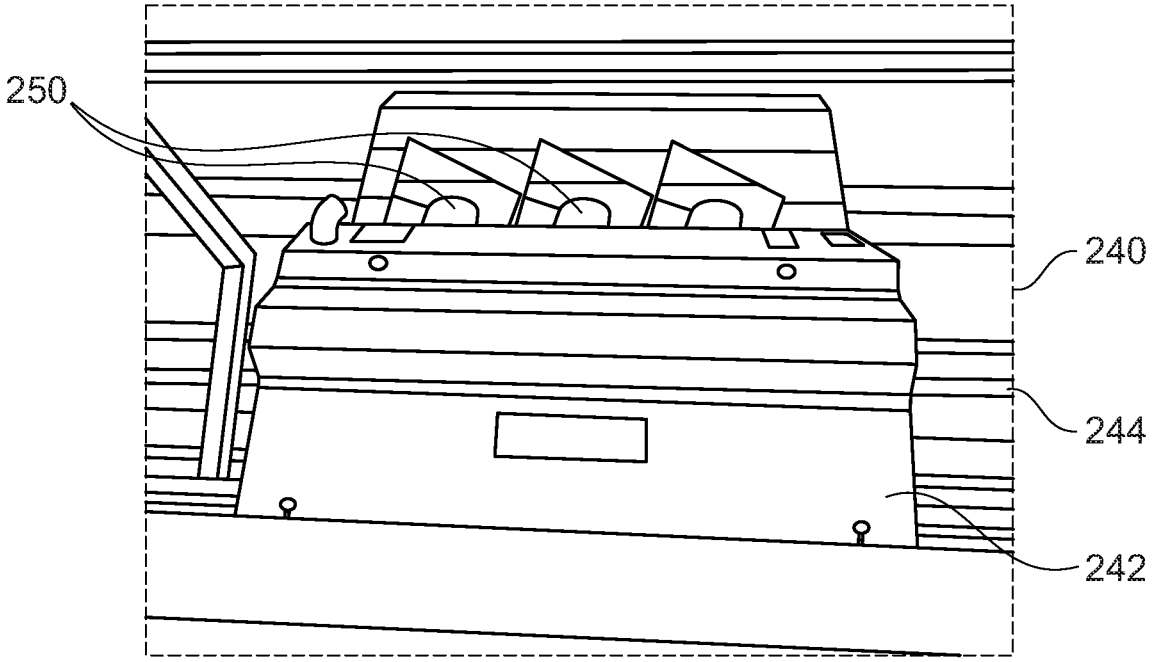
FIG. 21 shows an image of a carriage on a knitting machine according to some embodiments.

With respect to the machine settings, column 31 of FIG. 3B indicates the direction of the carriage in the knitting machine using directional arrows for any carriage stroke. As shown in FIGS. 20A-20B, the carriage 242 moves along the needle bed 244 (i.e., carriage stroke) of knitting machine 240 and adjusts the position of the needles using cams 250 (shown in FIG. 21). During a carriage stroke, knitting may occur on the front needle bed and/or the back needle bed or in the case of floats or float insertions between the needle beds. At row 52 of FIG. 3B, in column 31 "y" appears. This indicates the use of a particular flat knitting machine (i.e., the Stoll ADF machine) where one or more feeders may move independent of the carriage.

Knitting machines for use in production may be selected based on any number of features and/or capabilities of the machine. Knitting machines selected for use (e.g., Stoll ADF) may have unique capabilities including, but not limited to an ability of one or more carriages to move continuously in a transverse direction while placing multiple materials (e.g., yarn, inserts, plies, etc.), independent movement of yarn carriers, such as feeders, ability to position yarn feeders independently of each other, for example, to allow for predetermined positioning of a stitch, float, tuck, float insertion, universal yarn feeders (e.g., no requirement for separate, special yarn feeders to create float insertions), allowing every yarn feeder to be used to create a float insertion, an ability to create in any given course loops, tucks, floats and/or float insertions, knit structures such as loops, tucks, floats, and/or float insertions can be formed across rows, for example, in a vertical direction, and/or the knitting machine may include pushers, elements which push a float insertion down, and secure it during insertion ability to insert float insertions. In some embodiments, a pusher element may allow for the use of thicker threads and/or more plies of thread to be inserted in a controlled manner.

An embodiment may include a knitting machine that allows for the movement of feeders in one or more planes. Such movement of feeders may allow for additional control of the positioning of threads, yarns, strands, wire, and/or any elongated materials that may be positioned using the knitting machine. For example, in some embodiments, feeders and/or portions thereof may be moved in three planes to adjust the positioning of any elongated materials used in the formation of a knitted element. Independently controlled feeders allow for enhanced flexibility and reduced knitting times.

A knitting machine may be selected for use based on its ability to adjust position of threads, yarns, strands, threads, and/or any elongated materials in multiple planes of a knitted element such that a multiaxial knit element is formed. Different zones within the knit element may be positioned in different planes.

Figure 23:
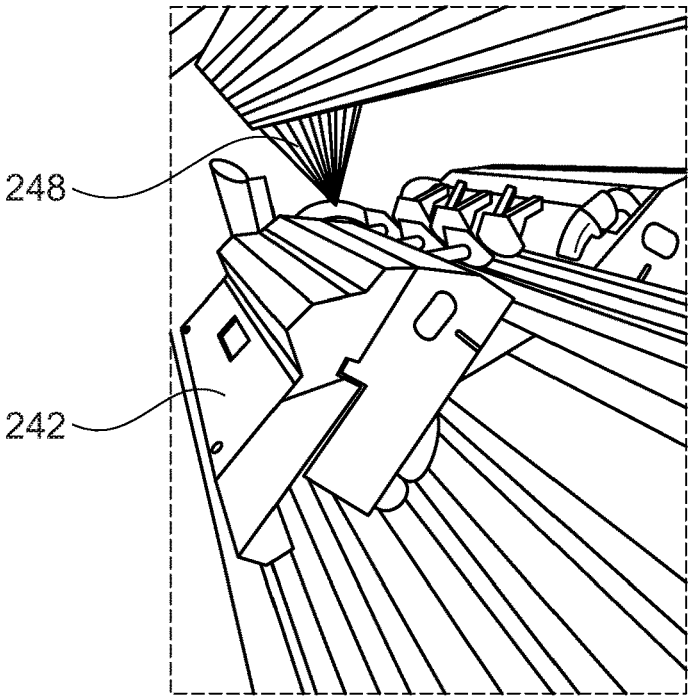
FIG. 23 shows an image of the needle beds of a knitting machine according to some embodiments.
Figure 24:
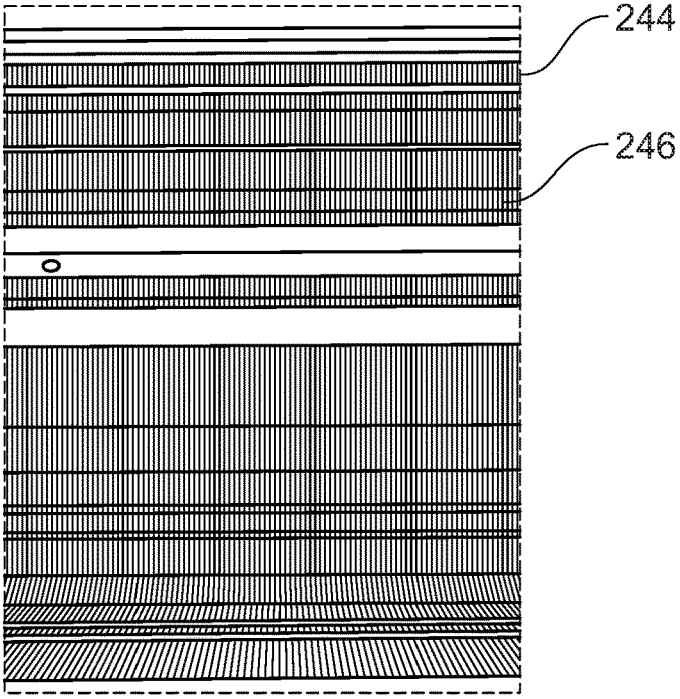
FIG. 24 shows an image of a knitting machine according to some embodiments.

Column 32 of FIG. 3B shows the feeder or feeders 248 (shown in FIG. 23) that are active for a given carriage stroke. In the example shown, feeders 248 are independent of carriage 242 as shown in FIG. 23. The independence of the feeders allows for greater flexibility in controlling the threads provided. For example, using independent feeders allows for a larger range of motion for any particular thread that may be knit, transferred, tucked, floated horizontally, floated vertically, or floated at practically any angle in the knit. Further, the feeders may be electronically controlled, which may allow for more precise movements and allow for more precision in the placement of threads.

Figure 22:
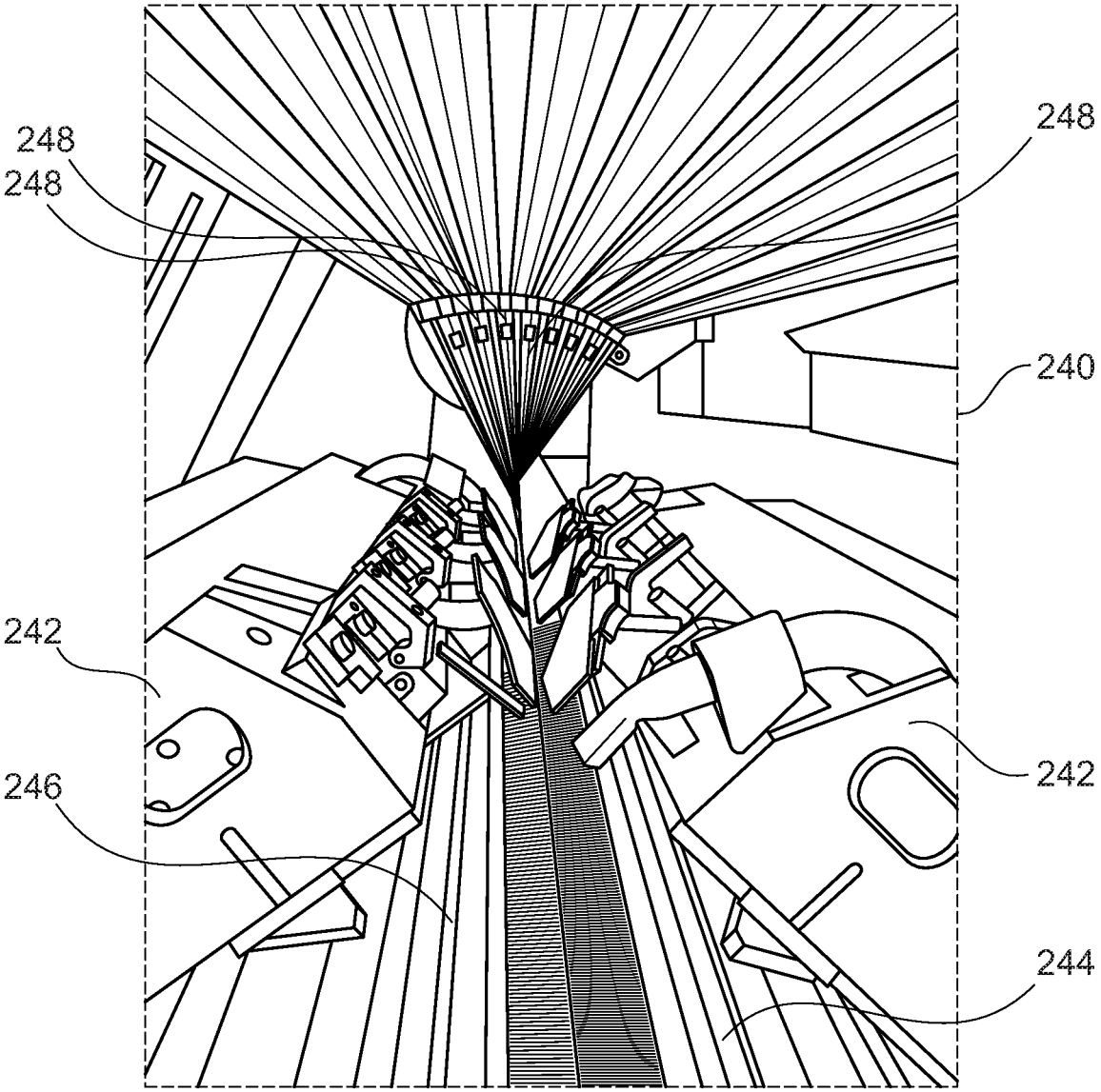
FIG. 22 shows an image of a knitting machine according to some embodiments.

Controlling feeder position during knitting allows for control of the position of threads. A feeder may be controlled such that the position of the thread delivered in the needle is selected. As shown in FIG. 22, feeders 248 may be positioned at specific angles to deliver threads to needles. In some embodiments, the order that the feeders approach a needle to be knit will affect the order of the threads in the needle and the order of the threads in any knit structure formed by the needle. For example, in some embodiments, multiple feeders may be moved during knitting proximate a predetermined needle in order to deliver the threads in a particular order. At the next needle to be knitted, the position of the feeders may be changed to control the position of the threads in any knit structure formed, such as a loop.

Use of independently controlled feeders allows for more flexibility when merging and/or diverging threads. Historically, delayed feeders were used to control the positioning of threads within loops. However, use of delayed feeders would affect the knit element by increasing a length between stitches for at least one of the separated threads. This may affect a visual aspect, stretch properties, and/or stability of the knit element.

Thus, use of independent, electronic feeders may enhance knit quality and feasibility of merging, diverging, and combinations thereof. In some embodiments, merger of threads may result when multiple feeders are moved during knitting proximate a predetermined needle in order to deliver the threads in a particular order. At the next needle to be knitted, the position of the feeders may be changed such that not all threads delivered at the previous location are delivered to next needle position to used. By not providing the same threads to the next needle to be knitted divergence of at least one thread occurs.

In some embodiments, independent, electronic feeders may be used to combine merging, diverging, and other knit structures and/or techniques, such as intarsia, jacquard, tuck stitches, spacer, exchanging, selective merger, partial knitting, double jersey, and single jersey. For example, merger and/or divergence may be combined with jacquard knitting within a row or course of a knit element.

Use of a carriage that has the ability to move continuously may, in some cases, decrease knitting time. Continuous movement of the carriage may be in transversal direction along a course of knitting in some embodiments. Using multiple feeders positioned at various angles relative to the needle bed, as shown in FIG. 22, may allow the feeders to pass each other during knitting. By moving the feeders to control the positioning of the threads in the needle and therefore the knit structure, the carriage may continue to move during knitting without stopping. Using such a configuration in a knitting system will allow the positioning of the threads to be changed at the various needles without having to stop the carriage.

Knitting elements such as knit shoe uppers on a knitting system that allows the carriage to move continuously while changing the positioning of multiple threads and/or plies without stopping and/or without using kickback may reduce knitting time as well as an amount of material (threads, yarns, plies, etc.) used.

In some embodiments, the ability of one or more carriages on a flat knitting machine to move continuously in the transverse direction may be useful when using materials complex or sensitive materials (e.g., silk). For example, a sensitive material such as a silk yarn may positioned such that border loops formed from silk may be bigger than for other materials and/or loops positioned away from a border of fabric.

Further, utilizing such carriages capable of continuous movement while simultaneously positioning one or more materials may allow for more consistent shearing forces.

FIG. 22 depicts a double needle bed flat knit machine 240 with multiple feeders 248 that can be controlled independently of the carriages 242. Given the configuration of the knitting machine and carriage 242, yarns may be fed directly to the needles of needle beds 244, 246 from feeders 248. The ability to feed the yarns in this manner may allow for more consistent control of the tension of the yarn during the knitting process.

In some embodiments, the feeders may be independently controlled. For example, the one or more feeders may be controlled using motors. One or more motors may be used to control both the vertical and/or horizontal movement of the feeders.

During carriage strokes one or more feeders may be active. In some embodiments, for example, depicted in FIG. 3B at row 50 multiple feeders 4*a*, 7*a* are used during the carriage stroke to the left as is indicated in column 32. During the next carriage stroke to the right represented by rows 51, 52 the merged yarns diverge from each other and feeder 4*a* acts independently of feeder 7*a* to form the knitted structures of rows 51, 52.

Figure 3C:
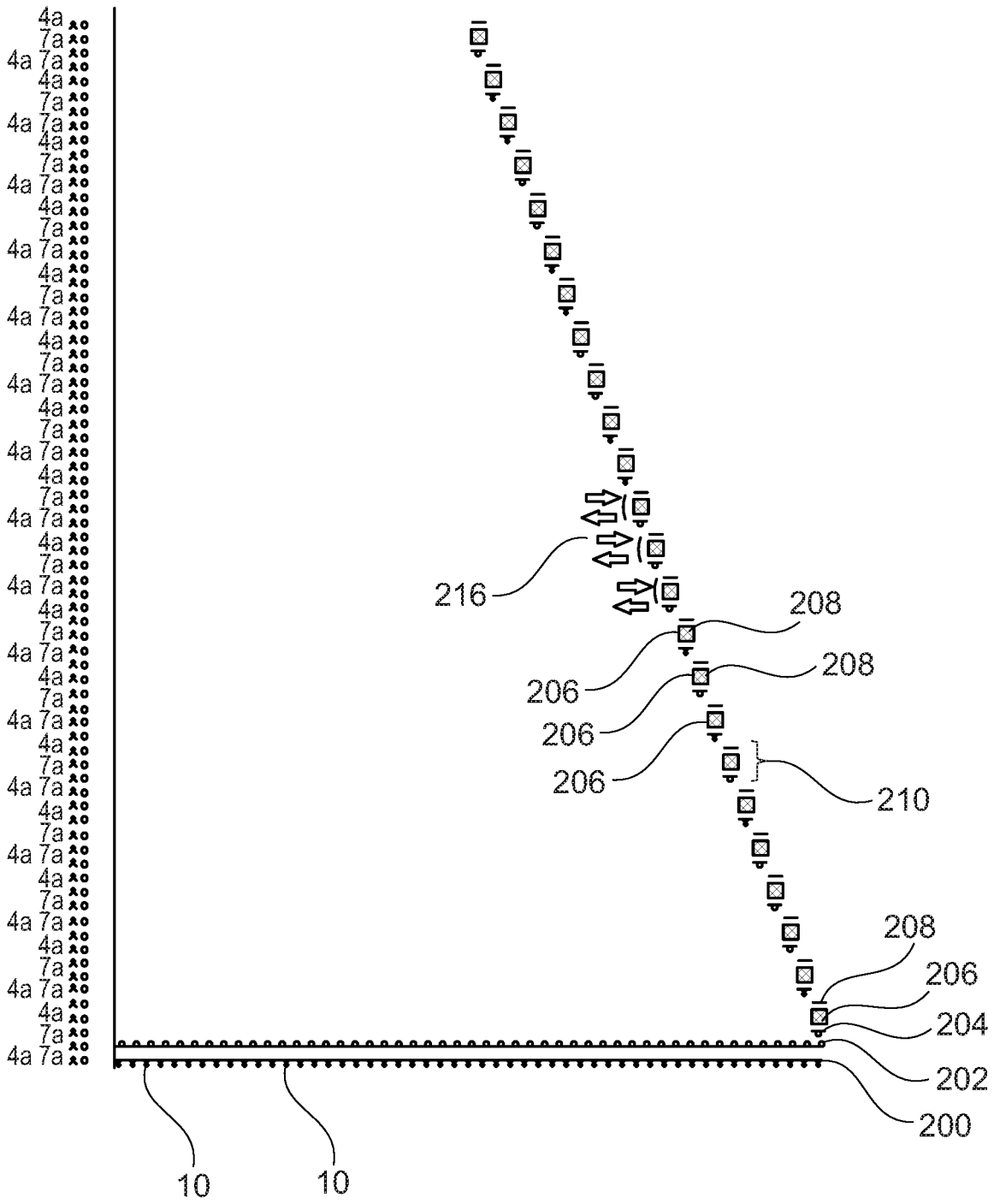
FIG. 3C shows a portion of a machine knitting sequence for at least a portion of a knit element according to some embodiments.

As shown in FIG. 3B, column 33 indicates how far paired needles located on the different needle beds 244, 246 (shown in FIG. 22) are offset from each other in a direction along the length of the needle bed. In the example provided, the settings shown represent three different positions of the back needle bed relative to the front needle bed. Setting 35 denotes that the needles on the front and back needle beds are aligned with each other, that is, there is no offset between the two beds. Setting 36 indicates that the front needles are positioned in the middle of the space between the two back needles. Setting 37 indicates that the needles on the front and back needle beds are only slightly offset. The illustrative example shown in FIG. 3B shows the offset changing for each of the zones 57, 58, 59. However, it may be desired to maintain the same offset throughout a portion of a knit element as is shown in FIG. 3C. Further, offsets may be varied in various portions of the knit element to form zones having predetermined characteristics. Positioning of the needle beds may differ on different machines, and any offsets may be utilized with merger and/or divergence, depending on the desired knit element.

Column 34 of FIG. 3B depicts the stitches made in a given carriage stroke. Each box 45 in column 34 represents a carriage stroke for a yarn or multiple yarns which are being knit together. Each box contains two rows of dots which represent front needle bed 38 and rear needle bed 39 and showing needle positions 47. Knit stitches 48 and floats 49 are indicated for each carriage stroke on the needle bed.

As shown in both FIGS. 3A and 3B, two strands are used to create the samples using feeders 4*a*, 7*a*. Strand 11 (depicted in FIG. 3A) is provided to the knitting machine using feeder 7*a*, while strand 12 (depicted in FIG. 3A) is provided to the knitting machine using feeder 4*a*. FIG. 3B depicts an excerpt of a machine knitting sequence including three sections 57, 58, 59.

Reading the machine knitting sequence of FIG. 3B from the bottom up, row 50 depicts strands 11, 12 (shown in FIG. 3A) merged together and knit on the front needle bed during a carriage stroke to the left as is indicated in column 31 to form knit stitch 54. As is shown in FIG. 3B, as the carriage moves back to the right strands 11, 12 (shown in FIG. 3A) diverge or are separated from each other which is depicted in rows 51, 52. In row 51, strand 11 forms a knit stitch 55 on a single needle on the back needle bed 47. Row 52 depicts strand 12 forming a miss stitch or float 56. In order to create this float, feeder 4*a* moves independently of the carriage. Both rows 51, 52 occur during a single carriage stroke to the right. As shown in FIG. 3B, all stitches 54, 55, 56 occur at a single needle position which includes a needle on the both the front and back needle beds.

In some embodiments, multiple carriage strokes may be used to create the stitches shown in row 51 and row 52 separately. In some embodiments, stitches 55, 56 may be formed contemporaneously. Timing of the formation of the stitches may depend on the specific stitches involved, connections between fabric formed on the front and back needle beds, types of yarn, etc.

FIG. 3C shows an illustrative example of an excerpt of a machine knitting sequence depicting merger and divergence. Yarns provided by feeders are knit to form merged loops 10 at all positions on the front needle bed as the carriage moves to the left in area 200. Area 202 depicts providing yarns using feeders such that they are knit on the back needle bed during the first carriage stroke to the right. During the next carriage stroke to the left, strands 11, 12 (depicted in FIG. 3A) are knit on front needle bed during the carriage stroke to form stitch 204. As is shown in FIG. 3C, as the carriage moves back to the right strands 11, 12 (shown in FIG. 3A) diverge from each other. Strand 12 (shown in FIG. 3A) is knit on the back needle bed to form stitch 206. Strand 11 (shown in FIG. 3A) is floated to form stitch 208, which is a miss stitch.

As shown in FIG. 3C, stitches 206, 208 are formed during the same carriage stroke 216 moving to the right. In some embodiments, stitches may be created substantially contemporaneously. For example, they may be formed during the same carriage stroke. In some embodiments, multiple carriage strokes may be used to create the stitch 206 and stitch 208 separately.

Series 210 that includes stitches 204, 206, 208 may be repeated in succession until a predetermined length of a course and/or row is reached. Once the predetermined length is reached, the knitting process starts again on the left and continues in the same manner until the desired length is met in that direction. This process may be repeated to create knit elements of a predetermined length along the wale. In some cases, a knit element spanning multiple courses and/or rows and wales may be created as is shown in FIGS. 4A, 4B.

As can be seen in the example shown in FIG. 3C, during each carriage stroke a single needle is used on the front needle bed to form stitch 204 and a single needle is used on the back needle bed to form stitch 206, while missed stitch 208 forms between the needle beds. In some embodiments, multiple stitches may be formed in succession on the front and/or back needle beds, and/or floated in either a horizontal or vertical direction depending on the desired characteristics for the knit element.

FIG. 3C shows an example where the offset between the needles on the front and back needle beds is set to a position where the front needles are positioned in the middle of the space between the two back needles.

The description of FIGS. 3A-3C are meant to be illustrative examples. Various settings, stitches, and yarns may be substituted from in the examples above. In some embodiments, multiple yarns may be merged together and split into different stitches in different sections of the knit element. For example, three or more different yarns may be merged together and later separated such that in the subsequent stitches in a double-layer fabric may result in a first yarn knit on a front side of the fabric, a second yarn forming a float between the front and back sides of fabric and the third yarn forming a loop on the back side of the fabric.

In some embodiments, merger and/or divergence may be used in predetermined areas to control properties of the knit by selectively placing yarns. Use of both merger and divergence allows for the controlled placement of yarns at a resolution much higher than currently used today. For example, multiple yarns may be merged and then separated to create various knit structures.

FIGS. 4A and 4B show an illustrative example of a knit element 41 created using the knit sequences depicted in FIGS. 3A and 3C. While FIG. 4A shows the back side of the knit element 41, FIG. 4B shows the front side of the knit element 41. This knit element 41 is knitted according to the knitting sequence of FIG. 3, such that the strand 11 is visible on the front side in FIG. 4B, whereas the strand 12 is visible on the back side in FIG. 4A. As shown in the knitting sequence depicted in FIG. 3A, strands 11, 12 are both knit on the front side of knit element 41. Strand 11 is positioned on the front side of the stitches and strand 12 is positioned on the back side of the stitches of the knit element 41, specifically at stitches in the first, third, fifth, seventh and ninth positions. After the first stitch on the front needle bed the yarns diverge, so that at the second stitch strand 11 floats across knit element 41, while strand 12 is moved to the back side of the knit element 41 and knit at the second stitch. At the third stitch, strands 11, 12 were merged together to form the third stitch on the front of the knit element 41. This pattern is repeated as is shown in the knitting sequence depicted in FIG. 3.

Figure 5A:
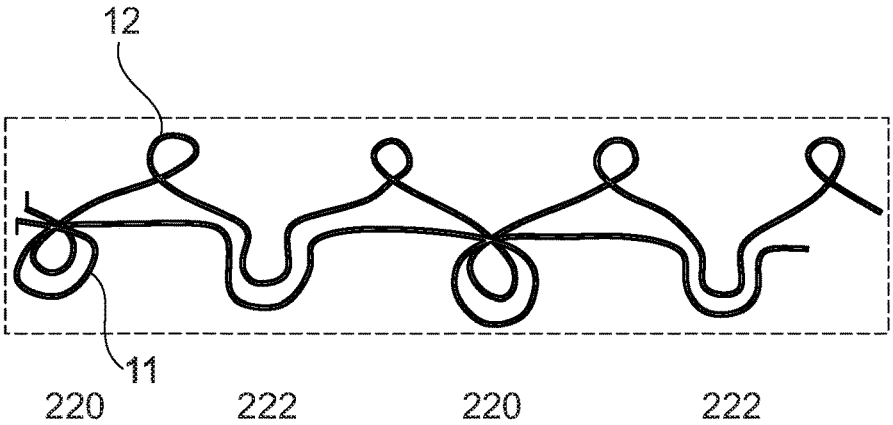
FIG. 5A shows an example of a knitting sequence depicting merger and divergence of two yarns according to some embodiments.

FIG. 5A shows an example of a knitting sequence depicting merger and divergence through combining knit stitches, tuck stitches, and floats. For clarity, portions 220, 221, 222 depict the stitches knit on both the front and back needle beds for a given needle. Strands 11, 12 are merged together on the front needle bed at portion 220. Then strands 11, 12 are separated and strand 12 is knit on the back needle bed at portion 221 which results in strand 11 forming a float. At portion 222, strands 11, 12 are merged and form a tuck stitch on the front needle bed. Then strands 11, 12 are separated again and strand 12 is knit on the back needle bed while strand 11 is floated. As depicted in FIG. 5A, portions 220, 221, 222 may be repeated.

Figure 5B:
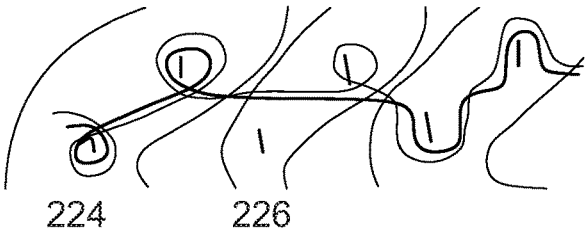
FIG. 5B shows an example of a knitting sequence depicting merger and divergence of two yarns according to some embodiments.

FIG. 5B depicts portions 224, 226, 228. In portion 224, the yarns 223, 225 are merged and knit on the front and back needle beds. Then yarns 223, 225 diverge or separate from each other. At position 226, yarn 223 is knit on the back needle bed and yarn 225 is floated to create a miss stitch. In portion 228, yarns 223, 225 are merged again and tuck stitches are formed on both the front and back needle beds.

Figure 5C:
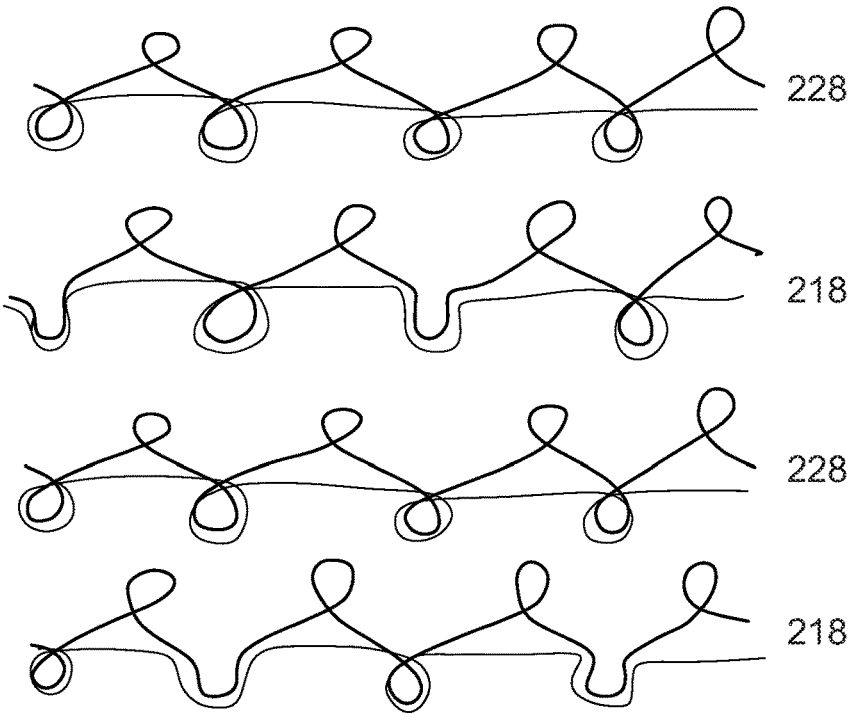
FIG. 5C shows examples of knitting sequences depicting merger and divergence of two yarns according to some embodiments.
Figure 5D:
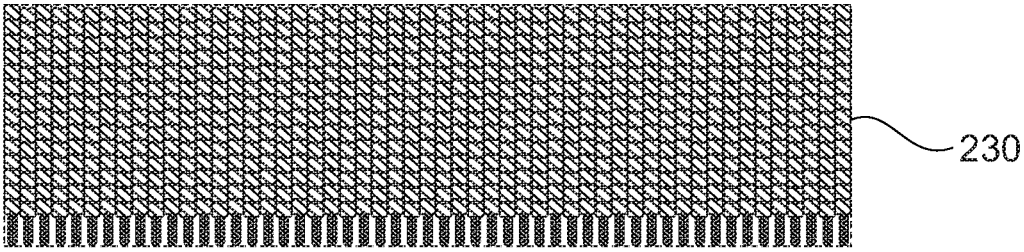
FIG. 5D shows an example of a knit element using the knitting sequence shown in FIG. 5C according to some embodiments.

FIG. 5C depicts a knit element including the knitting sequence 28 from FIG. 3A with the knitting sequence 218 from FIG. 5A. The knitting sequence shown in FIG. 5C was used to form sample 230 shown in FIG. 5D.

Figure 25:
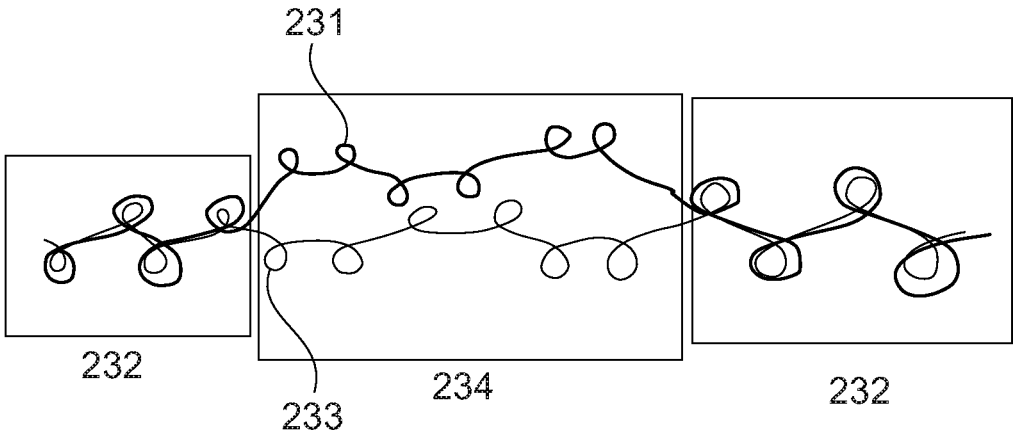
FIG. 25 shows a knitting sequence for a knit element having a merged yarn section, a jacquard knit section, and a further merged yarn section according to some embodiments.

FIG. 25 depicts an illustrative example of knitting sequence where merger and divergence are combined with jacquard knitting. In region 232 yarns 231, 233 are merged and knit together on both the front and back needle beds. Then yarns 231, 233 diverge from each other. As shown in FIG. 25, initially yarn 233 is knit on the front needle bed and yarn 231 is knit on the back needle bed. After diverging the yarns are knit like a standard jacquard as is shown in region 234. Yarns 231, 233 merge together in region 232 and are knit on both the front and back needle beds.

When using independently controlled feeders to knit the sequence shown in FIG. 25, due to the ability move the feeders relative to each other, yarns 231, 233 can be separated in region 234. Using independently controlled feeders to construct the knit configuration shown in FIG. 25 may allow an improved and faster production than would have been possible with standard feeders.

Figure 26:
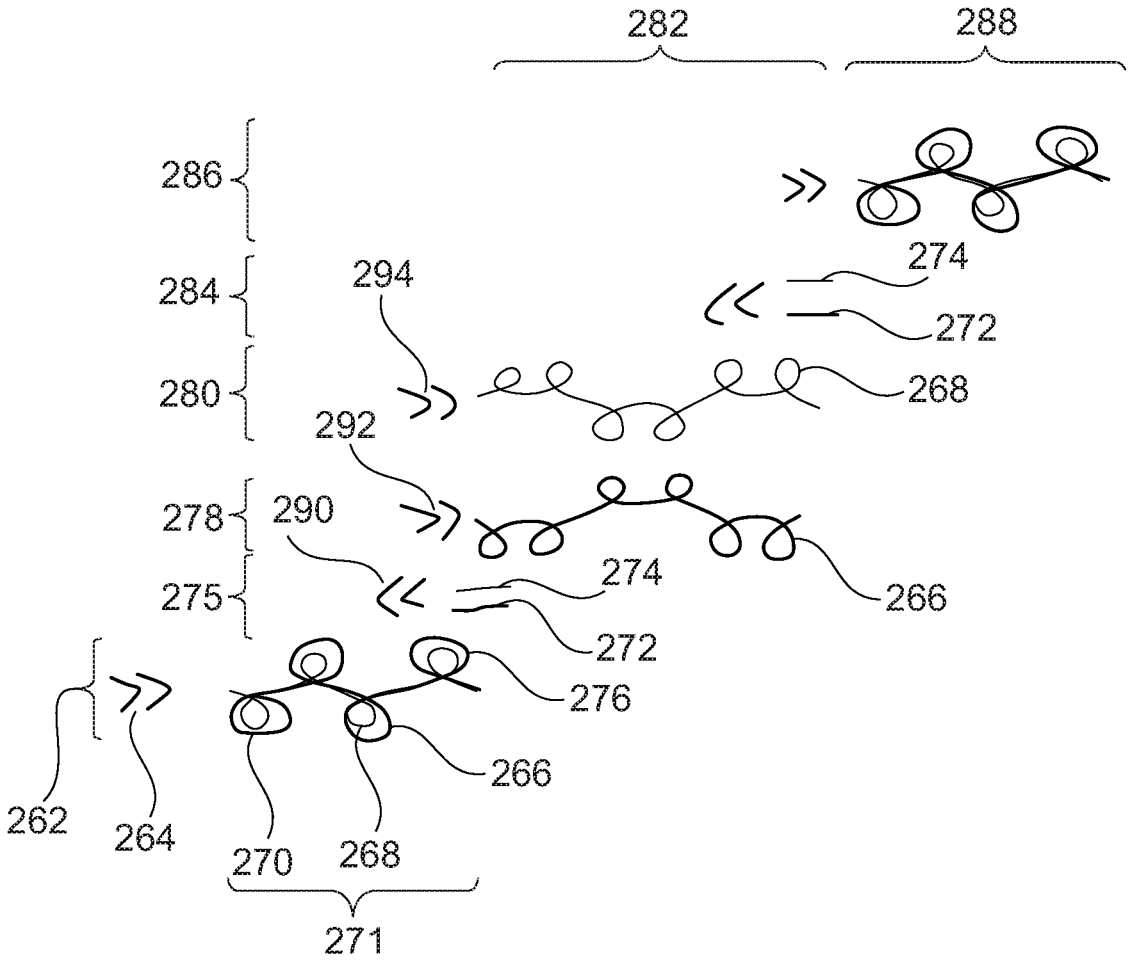
FIG. 26 shows a machine knitting sequence for a sequence comparable to that depicted in FIG. 25 according to some embodiments.

FIG. 26 depicts a portion of a machine knitting sequence for an example similar to FIG. 25 knit on using standard feeders on a flat knitting machine, in other words the feeders are not independently controlled. Starting from the bottom left, a series of sections indicating machine movement, direction of movement, and the associated yarn sequences are depicted. At the beginning of each section, as shown in FIG. 26, the direction of travel for the movement is depicted by direction settings 264, 290, 292, 293, 294. Generally, knitting sequences, including machine sequences are read from the bottom. In section 262, the carriage moves to the right, as indicated by direction setting 264, knitting merged yarns 266, 268 for a number of stitches 270 in region 271. In section 275, the feeders move back to the left, forming floats 272, 274 of both yarns 266, 268 as is depicted by direction setting 290. The formation of the floats allows the feeders to be re-positioned inside the field of the last structure 276 knit. In some cases, this process may be referred to as "kickback".

After the feeders are repositioned, the carriage moves to the right again as indicated by direction settings 292, 294 in sections 278, 280. While sections 278, 280 appear separate in FIG. 26, it is important to note that the loops shown in sections 278, 280 are formed in a single movement of the carriage. Thus, the loops are formed substantially concurrently. In these sections, yarns 266, 268 are knit as a jacquard, switching between the front and back needle beds. At the end of the jacquard region 282, the feeder moves to the left forming floats 272, 274. Thus, the feeders are positioned in the field of the last knit structure 296 as is depicted in section 284. Section 286 depicts region 288 where yarns 266, 268 are merged together and knit on both the front and back needle beds.

All of the knitting occurring in sections 262, 275, 278, 280, 284, 286 actually occurs in the same row on the knit element. This pattern of knitted zones of merged yarns and jacquard may be repeated multiple times along the length of the row. Thus, a knit element may have zones of knit structures and/or yarns that affect physical properties of the knit element. For example, a knit element for a shoe upper may be constructed from a substantially double layer fabric.

In some embodiments, repositioning of the carriage, also known as kickback, may occur in conjunction with a float, a tuck stitch, and/or a knit stitch. For example, a float, a tuck stitch, and/or a knit stitch on one or more needles may be used to position the feeders (i.e., to kick them back). In some embodiments, floats are chosen due to the lack of visibility of the float on a surface of the fabric. The kickback movement of the carriage may allow a feeder to be positioned inside the area last knitted. For example, as shown in FIG. 26, the kickback that occurs in section 275 returns the feeders to the knitting position at which the last structure 276 is made. The movement of the carriage may be controlled such that the feeders move one needle position. Controlling the movement of the carriage may allow for controlling a length of a float. In some embodiments, it may be desirable for the carriage to be moved more than one needle position.

While kickback may be used as shown in FIG. 26, the use of kickback will increase knitting times and therefore production costs as kickback requires the carriage to stop and move backwards such that the feeder is moved inside the area last knitted position. Further, when utilizing kickback due to the additional thread provided during the kickback movement because of the float, stitches will not be as consistent. Thus, it is preferred that independently movable feeders are used to ensure that the production is cost effective and consistent.

Figure 30:
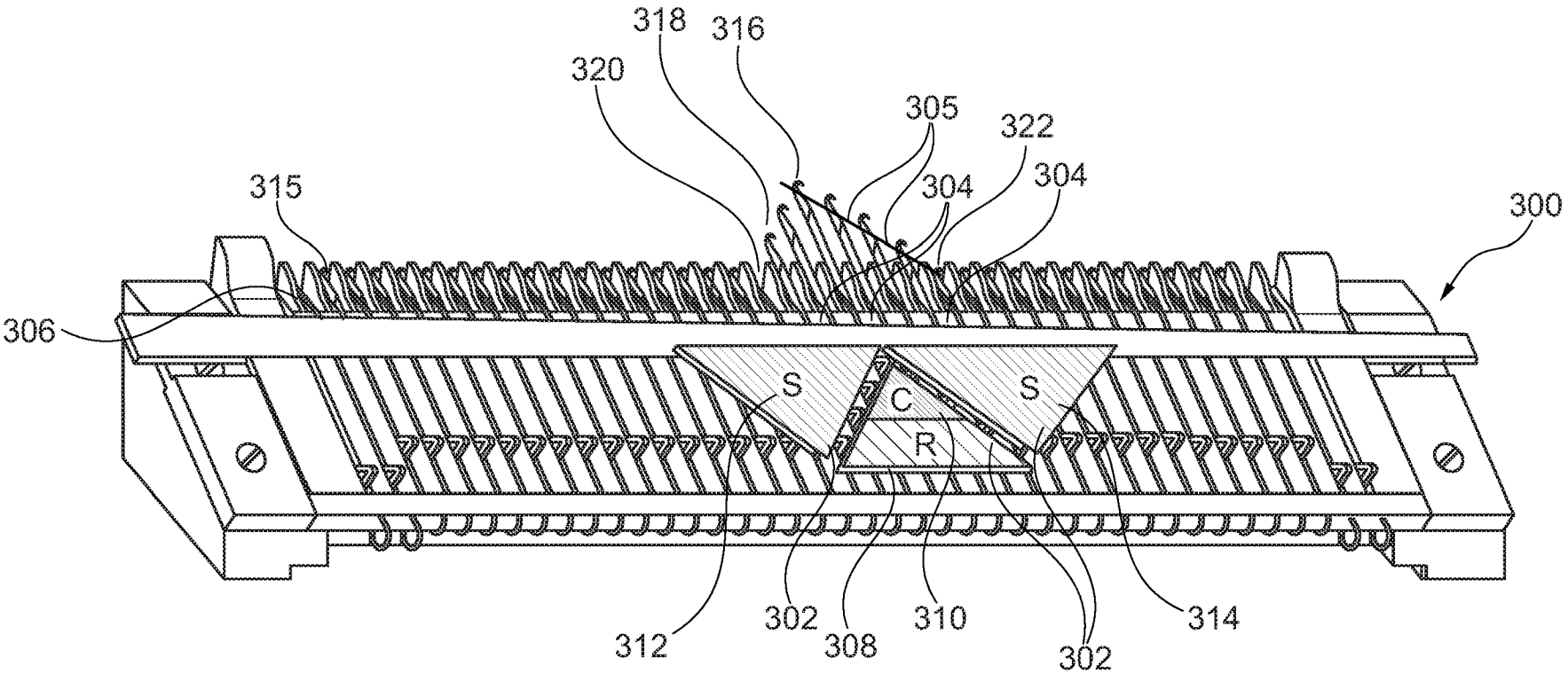
FIG. 30 shows a single system and a needle bed of a flat-bed knitting machine according to some embodiments.

FIG. 30 depicts a portion of knitting machine 300 being provided with strand 305 (a portion of which is shown). As illustrated knitting machine 300 includes a cam system 302 positioned proximate multiple needle positions 304 along a needle bed 306. As shown in FIG. 30, cam system 302 includes raising cam 308, cardigan cam 310 and stitch cams 312, 314.

Needles 315, 316, 320, 322 can be moved by the cams. In particular, needle 316 is being moved by the cams. As shown, the needle movement is guided by the cam along a track in which the needle sits. If both the raising cam 308 and cardigan cam 310 are active proximate a needle position, the needle 316 at that needle position is moved up to a high setting which allows for formation of a loop stitch at that needle position. When the cardigan cam 310 is deactivated, needle 318 will be moved up only by the raising cam 308 leading to the formation of a tuck stitch at that needle position.

If both raising and cardigan cams 308, 310 are deactivated, the needle will not go up at all and a float will be created as shown at needles 320, 322.

Stitch cams 312, 314 are mobile. A stitch cam may determine how big or small a stitch is going to be. If the stitch cam is moved downwards or allows the needle to descend more, more yarn will be used to form the loop, thus creating a bigger loop.

A flat knitting machine may have multiple cam systems on each carriage. For example, the flat knitting machine depicted in FIGS. 20A to 23 (i.e., Stoll ADF) has three such cam systems on each carriage. Thus, in one stroke a machine depicted in FIGS. 20A to 23 can create a maximum of three complete rows on each needle bed, if each cam system has its own feeder. The number of rows created depends, for example, on the knit structures formed, the number of needle beds used, and how the various yarns are used (i.e., are yarns transferred between beds to make knit stitches and/or structures).

Some knitting machines may include twelve cam systems capable of creating twelve courses, which may correspond to rows during one movement. For example, a twelve cam system circular knitting machine can create twelve rows of stitches during a single rotation.

A course, as used herein, generally refers to the path of a yarn through the knit. At times, courses may be equivalent to knitted rows. In some embodiments a knitted row includes multiple courses. For example, if two courses do not knit on the same needle positions during the same movement, these 2 courses may result in the formation of a single knit row.

Figure 6:
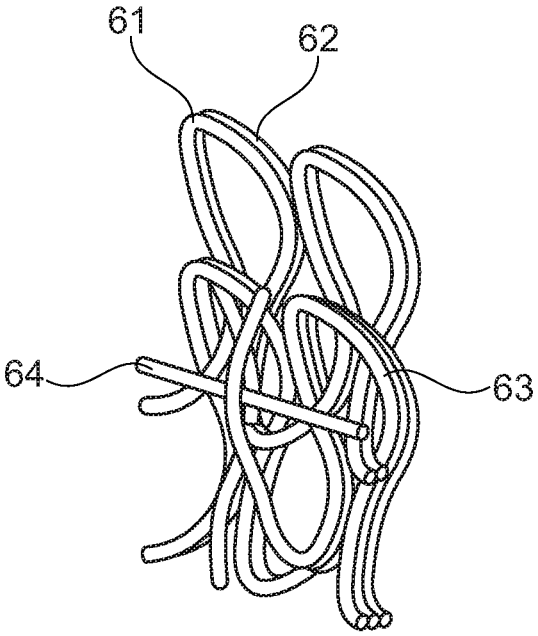
FIG. 6 shows an example of a knitting sequence depicting merger and divergence of multiple yarns which includes floats according to some embodiments.

FIG. 6 shows an illustration of a combination of merger, divergence, and a float insertion technique which can be used in the context of the present disclosure. As depicted in FIG. 6, this construction is shown as a single layer or single jersey fabric. The yarns 61, 62 and 63 are merged. The yarn 63 diverges to form a warp float insertion (vertical float insertion). The yarn 64 is a weft float insertion (horizontal float insertion), if it is knit into the knit structure at some point. In some embodiments, this construction or a portion thereof may be utilized in a double layer fabric.

Figure 7:
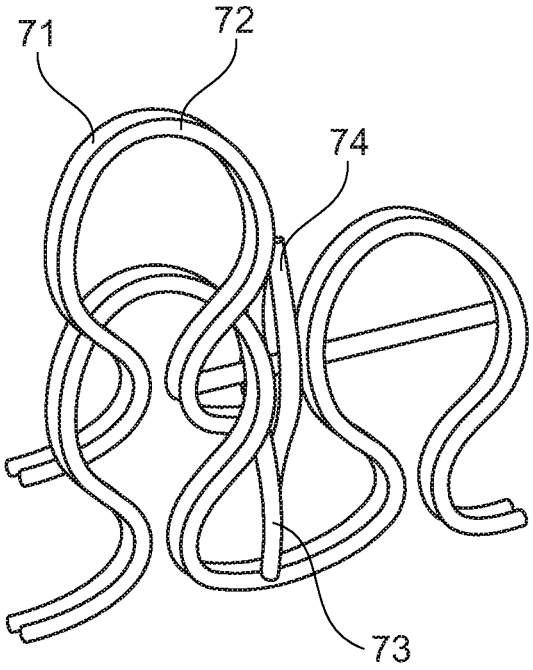
FIG. 7 shows an illustration of two stitch positions two rows high according to some embodiments.

FIG. 7 shows an illustration of two stitch positions two rows high. FIG. 7 depicts a combination of merger, divergence, and a float insertion technique. The yarns 71 and 72 are merged and then yarn 71 diverges to form a float acting as a weft float. The yarns 73 and 74 are vertical float insertions. In some embodiments, the float insertions may be floats if they are knitted into the knit element at some point. In alternate embodiments, the float insertions may not be knitted in or perhaps only knitted on one side.

Figure 8:
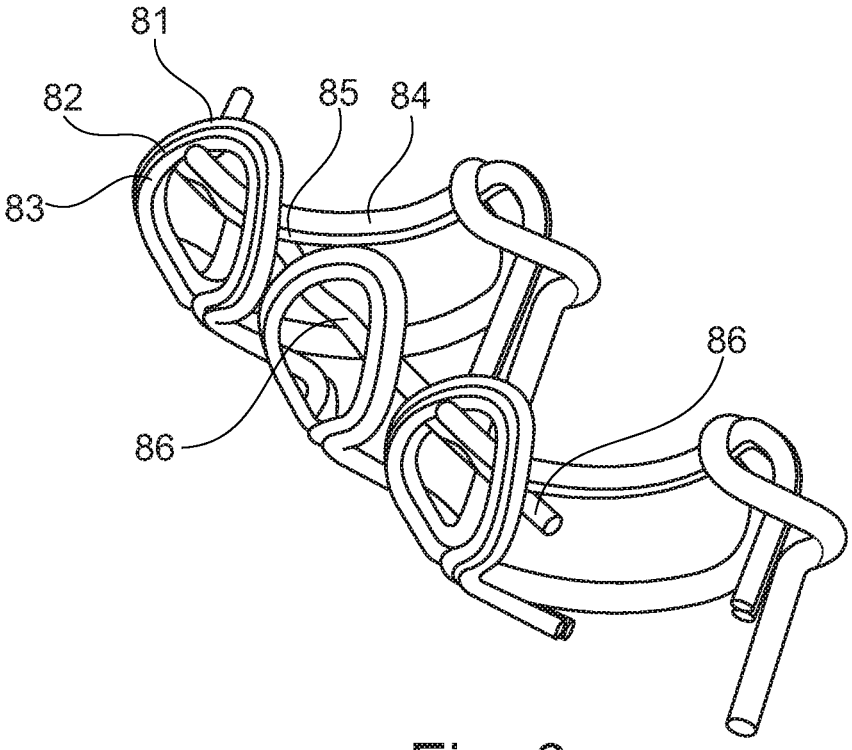
FIG. 8 shows a perspective view of a partial knit structure knitted on two knitting beds according to some embodiments.

FIG. 8 is a perspective view of a partial knit structure knitted on two knitting beds of a flat knitting machine. The knit structure depicted is a combination of merged and divergent yarns as loops, floats, and tuck stitches. Yarns 81, 82 and 83 are merged together and knitted at the first and third stitch positions on the front side as depicted. There is also a merged tuck stitch on the first and third stitch of the front side of the knitted element formed by yarns 84, 85, 86 which are merged. At the second stitch position, yarn 82 diverges from the other yarns 81, 83. Yarn 82 moves to the back side of the knit element where it forms a knit stitch around tuck stitches formed by yarns 84, 85 which are merged. Between the first and second knit positions, yarns 84, 85 diverge from yarn 86 and are tucked on the back layer. The tucked yarn 86 remains on the front layer for all of the stitches depicted and appears to create a tuck stitch at each stitch position on the front side of the knitted element.

Figure 9A:
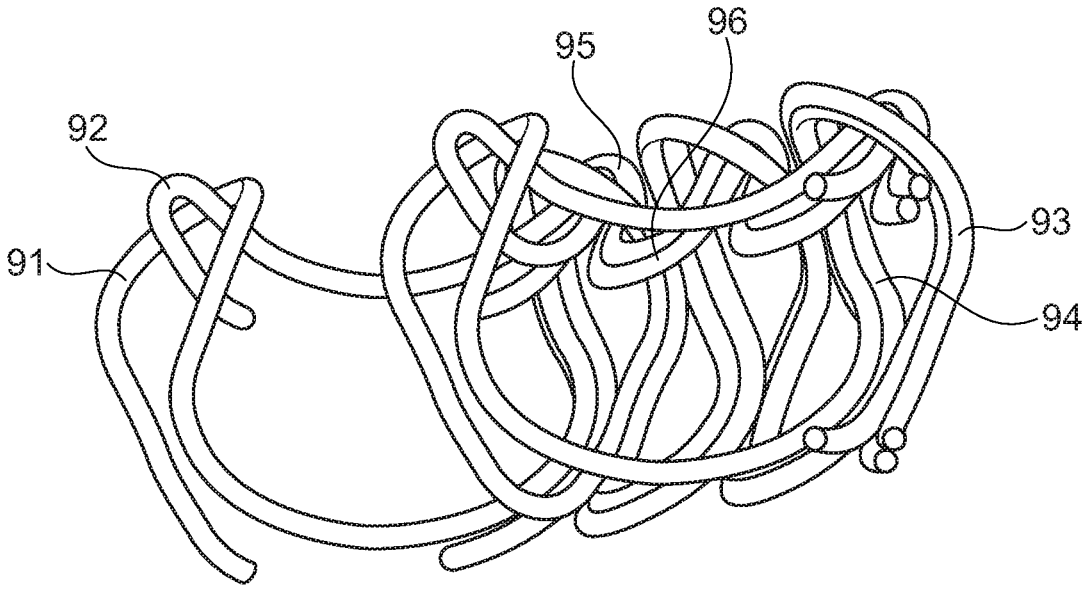
FIG. 9A shows a perspective view of a variation of merger and divergence which can be used in the context of the present disclosure according to some embodiments.

FIG. 9A shows a perspective view of a variation of merger and divergence which can be used in the context of the present disclosure. From left to right, FIG. 9A shows a double layer fabric which could be knit on a double bed knitting machine. At the first stitch position, a stitch of a yarn 91 and a tuck stitch of a yarn 92 are formed on the front side of a fabric. At the second stitch position, all yarns are moved to the back where yarns 91, 93, and 94 are merged and knit. There is also a merged tuck stitch on the back side where the yarn 92 from the front is merged with the yarns 95 and 96 on the tuck stitches on the back layer. In the third stitch position, the yarn 91 diverges from the other merged yarns and is used on the front layer and the yarn 92 diverges from the tuck and is used on the front layer as tuck stitch. In the third stitch position on the back, the yarns 93 and 94 are merged and remain on the back layer and are knit as a knit stitch. The yarns 95 and 96 are merged and are knit on the back layer as tuck stitches. At the fourth stitch position, all of the yarns are moved to the back layer. This last stitch in the back (i.e. the rightmost in FIG. 9A) is a repetition of the stitch structure on the second stitch position on the back.

Figure 9B:
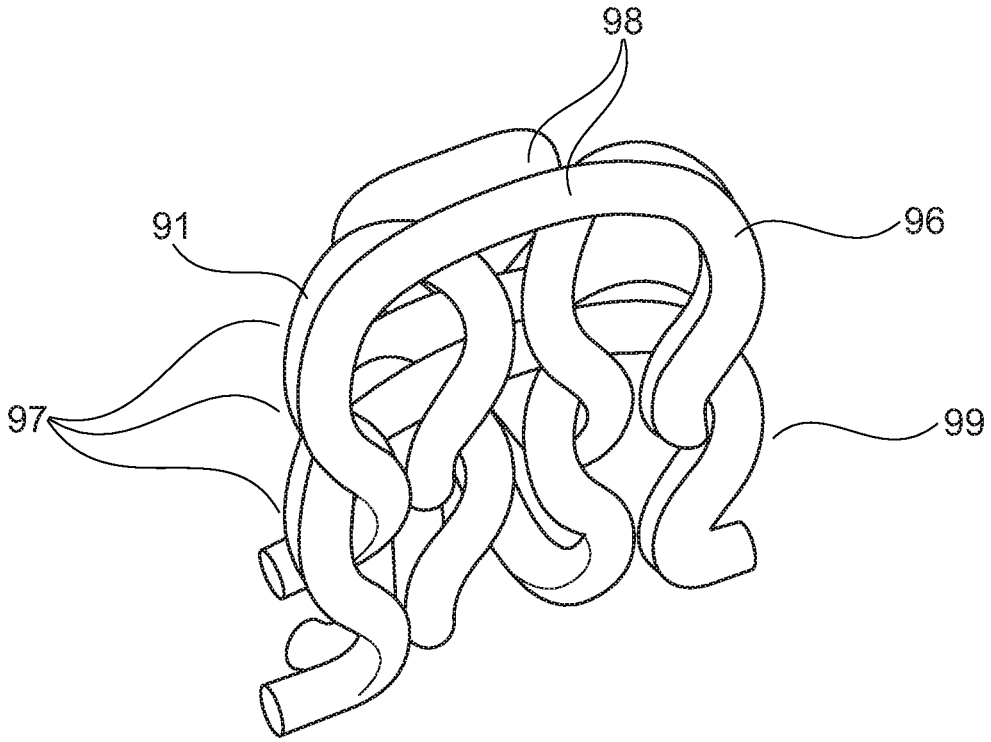
FIG. 9B shows a perspective view of a variation of merger and divergence which can be used in the context of the present disclosure according to some embodiments.
Figure 10A:
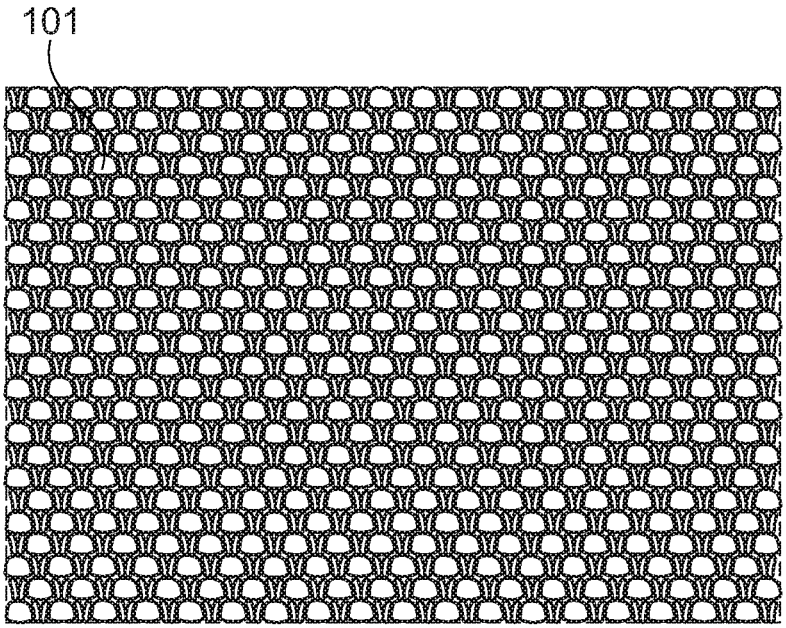
FIGS. 10A-D show examples of knits that include knitting techniques which can generally be combined with merger and/or divergence according to some embodiments.
Figure 10B:
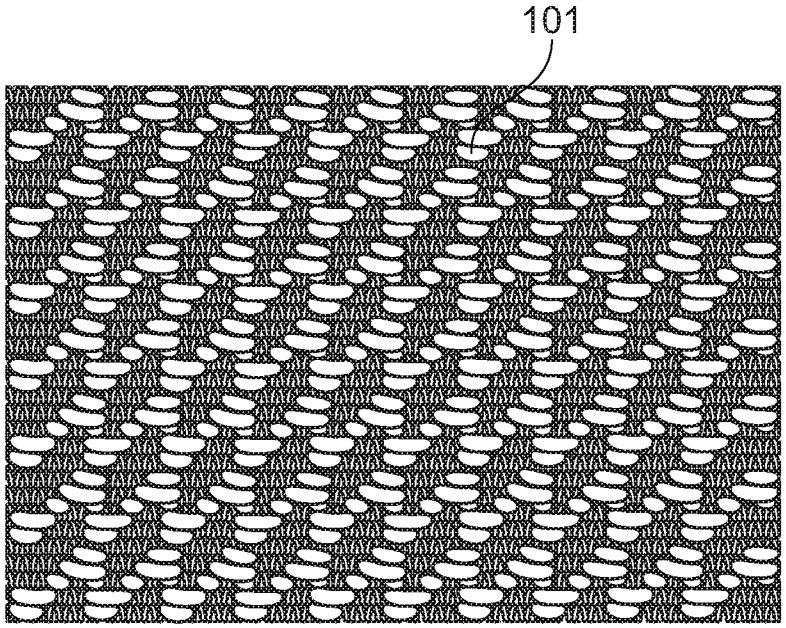
Figure 10C:
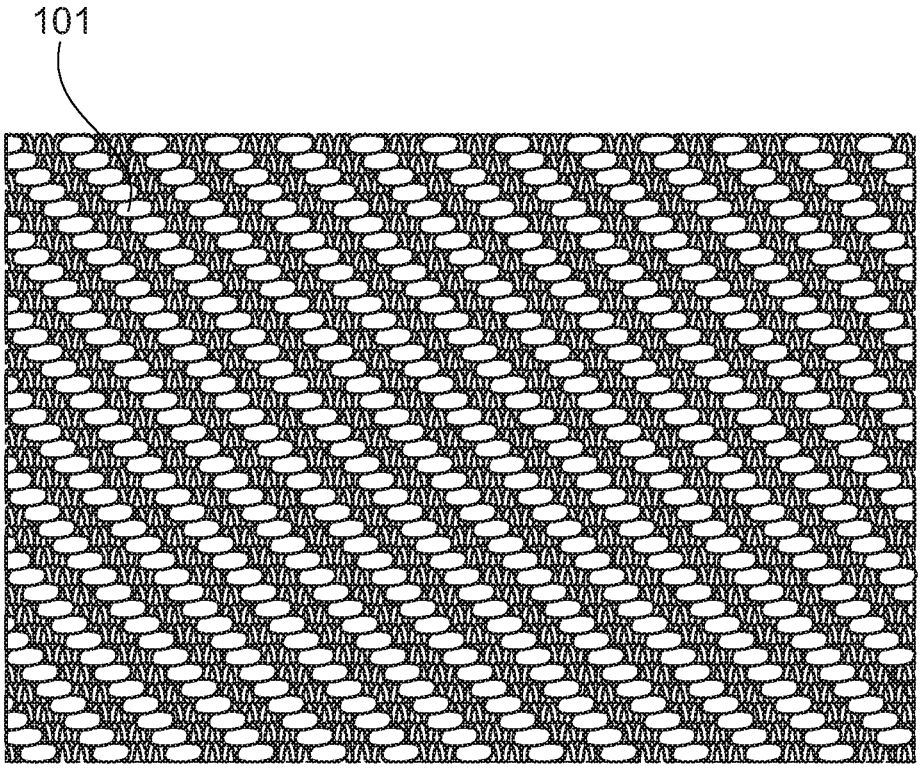
Figure 10D:
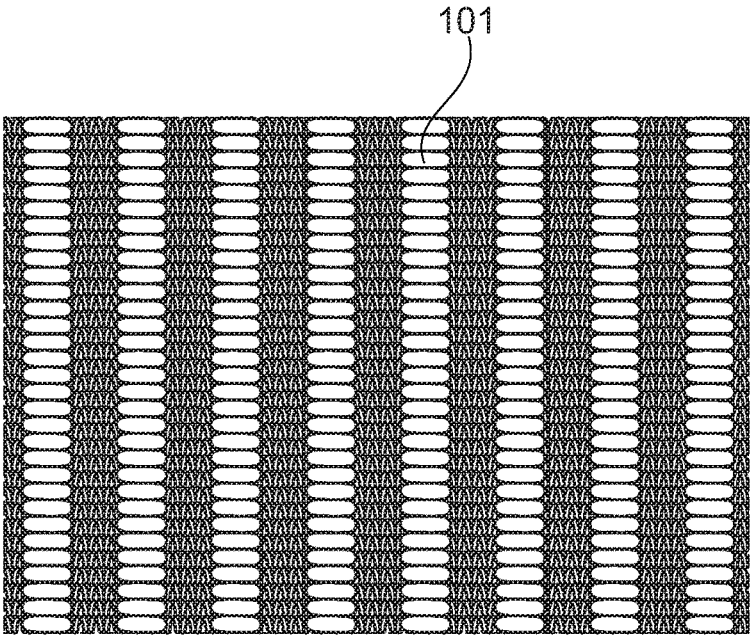

FIG. 9B depicts a knit structure 99 that includes merging and diverging threads. Threads 91, 96 are merged in merged part 97 of the knit structure 99. During knitting threads 91, 96 diverge to form separate structures at position 98 such that thread 91 forms a loop on a back layer of knit structure 99 of a double layer knit. Thread 96 at position 98 on a front layer of the knit structure 99 forms a float. Depending on the properties of threads 91, 96 the properties of the knit structure may change. For example, knit structure 99 may be used to reinforce a knit element. In some embodiments, a length of the float may be varied to provide desired properties to the knit. For example, the knit structure may allow for the formation of a multiaxial reinforced material without an inlay. Such a structure may allow a designer to limit stretch in specific areas of knit structure. Thus, thread type, loop style, and/or placement in the knit structure may be varied to tailor properties of the knitted material.

As shown in FIGS. 6 to 9B, various knit structures are possible using the controlled positioning of threads in a knit. Further, advanced engineered loop and mesh designs may be possible due to the ability to control placement of threads such as yarns at a single needle. Further, various elements of the knitting may be controlled such that the positioning of threads within the needle may be controlled. For example, positioning of feeders relative to each other and a particular needle during knitting at the particular needle may control the positioning of individual threads in the needle.

FIGS. 10A to 10D show a knitting technique which can generally be combined with merger and/or divergence according to the present disclosure, namely a single jersey with float insertion. A float is generally a section of yarn that extends along a course or wale without being knit. In some embodiments, a float has previously been knitted and then is not knitted for a number of stitches. The yarn then floats across the stitches formed by the other yarns in use. In FIGS. 10A to 10D the float yarn is depicted with the reference numeral 101.

Figure 11A:
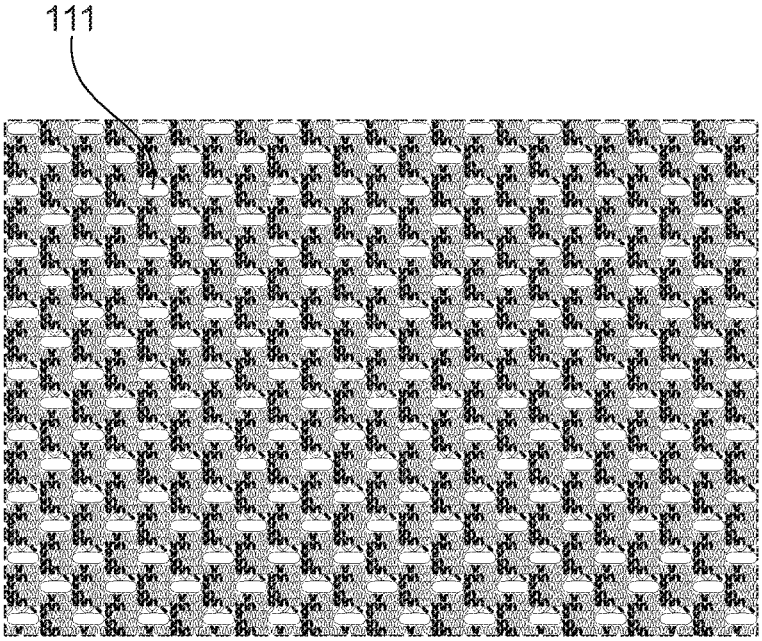
FIGS. 11A-B show examples of knits that include knitting techniques which can generally be combined with merger and/or divergence according to some embodiments.
Figure 11B:
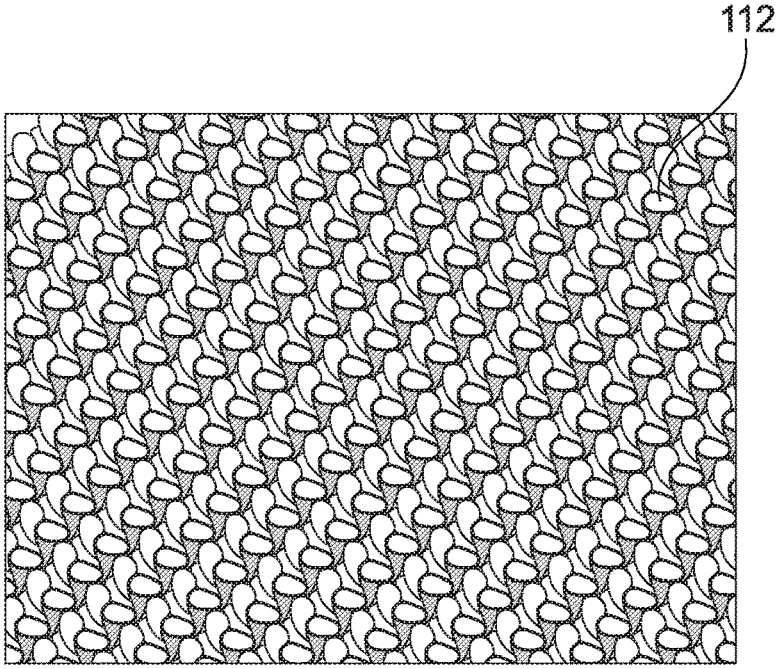

FIGS. 11A to 11B show another knitting technique which can generally be combined with merger and/or divergence according to the present disclosure, namely a double jersey with float insertion. In FIG. 11A the float yarn is depicted with the reference numeral 111, while in FIG. 11B, the float yarn is depicted with the reference numeral 112.

Figure 12:
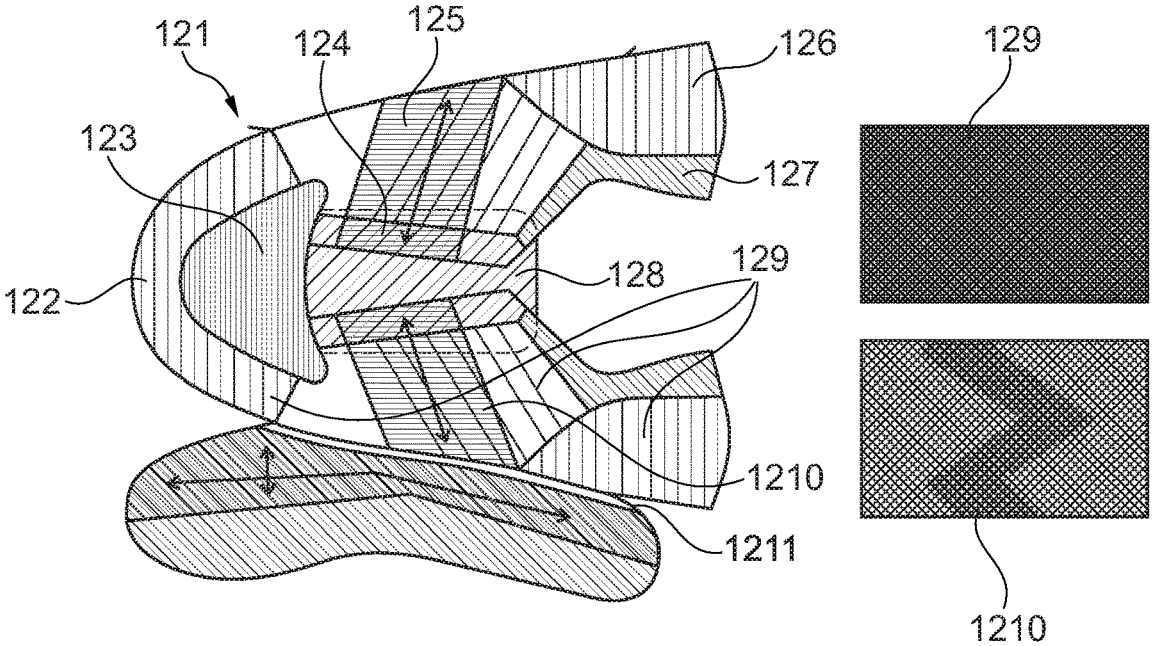
FIG. 12 shows an illustration of a combination of different knitting techniques in an upper for a shoe according to some embodiments.

FIG. 12 shows an illustration of a combination of different knitting techniques in an upper 121 for a shoe. The toe cap 122 of the upper 121 forms a pocket and is open at the lasting line. In some embodiments, a reinforcing or other material may be placed in the pocket.

In other embodiments, a toe cap area may be knitted in a manner to enhance stability of the toe cap by knitting the layers in a connected manner and without an opening. The vamp insert 123 is knitted using exchanging of merged yarns, half side a first color, the other half a second color. In the area of the eyestays 124 a tight knit and fuse yarn is used to provide for the necessary stiffness in that area. In the midfoot area 125 a float insertion technique is used to prevent stretch. The heel cap is formed as a distance knit using fuse yarn right in between and surrounding with PES (polyester) tucked with Spandex. The collar area 127 may include floats with volume yarns to provide for cushioning. The tongue 128 is executed as a tubular knit. In the areas 129 an exchanging knit with two colors is used. Exchanging refers to exchanging the yarns in the base position with the yarn in the merged yarn position. In other words, they switch positions in the loop by changing the position of the feeders. In the area 1210 an exchanging with a visible float insertion for midfoot support is used. The float insert yarn is merged with a fuse yarn. All upper structure is extended from above until the area 1211.

Generally, the upper 121 is a flat knitted upper with attached insole. Possible knitting directions for the upper 121 include from toe to heel, from heel to toe, and from the side.

The knitting technologies used for upper 121 include float insertion, wherein support elements are knit into a midfoot area limiting and controlling stretch in horizontal and vertical direction. This may be used to add cushioning to certain areas by using volume or expansion yarns, for example in the collar and/or other areas like the heel cap, the toe box and/or an insole area. In an insole area, for example in an instep area, an elastic yarn may be used to create a laceless shoe.

Another knitting technique that can be used for the upper 121 includes exchanging. This allows to create zones, for example at the vamp, quarter and heel to achieve unique visuals and color options.

Another technique which may be used for upper is a combination of exchanging and float insertions. This influences the physical properties of the knitted fabric.

For the construction of the upper 121 intarsia knits are executed in certain areas for functional and optical reasons. Knit pockets are used at toe and heel to insert mold- and formable sheet materials. The eyestay zone is reinforced by fuse yarn and/or liquid polymer. In the collar area volume yarns are used to achieve proper cushioning properties. Additionally, or alternatively, spacer yarns may be used. The tongue is a fully integrated tongue as a second element knitted together with the upper 121. The tongue is a pocket construction to insert foam sheets for cushioning properties. Additionally, it is a seamless construction, such that no sewing allowances are needed.

The insole is attached to the upper 121 as a one-piece insole or as two half pieces on the lateral and medial side. In some embodiments, a pocket may be formed within the knitted insole. For the sockliner a double layer knit may be used to avoid curling. In particular, a double layer construction may be used in particular locations to reduce curling of the knitted element. For example, a double layer may be used toward the rear of the upper (e.g., the heel).

Figure 13:
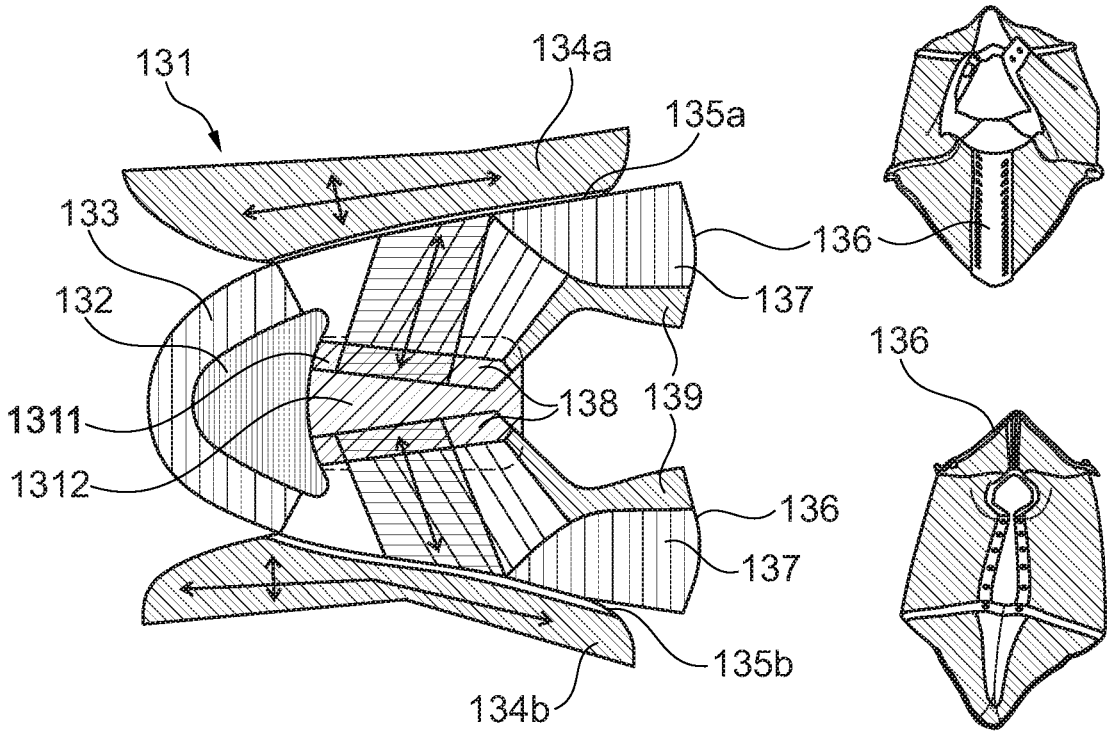
FIG. 13 shows an illustration of a combination of different knitting techniques in an upper for a shoe according to some embodiments.
Figure 14A:
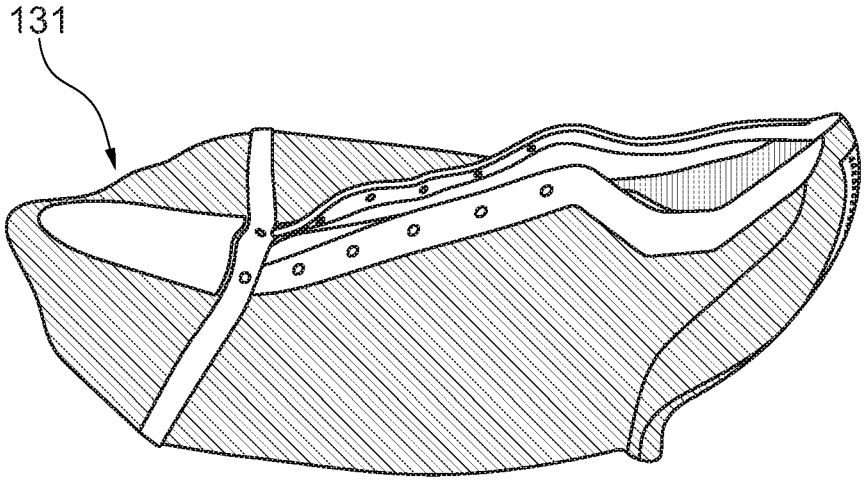
FIGS. 14A-E show examples of an upper for a shoe according to some embodiments.
Figure 14B:
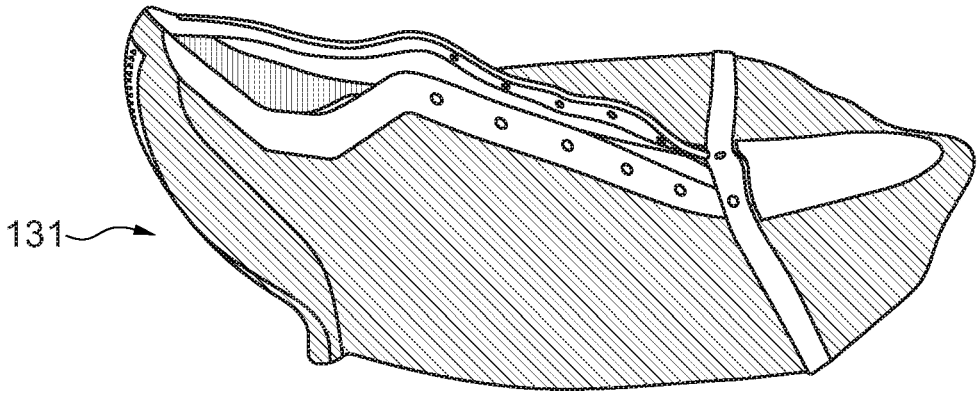
Figure 14C:
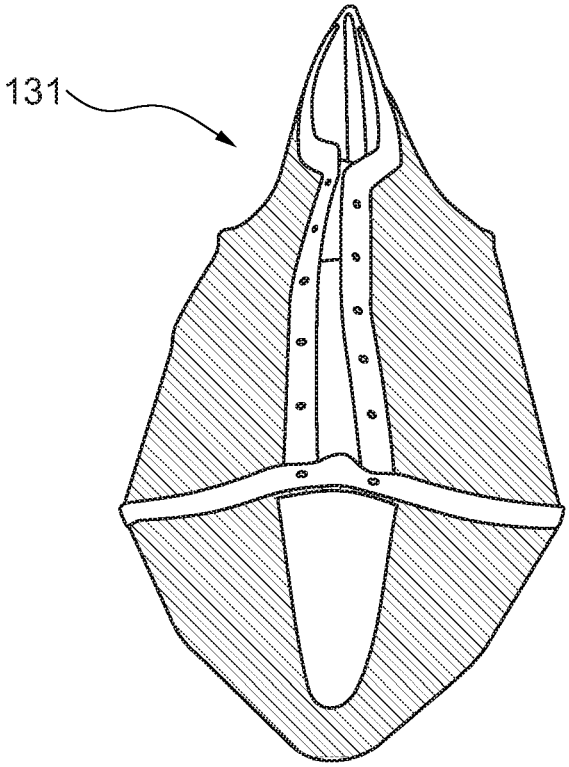
Figure 14D:
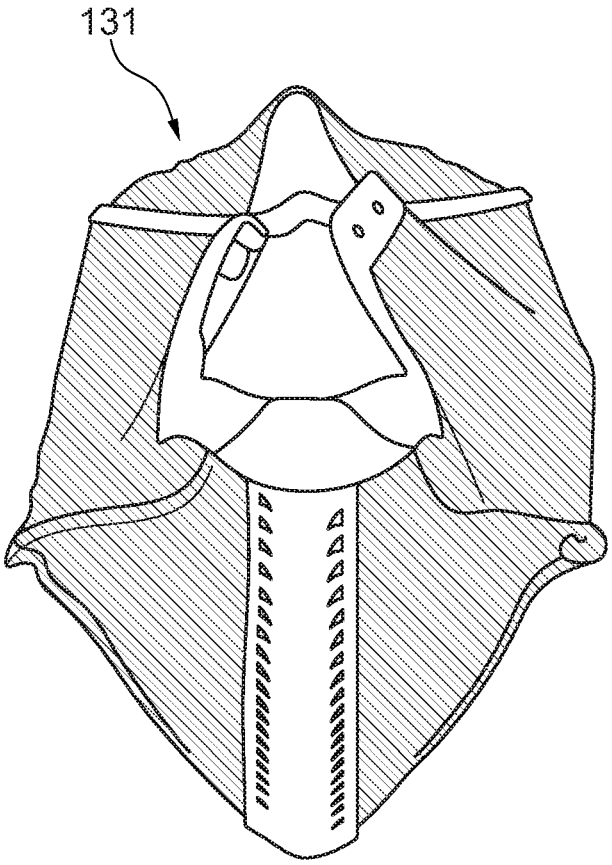
Figure 14E:
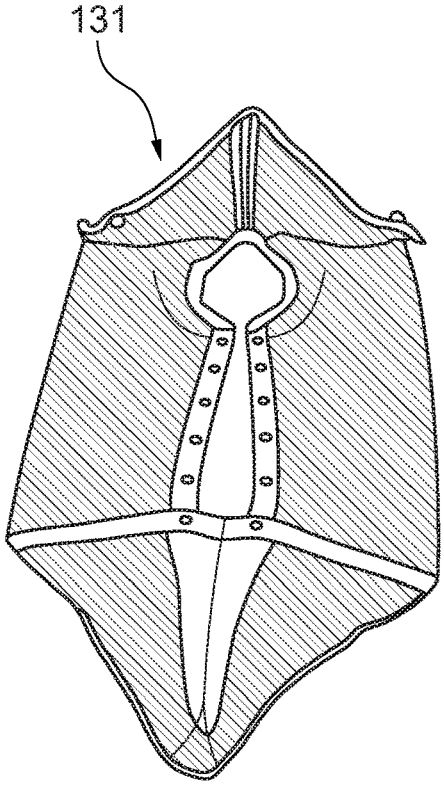

FIG. 13 shows a further illustration of a combination of different knitting techniques in an upper 131 for a shoe. In the area 132 an open hole structure is used in the top layer, whereas in the back layer exchanging of threads is used. In the area 133 two separate layers are knit for inserting a toe box. The first half 134*a* and the second half 134*b* of the insole is a single layer with some stretch in both directions. The insole is directly knitted with the upper in one piece. All upper structure is extended from above until the areas 135*a* and 135*b*. The heel center line 136 is linked together during the knitting process. In the areas 137 two separate layers are used for inserting a heel counter. In the eyestay area 138 yarns are merged, including a fuse yarn. In some embodiments, the lace holes are created when yarns are transferred to other needles, leaving at least one needle empty to create an opening in the knit. Fuse yarn may be positioned using merger and/or divergence to allow the melted fuse yarn to reinforce the lace hole. The collar area 139 includes float inserts using volume yarns to provide for cushioning. In the area 1311 the tongue is knitted against the vamp in a single layer where it is overlapped by the eyestay. In the area 1312 the tongue is knitted against the vamp in a double layer where it is in between the eyestay.

For the upper 131, the focus is on a more three-dimensional shaped product to achieve different appearances and new silhouettes. It is basically about the same construction as described above with respect to the upper 121 in FIG. 12, however, the heel is three-dimensionally shaped during the knitting process by knitting it as a one piece connecting the heel in the center line.

For the construction of the upper 131 it is preferred to knit the forefoot portion beginning at the toe area. The knitting direction is towards the heel. The first finished part of the upper 131 is then held on a first needle bed of the knitting machine, before the heel part is knit.

Knitting direction for the heel part begins at the bottom portion of the heel. Then, it is knitted toward the top of the heel. When the heel part is complete, it is held on the needles. The forefoot portion is then joined to the heel portion on the needle beds.

Float insertion can be used with upper 131 to knit support elements into a midfoot area in order to limit and control stretch in horizontal and vertical direction. Exchanging zones may be used in vamp, quarter, and heel to achieve unique visuals and color options. Besides that, there is a possibility to combine exchanging and float insertions which allows for influencing the physical properties of the knitted fabric. Intarsia knits may be executed in certain areas for functional and optical reasons. Knit pockets may be used at toe and heel to insert mold and/or formable sheet materials. The eyestay zone is reinforced by fuse yarn and/or liquid polymer. Spacer knit may be used at the collar area. Volume yarns may additionally or alternatively be used to achieve proper cushioning properties. The tongue may be a fully integrated tongue as a second element knitted together with the upper 131. The tongue may also be made as a pocket construction to insert foam sheets for cushioning properties.

It may be a seamless construction, thereby reducing friction to a wearer if the knit element is used in clothing or as part of a shoe. Further, the knit element may be constructed so that no sewing allowances are needed. The insole is attached to the upper either as a one-piece insole or as two half pieces on the lateral and medial side. The heel is a fully three-dimensional integrated heel shape for improved heel fit and functionality. The heel may be joined, for example, using linking, bonding, sewing or other known methods in the art.

In some embodiments, merger and/or divergence may be used to connect areas of an upper requiring different physical properties. In an illustrative example, uppers similar to those depicted in FIGS. 12 to 13 may include merger and/or divergence as methods to connect to areas of the upper having different predetermined required properties, in particular, a toe box, a heel, a vamp, an insole, tongue, lace elements. For example, using merger and/or divergence in an upper may allow for use of a melt yarn in combination with a polyester yarn. In the vamp, the yarns may be merged. At the juncture between the vamp and the insole the merged yarns may diverge (i.e., be separated from each other). The separate yarns may be knit in a first and second part of the insole. For example, the melt yarn may be used in a first part of an insole that will be place proximate to a midsole, while the polyester yarn may be used to knit a second part of the insole that is positioned proximate to the foot. In some embodiments, these parts of the insole may create two or more layers. For example, customized shoes could be developed which allow an end user to choose a yarn for the insole, for example, a yarn that provides cushioning and/or breathability, while using a melt yarn in an outer layer to ensure that the upper and midsole and/or outsole are bonded together in a manner sufficient to ensure stability of the final shoe.

In other configurations, the parts of the knit element formed after the yarns diverge may be connected to each other along the knitted row. For example, after the yarns diverge, the yarns may be knit alternately on the front and back needle beds to create connections between the layers. For example, after the divergence a number of knit structures may be formed from the two yarns individually. The yarns may be merged again to create a point of connection between the layers. At these points of connection one or more additional yarns may be used to create knit structures.

A shoe upper may have a section that includes three or more yarns of distinct materials. For example, a waterproof yarn merged with a moisture wicking yarn and a melt yarn. The waterproof yarn and the moisture wicking yarn may be merged together for a few stitches and then diverge are knit individually for five or ten stitches. A third yarn may be knit on the opposite needle bed when the yarns are merged and may be positioned between the first and second parts of the knit when after the merged yarns diverge and form knit structures independently.

FIGS. 14A to 14E show an example of an upper for a shoe that incorporates the different knitting techniques that have been described with respect to FIG. 13.

In some embodiments, exchanging may be used to control positioning of yarns in a manner that allows patterns to be created on an upper. Exchanging refers to exchanging the position of yarns in a needle by changing feeder positions. In other words, they switch positions in the loop by changing the position of the feeders. In some embodiments, the use of independent feeders enhances the ability to effectively utilize exchanging.

Figure 29:
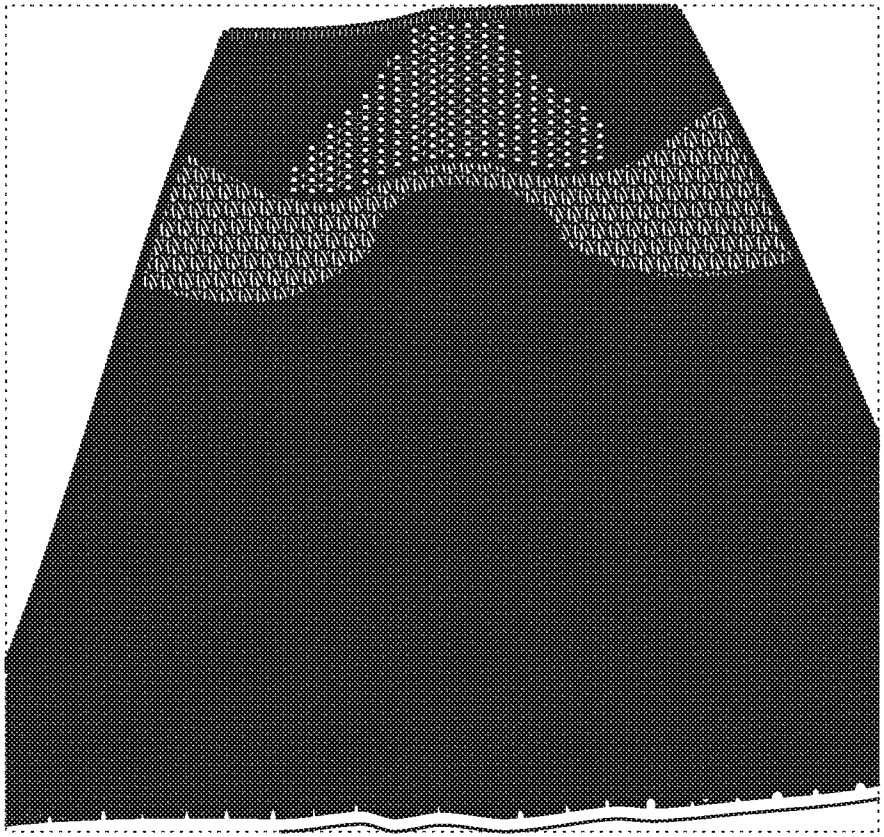
FIG. 29 shows a knit element for a shoe upper that uses exchanging to selectively position yarns in a predetermined configuration according to some embodiments.

Color effects as shown in FIG. 29 are good example. Previously, in order to have created such a pattern a space dyed yarn would have been used. Spaced dyed yarn is a yarn that has been dyed with multiple colors along the length of the yarn. Use of such a yarn creates random patterns of color on a knit element. However, for some uses this can be problematic. For example, when creating a pair of knit elements for a pair of shoe uppers it is nearly impossible to create two knit elements that match. This creates a significant issue when pairing shoes. In many embodiments, when using spaced dyed yarns, the resulting shoes have different color patterns. Time is wasted trying to match the knit elements or the shoes end up with different patterns. In some embodiments, when patterns cannot be matched, knit elements may be discarded resulting in waste. Exchanging creates a similar effect as space dye yarns using controlled placement of the yarns. This allows a pattern in a knit element, for example, a shoe upper to be controlled. Thus, it is possible to create multiple knit elements that can be matched. Use of exchanging on shoe uppers, for example, has the potential of greatly reducing waste and time spent on matching knit elements. This may result in production cost savings.

As shown in FIG. 29, exchanging is used to control the placement of two different colored yarns to create this effect. In some embodiments, three or more yarns may be merged together. For example, use of multiple yarns having different colors may be used to create a gradient color effect across the knitted element. In addition, exchanging may also be used with functional yarns to control properties of a knit element.

The controlled placement of yarns having particular colors or properties to create an upper may decrease the amount of yarns necessary to knit an upper with a complicated pattern, increase the likelihood of being able to produce a matching upper for a pair of shoes. Thus, use of merger and/or divergence in a knit upper can greatly increase the sustainability of a shoe by reducing an amount of material required to produce.

For example, it may be beneficial for a football (i.e., soccer) shoe upper to have particular yarn types positioned on the external surface of the key striking areas of the shoe to enhance grip, for example, while having a cushioning yarn placed proximate to predetermined portions of the foot during use. Controlled positioning of yarns through merger and/or divergence may be used to position a yarn with grip properties and a yarn with cushioning properties in such a manner to create specific zones on a shoe. In some embodiments of a multilayer knit upper, these zones may be selectively positioned on individual layers using a combination of merger and divergence.

Yarns may be merged in areas and diverge in other areas to create specialized designs using, for example, a jacquard knit technique. For example, in some embodiments, multiple yarns may be merged and used to create an area needing additional support such as a heel. In particular, two different color yarns may be combined with a melt yarn and a bulk yarn. In parts the yarns may be merged together in different combinations. For example, near an edge of the upper the melt yarn may be merged with a blue yarn. In some embodiments, these yarns may be positioned such that they will form a substantial portion of an outer layer of a knit element used in an upper. A bulky yarn (e.g., cushion yarn) may be positioned in a loop such that it will be proximate the foot during use. Using a combination of merger, divergence, exchanging and/or jacquard these yarns can create heel structures with various designs and/or properties.

Figure 31:
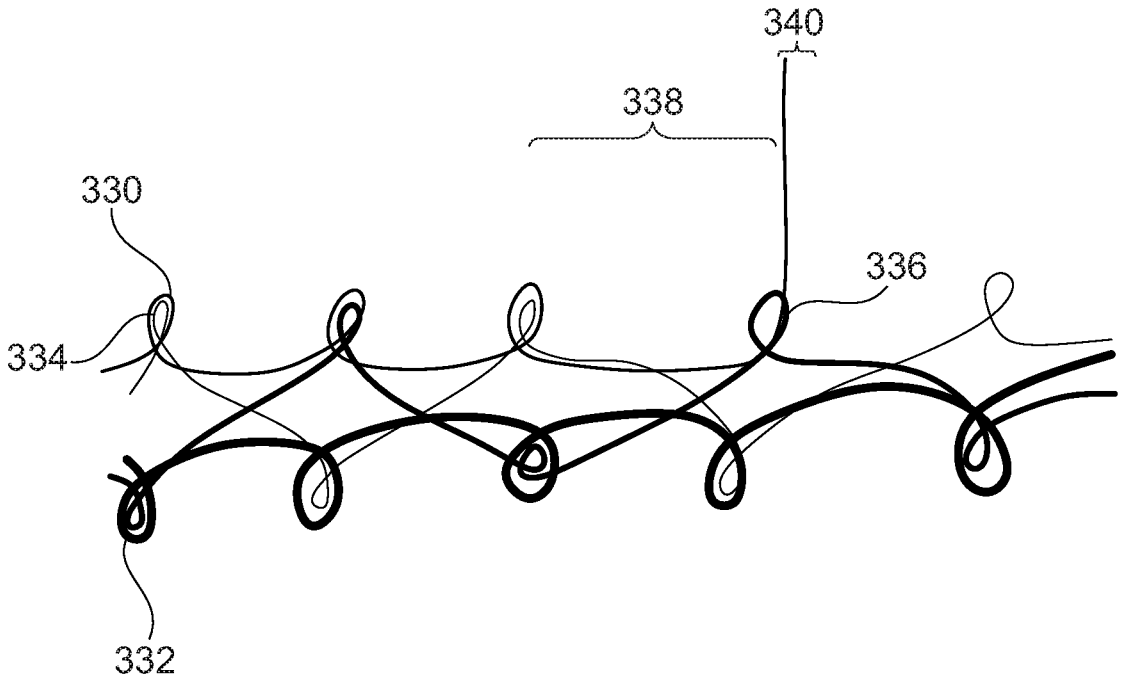
FIG. 31 shows a knitting sequence for at least a portion of a knit element according to some embodiments.

For example, FIG. 31 depicts a knitting sequence using merger and divergence throughout the sequence to allow for flexible positioning of multiple yarns. In particular, the sequence depicts merged yarns at most positions. Generally, the merged yarns diverge and then merged with another yarn at the next needle position. Yarn 330 is positioned such that it is knit primarily on the layer of textile that will be on the outside of the shoe upper. Yarn 330 may be, for example, a technical yarn, a bonding yarn, a melt yarn, including materials such as thermoplastic polyurethane "TPU", copolyester "CoPES", copolyamide "CoPA", polyester, polyamide, phenoxy and/or combinations thereof. In some embodiments, yarn 330 may include a functional property such as a waterproof yarn, a thermoregulating yarn, a flame resistant yarn, a moisture wicking yarn, a hydrophobic yarn, a hydrophilic yarn, a monofilament, a multifilament yarn, any specialty yarn which has properties that are desired to be on an exterior surface of the knitted element, in particular an external surface of a shoe upper, and/or combinations thereof. If a melt yarn is used in this position, it may allow for the area to have desired properties such as additional stability, stiffness, water resistance, etc. Such a knitting sequence may be useful in areas of a shoe that require additional support, for example, a heel and/or toe portion of an upper. Yarn 332 is primarily knit on the textile layer that corresponds to the interior facing side of the textile. Yarn 332 may be, for example, a bulky yarn to provide cushioning during use, a moisture wicking yarn to enhance moisture wicking, a stretchable yarn such as a lycra or spandex, any specialty yarn which has properties that are desired to be in contact with the foot, and/or combinations thereof. Yarn 334 and yarn 336 are merged with yarn 330 and yarn 332, respectively based on the design desired for the shoe upper. For example, in some embodiments yarns 334, 336 may have different colors in order to create a desired pattern on the upper of a shoe.

In the example depicted in FIG. 31, merger and divergence may be used for each pass of the carriage such that merged yarns diverge allowing at least one of the yarns to be transferred to the opposite layer of the fabric. This allows for the creation of a pattern on the outside surface of a shoe upper by changing yarn merged with the melt yarn as shown. Further, yarn 330 diverges from yarn 334 and yarn 332 diverges from yarn 336 in zone 338. This allows yarn 330 to be held at needle position 340. By holding yarn 330 at position 340 until the next pass of the carriage, the amount of yarn used can be reduced by limiting the yarn to areas where it is needed. In the case of a yarn such as a melt yarn or bonding yarn, this may increase sustainability of the shoe or knit article by reducing the amount of yarn needed. Further, the zones of an upper or within a knit article can be clearly defined using merger and divergence in this manner to control the positioning of the melt yarn for example, in the heel section.

In some embodiments, yarns such as yarn 330 as depicted in FIGS. 31-34 may not be knit for a number of knit rows and thus may form a vertical float insertion between the front and back layers of the textile.

Figure 32:
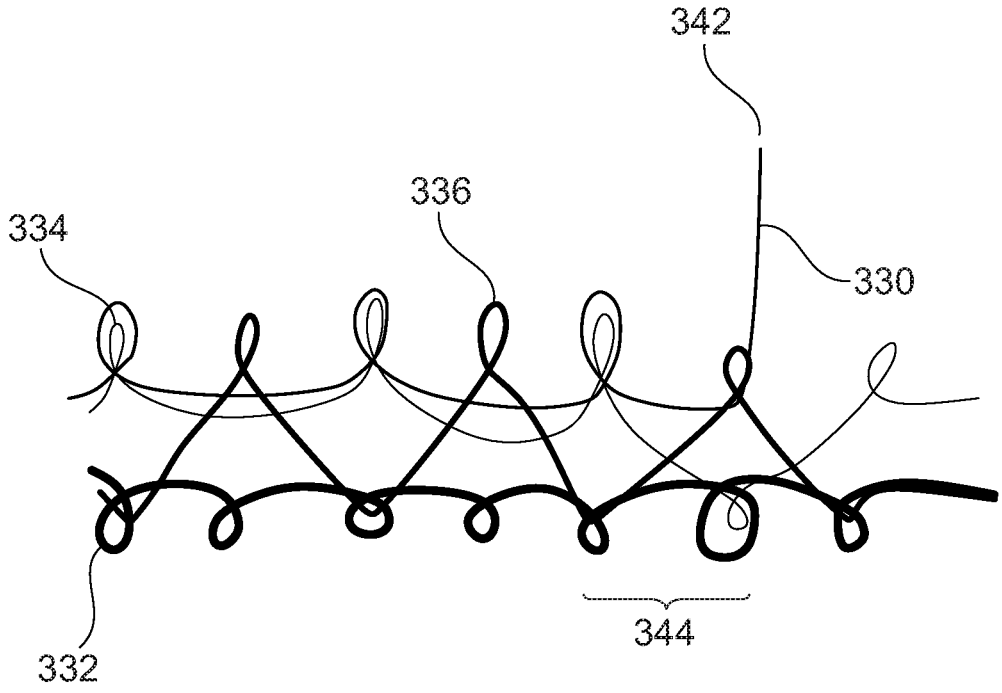
FIG. 32 shows a knitting sequence for at least a portion of a knit element according to some embodiments.
Figure 33:
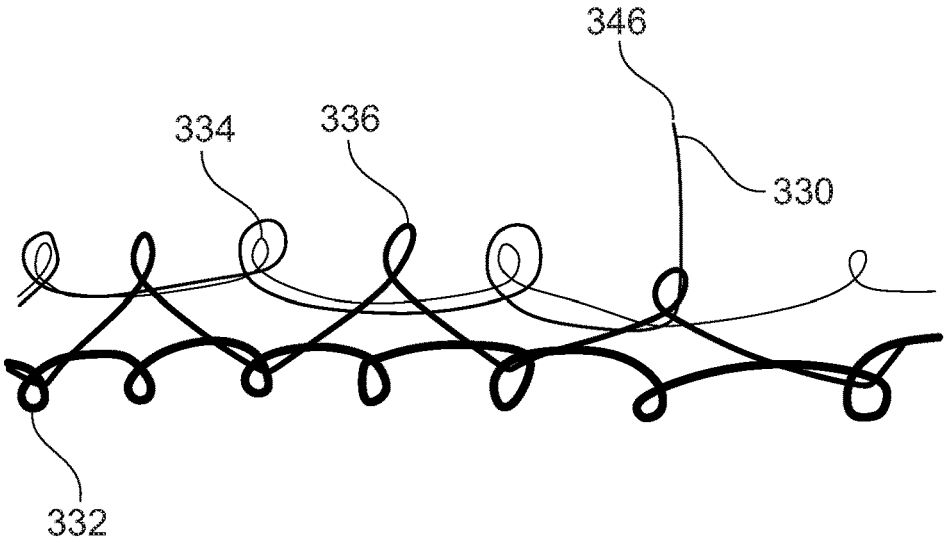
FIG. 33 shows a knitting sequence for at least a portion of a knit element according to some embodiments.

FIGS. 32 to 33 depict knitting sequences that utilize merger and/or divergence while trying to control the placement of yarns in a resource and time efficient manner. In some embodiments, yarns may be selectively placed in areas of the knit element due to yarn properties. Merger and/or divergence may be used in a border between two areas having different properties to selectively place the yarns. It may be desirable due to cost and sustainability issues to limit yarns only to the area in which the properties of the yarn are desired. As shown in FIG. 32, yarn 330 diverges from yarn 334 at zone 344 and is held at needle position 342. To create a separate area utilizing the properties of yarn 330, yarn 330 will be knit again when the carriage makes a pass from the other direction. This process may be repeated until the area of the desired size is created. At position 342 yarn 334 is merged and knit with yarn 332 and subsequently diverge. It is important to note that many knitting sequences configurations may utilize merger and/or divergence and those set for are examples.

FIG. 33 shows another example of a knit sequence where merger and/or divergence is used to control the yarns in areas proximate to each other. As shown merged yarns 330, 334 on the exterior surface are separated such that at needle position 346 yarn 330 may be held until the next pass of the carriage while yarn 334 is floated to the next needle position on the same layer of fabric.

Various configurations of stitches and yarns may be used to create a textile having properties desired by an end-user (e.g., an athlete and/or a consumer), a designer, and/or a developer. For example, an athlete may select to have a certain level of stiffness in a lateral portion of the shoe, through a combination of placement of yarns and/or treatment processes this may be accomplished. In a further example, a football (i.e., soccer) shoe upper may have particular yarn types positioned on the external surface of the key striking areas of the shoe to enhance grip, for example, while having a cushioning yarn placed proximate to predetermined portions of the foot during use. Merger and/or divergence may be used to position a yarn with grip properties and a yarn with cushioning properties in such a manner to create specific zones on a shoe. In some embodiments of a multilayer knit upper, these zones may be selectively positioned on individual layers using merger and/or divergence. FIGS. 31 to 36 depict examples of knitting sequences that could be used to selectively place yarns such as a grip yarn and/or a cushioning yarn in the desired zones on a shoe upper.

Figure 34:
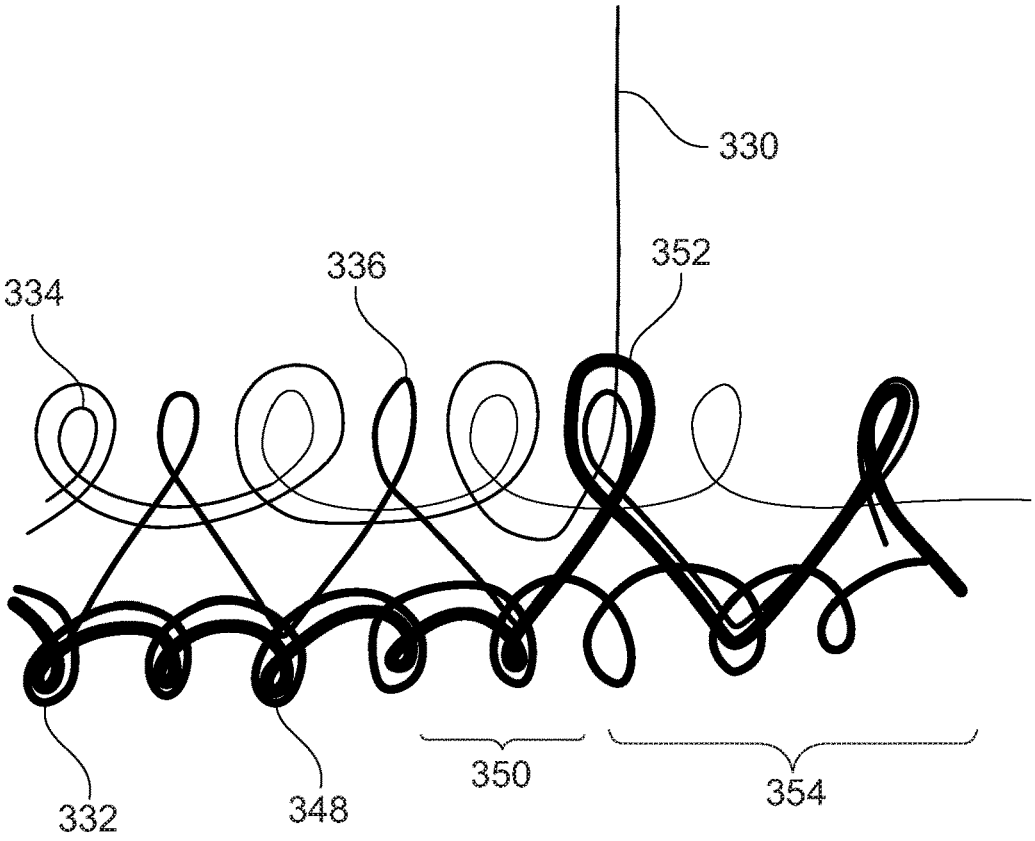
FIG. 34 shows a knitting sequence for at least a portion of a knit element according to some embodiments.

In particular, as shown in FIGS. 31 and 34 yarns may be merged on both layers in a textile to provide specific properties to those zones. Within a given textile, element and/or shoe upper there may be multiple zones that have different properties based on the materials and/or stitch types used. Specifically, in FIG. 34 merged yarns 330, 334 located on a first surface (e.g., external layer of knit element) and 332, 348 diverge in section 350. Yarns 336, 348 are merged together while yarn 330 is held at needle position 352. In portion 354 of knitting sequence the merged yarns 336, 348 remain merged, however, an inversion occurs switching the positions of the yarns in the loops from yarn 348 being the outward facing yarn to yarn 336 being the outward facing yarn.

Figure 35:
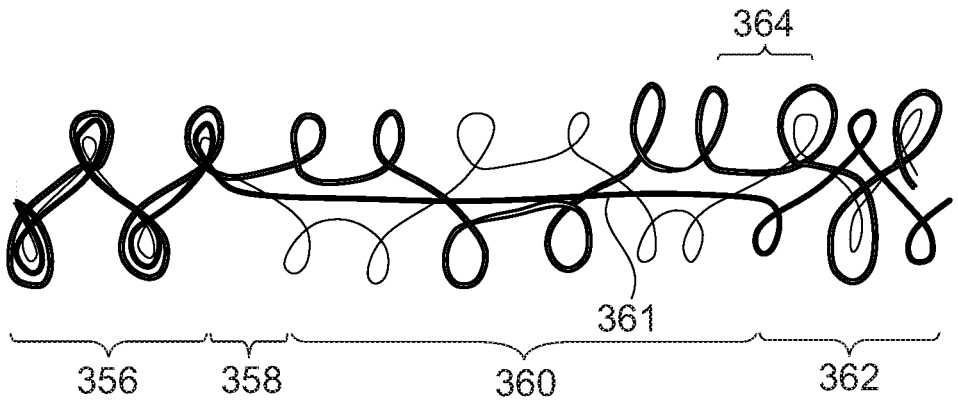
FIG. 35 shows a knitting sequence for at least a portion of a knit element according to some embodiments.

FIG. 35 shows a knitting sequence having different portions including a merging portion 356, diverging portion 358, jacquard portion 360, merging portion 364, and merged jacquard portion 362. Jacquard portion 360 includes yarn 361 as a float insertion between the front and back layers of the textile.

In some embodiments, multiple threads of the same yarn type may be introduced to a knitting machine using multiple feeders so that the threads can be separated using merger and/or divergence.

Figure 36:
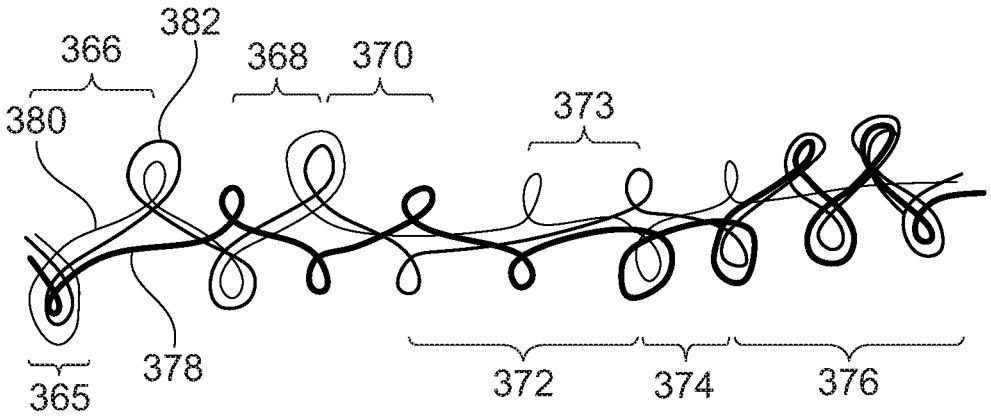
FIG. 36 shows a knitting sequence for at least a portion of a knit element according to some embodiments.

FIG. 36 depicts a knit sequence having multiple portions including multiple yarn merging portion 365, splitting and exchange portion 366, exchanging portion 368, diverging portion 370, jacquard portion 372, merged portion 373, merging and diverging portion 374, and exchanging portion 376. As shown in FIG. 36 it is possible for yarns to diverge and exchange the positions of the remaining yarns as is shown in diverging exchange portion 366. Yarns 378, 380, 382 are merged together in merging portion 365. In diverging exchange portion 366, movement of the independently controlled feeders allows the feeder to change positions and enables exchanging of the yarns which is used to separate at least one of the merged yarns, in particular yarn 378, as well as exchange the positions of yarns 380, 382 in the subsequent merged loop. Independent control of the feeders allows for this control of the yarns to make it possible to conduct merger, divergence, and exchanging in the same portion of the knitting sequence. For example, autonomous independent control of multiple feeders allows for control of the positioning of yarns making it possible to conduct merger, divergence, and/or exchanging in the same portion of the knitting sequence.

Figure 37:
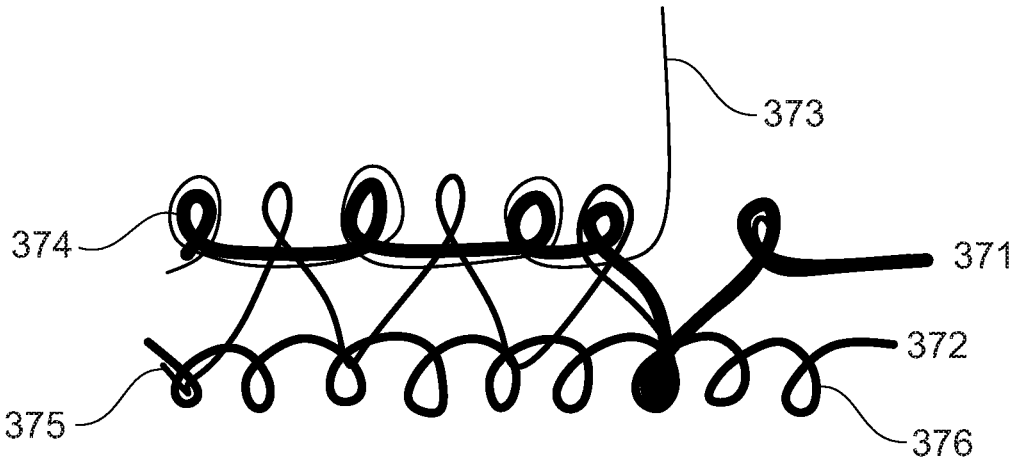
FIG. 37 shows a knitting sequence for at least a portion of a knit element according to some embodiments.
Figure 38:
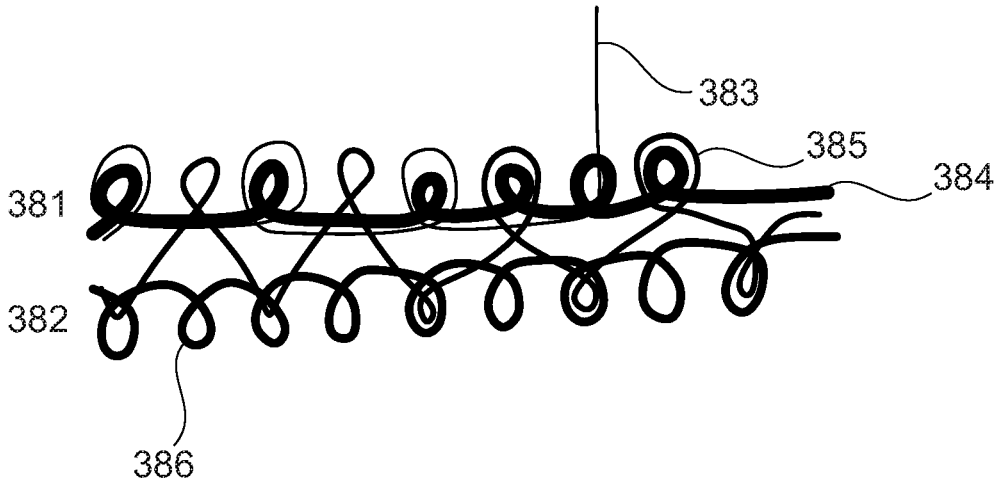
FIG. 38 shows a knitting sequence for at least a portion of a knit element according to some embodiments.

FIGS. 37 to 38 provide additional examples of knitting sequences utilizing merger and/or divergence to control positioning of the yarns within double layer knits. FIG. 37 depicts layer 371 connected to layer 372 using a series of knit loops and tuck stitches. Yarn 373 is knit on layer 371 as the outer yarn at every other stitch and at one point in the knitting sequence becomes a vertical float insert. Yarn 374 is merged with yarn 373 and both are knit together at every other stitch until yarn 373 and yarn 374 diverge so that yarn 373 becomes a vertical float insert and yarn 374 is transferred to face 372 and is knit there. Yarn 376 is knit exclusively on face 372. Yarn 375 connects layer 371 to layer 372 using tucks and stitches. Stitches of yarn 375 that form connections between layer 371 and layer 372 are merged and diverged with other yarns 374, 376. FIG. 38 depicts layer 381 connected to layer 382 using a series of knit loops and tuck stitches. Yarn 373 is knit on layer 371 as the outer yarn at every other stitch and at one point in the knitting sequence becomes a vertical float insert. Yarn 374 is merged with yarn 373 and both are knit together at every other stitch until yarn 373 and yarn 374 diverge so that yarn 373 becomes a vertical float insert and yarn 374 is transferred to face 372 and is knit there. Yarn 376 is knit exclusively on face 372. Yarn 375 connects layer 371 to layer 372 using tucks and stitches. Stitches of yarn 375 that form connections between layer 371 and layer 372 are merged and diverged with other yarns 374, 376.

Figure 39A:
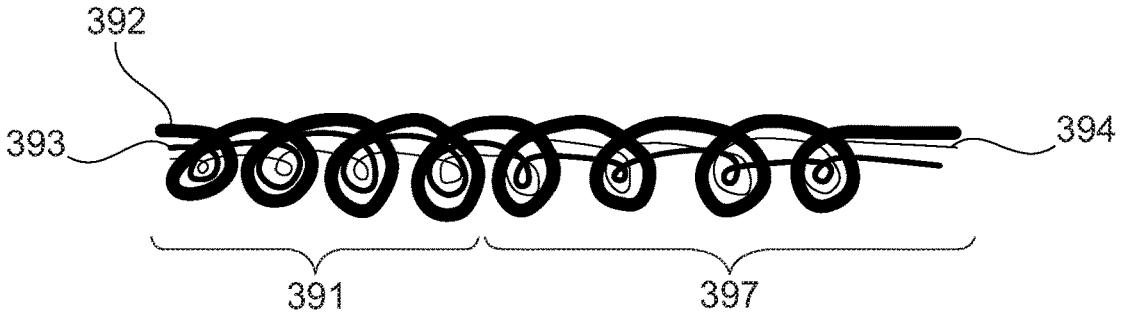
FIGS. 39A-C show a knitting sequence for at least a portion of a knit element according to some embodiments.
Figure 39B:
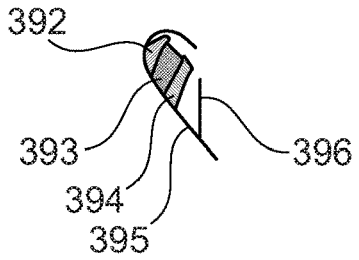
Figure 39C:
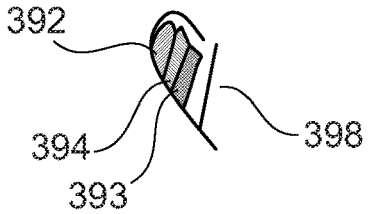

As described herein, it is possible to control properties of an individual stitch by controlling placement of a thread such as a yarn within the stitch. In some embodiments, feeder position relative to the particular needle may determine the position of the thread in the needle and also the position of the thread in a knit structure. For example, multiple feeders may be used to position multiple threads in a particular needle. FIG. 39A depicts an example of exchanging yarn positions within loops in different sections of the knit element. In particular, section 391 includes thread 392, thread 393, and thread 394. As shown in FIG. 39B, thread 392 is positioned in the top of needle 395 and thus becomes the outer yarn in section 391. Thread 393 in the middle position in needle 395, while thread 394 is positioned closest to latch 396. By using independently controlled feeders, threads 392, 393, 394 are rearranged in needle 398 as shown in FIG. 39C. The configuration of yarns in FIG. 39C results in the repositioning of threads 393, 394 as shown in section 397 of FIG. 39A.

Figure 40A:
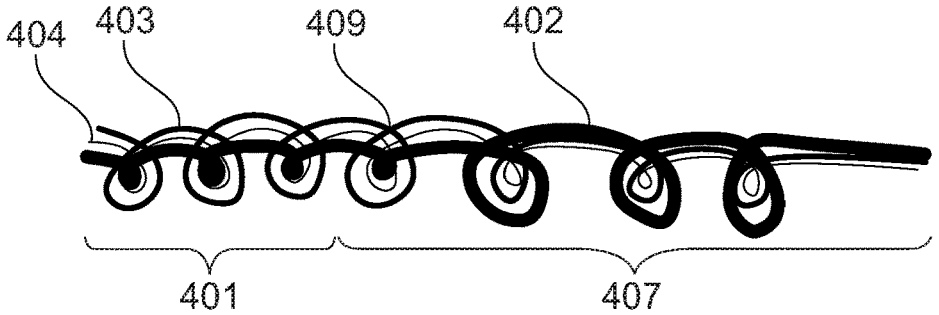
FIGS. 40A-C show a knitting sequence for at least a portion of a knit element according to some embodiments.
Figure 40B:
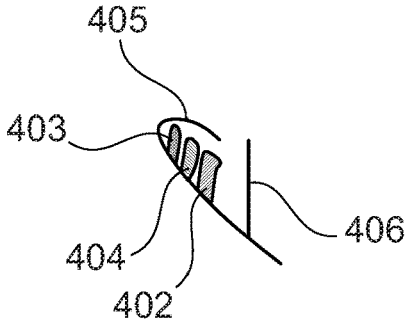
Figure 40C:
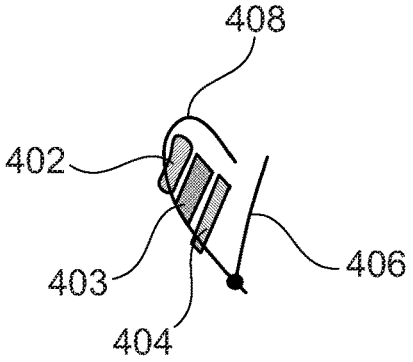

In some embodiments, all of the yarns may be repositioned within a knit element by using the independently controlled feeders. By rearranging the order of the feeders, one controls the order in which the yarns are positioned within the needles. Thus, FIG. 40A depicts a further example of exchanging yarn positions within loops in different sections of the knit element. In section 401, thread 403 forms the outer portion of loop 409, thread 404 is positioned in the middle, and thread 402 forms in the inner portion of loop 409. As shown in FIG. 40B, thread 403 is positioned in the top of needle 405, thread 404 in the middle position in needle 405, while thread 402 is positioned closest to latch 406. By using independently controlled feeders, threads 402, 403, 404 are rearranged in needle 408 as shown in FIG. 40C. The configuration of yarns in FIG. 40C results in the repositioning of threads 402, 403, 404 as shown in section 407 of FIG. 40A. Thus, in some embodiments, it is possible to rearrange all of the yarns within a knit portion such that each yarn occupies a different part of a knitted loop in the section of the knitted element.

Figure 41:
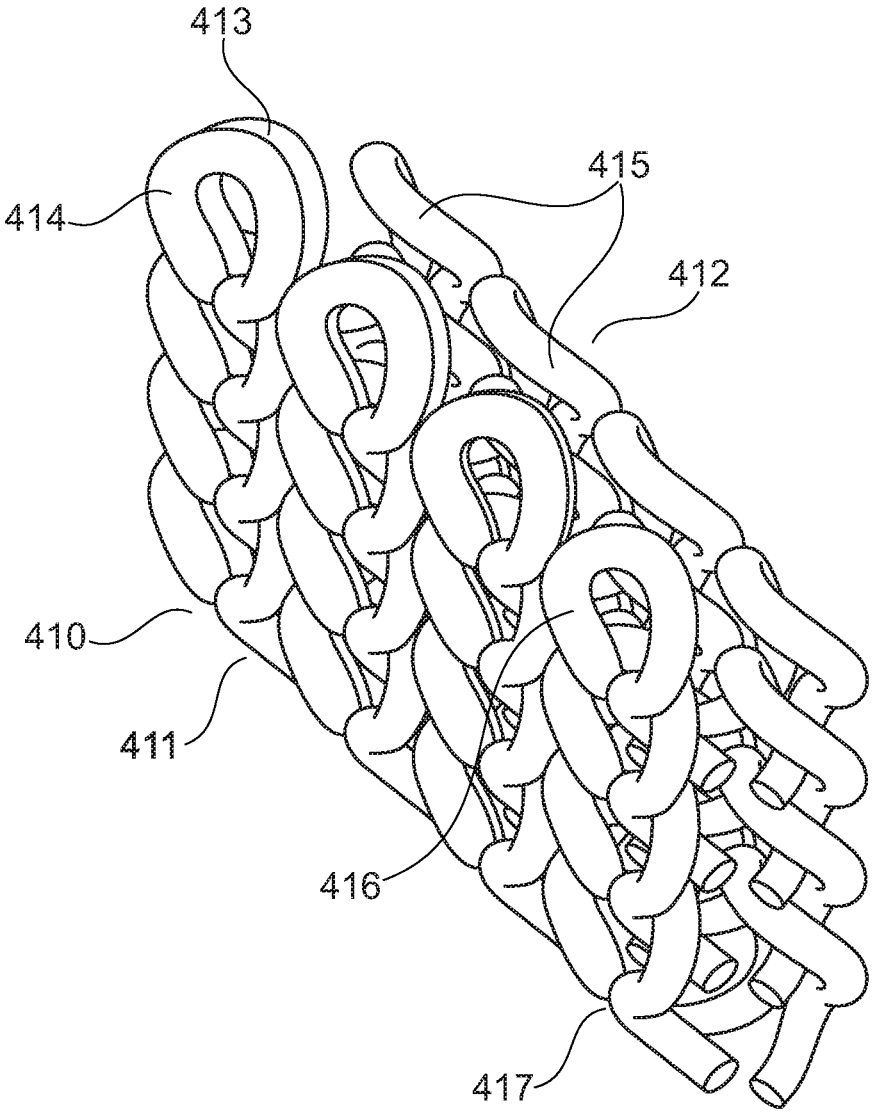
FIG. 41 shows a portion of a knit element demonstrating the use of merging and diverging of yarns according to some embodiments.

FIG. 41 depicts an embodiment of a knit element that includes a double faced knit. Face 411 of structure 410 includes at least two yarns knit to form loops 413, 414. In contrast, loops 415 of face 412 positioned on the back surface of the knit are formed from a single yarn. Further, as shown FIG. 41 some loops 416 in stitches in warp direction 417 are formed after yarns diverge such that only a single loop is formed.

As shown FIG. 41 illustrates a double face fabric where at least a portion of face 411 is knitted with 2 yarns and face 412 is formed from a single yarn.

For example, use of merging and/or diverging yarns may allow for the creation of multiaxial and multilayer knitted reinforced structures with a single needle accuracy. The ability to control placement of the yarns in the needle increases flexibility of placement of the yarns in the knit and further allows for enhancements in functionality. For example, in areas of a knit element that would benefit from reinforcements melt yarns may be placed in differing amounts in order to create zones of varying stiffness and/or strength.

Textile characteristics can be controlled in a detailed way since it is possible to use a broad variety of base materials on a stitch-by-stitch basis. In many embodiments, the threads such as yarns may be dosed depending on the desired properties in that section of the knit. Dosing of threads may be possible by using multiple feeders to deliver a particular type of strand or yarn. In some embodiments, a first feeder may deliver a strand that includes one or more plies, a second feeder may deliver a strand that includes one or more plies, and a third feeder may deliver a strand that includes one or more plies. Some embodiments may include a specific thread type, that is delivered to a first needle from three different feeders each of which includes a thread having differing amounts of material (e.g., numbers of plies). For example, a first feeder may include a strand having four plies of material, a second feeder may include a strand having six plies of material, and the strand from the third feeder may include ten plies of material. During knitting feeders may be selectively positioned to provide preselected amounts of material to the different needles. Thus, in the example given it would be possible to deliver anywhere from four plies (i.e., only one feeder including the strand having four plies) to 20 plies (i.e., all of the feeders described above) to a predetermined needle based on the design of the knit element.

Thus, it would be possible to use, for example, multiple strands of the same material delivered to a needle by multiple feeders in a first section of the knit and only one strand of the material delivered by only one of the feeders to a second section of the knit. In some embodiments any number of feeders may be used to provide threads to a needle of the knitting machine or as an inlay.

A number of strands that may be provided to a knitting machine for inclusion at a particular location may vary based on the type of strand, specific properties of strand such as a thickness of the strand, size of needle to which the strands are to be provided, and/or the surrounding materials. For example, in some embodiments, a needle may be able to accommodate up to sixteen strands. Generally, strands provided to a needle may be in a range from about one (1) strand to about 16 strands. Some embodiments may include knitting four (4) yarns at any given needle depending on the thickness of yarns and gauge of needle.

Strands provided for use as inlays may be provided in varying amounts depending on the construction of the knit, the types of materials used, and/or the knit structures. In some embodiments, inlays may include any number of threads. In some embodiments, inlays may include up to 32 threads.

Thread introduced to a feeder, as disclosed herein, may include one or more plies, yarns, filaments, strands, wires, ribbons, and/or combinations thereof. In some embodiments, a large number of different yarns may be used within a knit element.

Designers may utilize multiple threads in order create a predetermined design and/or impart particular predetermined properties to the knit element and/or a shoe upper. In some embodiments, designers may utilize greater than ten threads to create a desired design. For example, designers may create a design using greater than 20 threads. Further, some embodiments may include designs that include greater than 30 threads.

In this manner, the properties of zones in the knit may be controlled, including for example elasticity, melt characteristics, resistance (e.g., abrasion, cut, heat, fire, water, chemical), thermal regulation, grip, conductivity (e.g., thermal and/or electrical), strength (e.g., tensile strength), weight, breathability, moisture wicking capability, water-repellence, compression, shrinkability, cushioning, reflectivity, insulation, durability, washability, reactivity (e.g., to chemicals, environmental conditions, including moisture, and/or energy, in particular, light, heat or cold), luminescence, etc. For example, in some embodiments, threads may be dosed at varying levels to create specific inlay sequences such that specific product properties are achieved.

Due to the ability to control positioning of the yarns on a single needle level it is possible to create various inlay shapes. For example, there are few limitations, if any, on rectangular or curved pattern elements. Thus, it is possible to create sporty silhouettes, fading effects, or other visual effects.

Thus, placement of yarns using single needle accuracy allows for the production of knits and/or knit elements that are fully customizable or designed for a particular user, sport and/or visual effect. This allows the designs to be flexible with respect to placement of materials as well as improves the ability of a design to meet functional needs.

The use of merging and/or diverging yarns allows for seamless transitions between areas of the knit having different properties. These seamless transitions reduce interruptions and/or irregularities in knit.

Controlling the positioning of threads in the manner described herein reduces the forces applied to the elongated materials, for example, threads such as yarns, during the loop formation. Thus, it is possible to use a broader range of materials in the knit, for example, materials which are not easy to process. For example, materials such as stiff padding materials, conductive yarns, thick multifilament blends, non-stretchable yarns, metal yarns, reflective yarns, high strength yarns, etc. In some knit element embodiments, it may be possible to incorporate threads that under conventional conditions are difficult to process using the methods described herein. For example, threads that have properties such as limited flexibility, smooth surfaces, limited bendability, and/or high fragility may be used for knit elements when processed as described herein.

Utilizing the methods described herein to control positioning of the yarns allows for additional degrees of freedom, for example, it allows individual yarn materials to be positioned in multiple planes. Thus, the knit elements and/or uppers produced using the methods described herein may be transformed into highly complex textile products. For example, controlling the positioning of the yarns at the level of a single needle allows a designer, developer, or potential end-user to create a three dimensional ("3D") mesh grid by moving one or more elements of the knitting systems including, for example, feeders, needles, needle beds, carriages, and/or cam systems. For example, it is possible to create a customized 3D mesh grids, such as a triangle shaped pyramid.

Figure 15A:
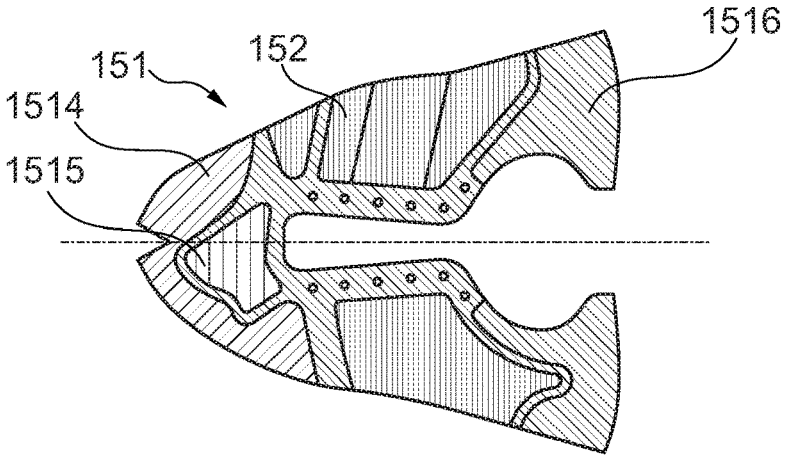
FIGS. 15A-E show illustrations of a combination of different knitting techniques in an upper for a shoe according to some embodiments.
Figure 15B:
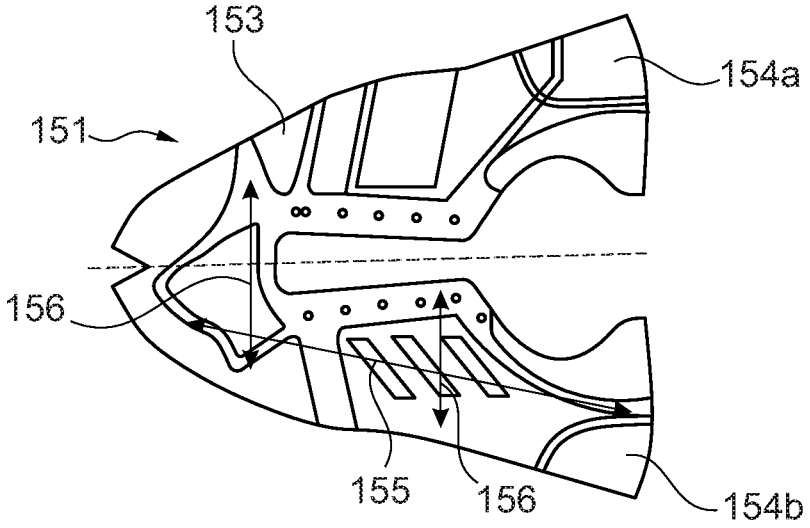

FIGS. 15A and 15B show a further illustration of a combination of different knitting techniques in an upper 151 for a shoe. FIG. 15A shows a structure, which depicts the different knit structures that are being used and their corresponding locations. FIG. 15B depicts a material map showing the yarns and locations of the various yarns that are being used.

In some embodiments, for example, as depicted in FIG. 15A, a nearly closed knit structure is used in area 152. Area 1514 is an open knit structure, area 1515 is a half open knit structure, and the area 1516 is a closed knit structure. However, it should be noted that the arrangement of areas and the knit structures can be varied and may be different in different embodiments according to the visual and physical properties desired.

In some embodiments of FIG. 15A, areas 152, 1514, 1515, 1516 may be defined by a particular physical property such as stretch. Using controlled positioning of yarns through the use of independently controlled feeders allows for each area shown in FIG. 15A to include a different number or type of threads. For example, if the same material is used throughout the upper, use of merger and divergence would allow the number of threads to vary in the different areas. In area 1514 which would likely require little stretch multiple threads may be delivered to the needles using multiple independent feeders. In a shoe that requires stretch in area 1515 the number of threads provided to the needles may be reduced when knitting area 1515. Alternatively, a stretchable thread such as an elastic may be provided in addition to one or more threads of a standard polyester through separate independent feeders.

In this manner, it is possible to achieve great variation in any given predetermined design by creating combinations of threads from pre-loaded independently controlled feeders. Thus, it is possible to create a number of customized knit elements to include shoe uppers that have multiple areas having different properties and structures.

In some embodiments, as shown in the example depicted in FIG. 15B, in the area 153, which corresponds to almost the entire upper, a monofilament yarn may be used in addition to a PES (i.e., polyester) yarn. In some embodiments, PES yarn may be used alone. In the areas 154*a* and 154*b* a fuse yarn is used. The melt yarn may be combined with other yarns in areas 154*a* and 154*b*, such as a polyester yarn. Areas requiring the ability to stretch and recover to their original shape may be knit using tension in order to enhance recovery. Use of the independent controlled feeders allows for more consistent control of tension in the yarns throughout the various areas of the knit. Further, the yarn feeders may be controlled such that a tension in the thread can be altered based upon a position in the knit. For example, in some embodiments, the tension in an elastic thread used for a float insertion may be varied in different rows. Thus, different compression forces can be achieved in the different rows or parts of the upper.

Further, float insertions can be positioned in different rows in different locations. For example, float insertion may be positioned between a front and back layer of a double jersey fabric, on the front face of the double jersey fabric or on a back face of the double jersey fabric.

FIG. 15B also depicts the natural stretch of the upper 151. Knits stretch more along a row and less along the wale. That means that along the arrow 156 which runs from the lateral midfoot to the eyestay and across the forefoot, the stretch will be greater as compared to the direction depicted by arrow 155, because that is the direction of the knitted row.

Figure 15C:
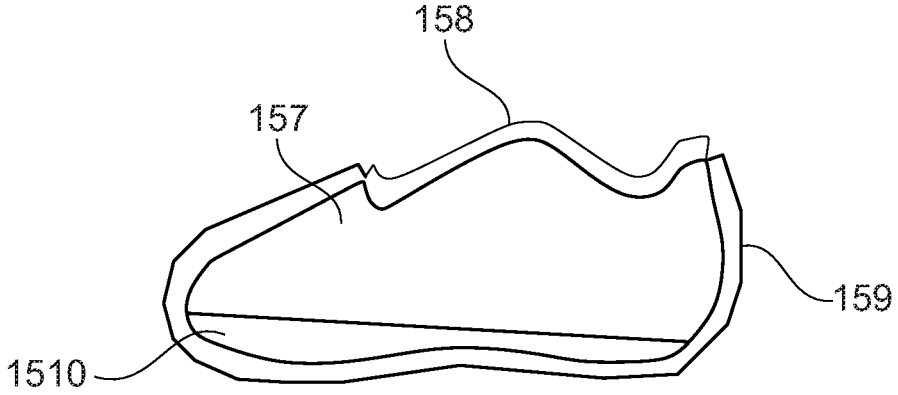

While FIGS. 15A and 15B depict the upper 151 in a flat configuration, FIG. 15C schematically depicts the upper 151 having a three-dimensional configuration in a side view. Essentially, the upper 151 comprises two symmetrical layers which are only connected to each other at a portion of their edges. Thus, the edges of the upper 151 are open in the portion 158, whereas in the portion 159 the edges are closed. In the area 157 a tight knit is used, whereas in section 1510 an elastic knit is used. Properties of the knit, for example, tight knit in contrast to an elastic knit may be the result of yarn selection, number of yarns, knitted structure selection, number of layers of knit material, number of connections between layers, tension applied, and/or a combination of such factors.

Figure 15D:
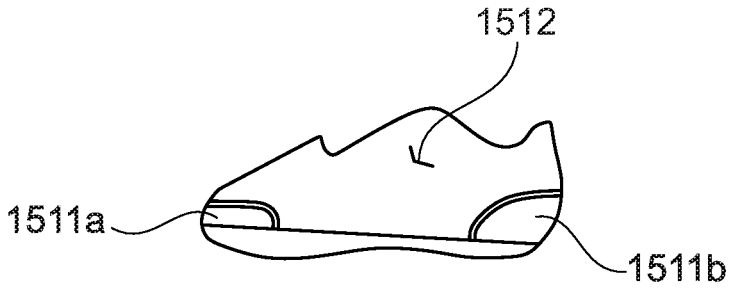
Figure 15E:
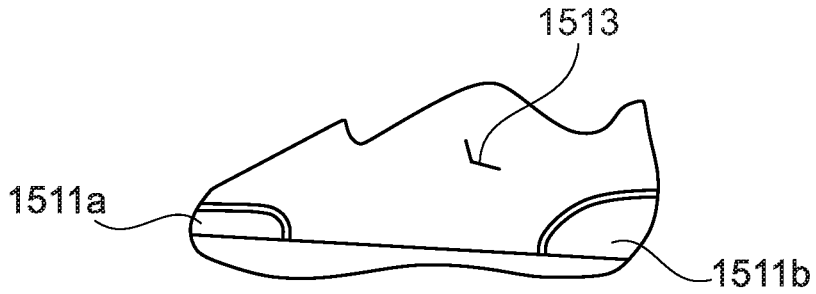

FIGS. 15D and 15E show two alternative distributions of yarns in the upper 151. Turning to FIG. 15D, a fuse yarn, a PES (polyester) yarn, and a monofilament are used in sections 1511*a* and 1511*b*. In section 1512, a PES yarn and a monofilament are used. The embodiment in FIG. 15E is similar to the embodiment in FIG. 15D. However, in the section 1513 (corresponding to section 1512 in FIG. 15D), a fuse yarn in combination with a PES yarn and monofilament is used. The amount of fuse yarn in section 1513 is less than in areas 1511*a* and 1511*b*.

Generally, the upper 151 is a knitted upper made on a flat knitting machine. It comprises the upper part and the bottom part of a footwear component to be knitted as one piece. Lateral and medial sides may be mirrored to an extent and may be knitted at the same time on the front and rear needle bed on a two, three or four needle bed machine.

A plurality of yarns is used to achieve certain functionalities and visuals. Different knit structures and knitting methods are combined for a proper construction. Due to not connected medial and lateral side layers, a bag is going to be created which acts as the outer shell of a footwear product. The yarns, the stitches, and the knit construction are generating the function and appearance, zones like stretch, non-stretch, supporting, reinforcing, padding, open and closed areas are integrated.

In some embodiments, the three-dimensional shape of the upper 151 is achieved by converting the shape into a two-dimensional jacquard drawing. The individual jacquard sections/rows are then connected using merger and divergence as described herein. The three-dimensional shape is obtained by the connection of the split loops from the merger and/or divergence. Thus, merger and/or divergence allows one yarn to continue along the row while the other can be used to form a tuck, float, or stitch. For example, merger and/or divergence allows one yarn to continue along the row on a first needle bed while the other can be used to form a tuck, float, or stitch on the opposite needle bed, between the layers, or on a surface of the knit.

Figure 16:
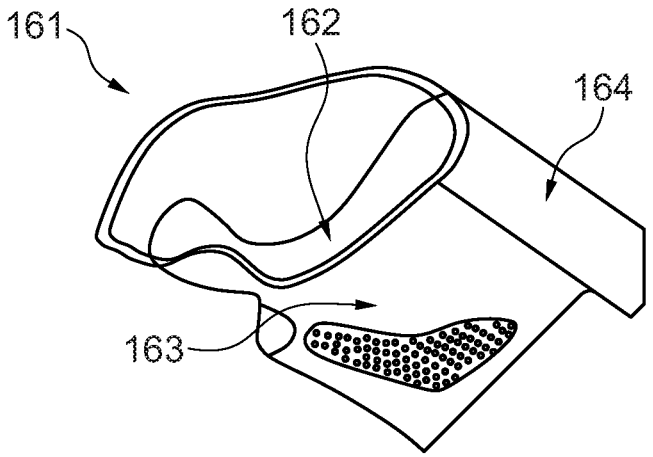
FIG. 16 shows a top view of a collar of an upper according to some embodiments.

FIG. 16 shows a top view of an exemplary embodiment of a collar 161 of an upper, such as one of the uppers previously shown. The inside of the collar 161 is denoted with the arrow 162. The area 163 comprises a non-stretch knit, whereas the section 164 comprises a knit with stretch.

Figure 17:
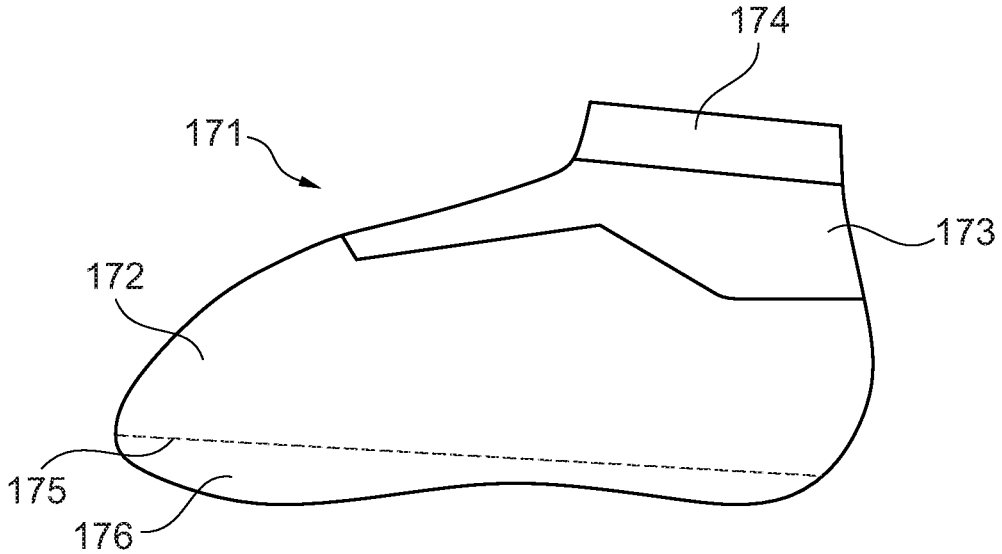
FIG. 17 shows a schematic drawing of an upper according to some embodiments.

FIG. 17 is a schematic drawing of another exemplary embodiment of an upper 171 for a shoe and shows the distribution of different knit structures. Thus, in the area 172 a tight knit is used, whereas in the area 173 an elastic knit is used. The collar of the upper 171 is denoted with the reference numeral 174. Upper 171 may include demarcation line 175 separating sections of the upper such as area 172 and outsole 176. In some embodiments, merger and/or divergence may be used to join sections of the upper. For example, the three-dimensional shape may be obtained in part by the connection of the split loops at points where sections join.

Figure 18A:
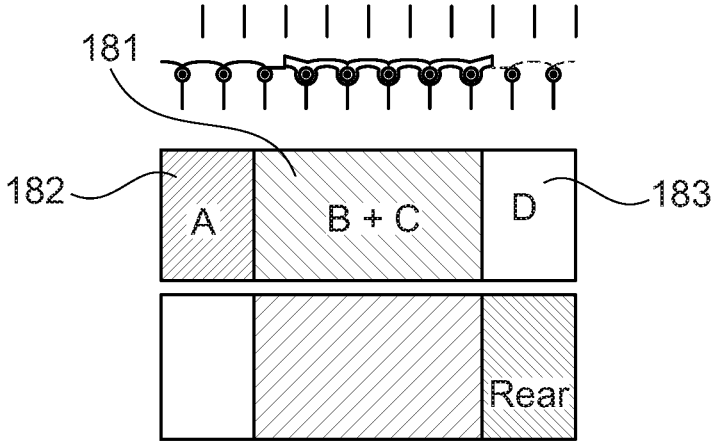
FIG. 18A shows the combination of exchanging with an intarsia technique according to some embodiments.
Figure 18B:
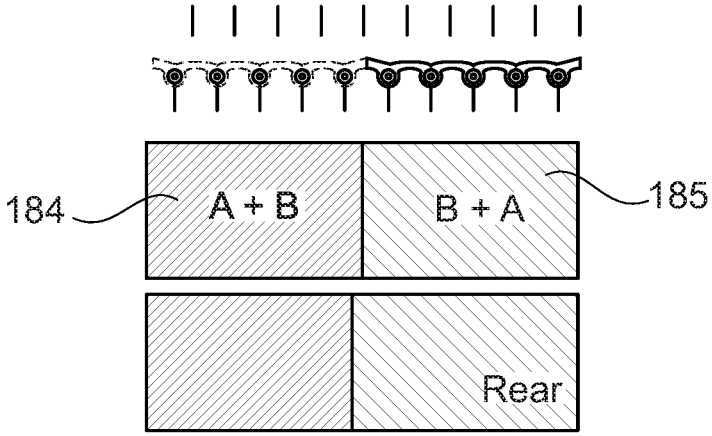
FIG. 18B shows exchanging alone according to some embodiments.
Figure 18C:
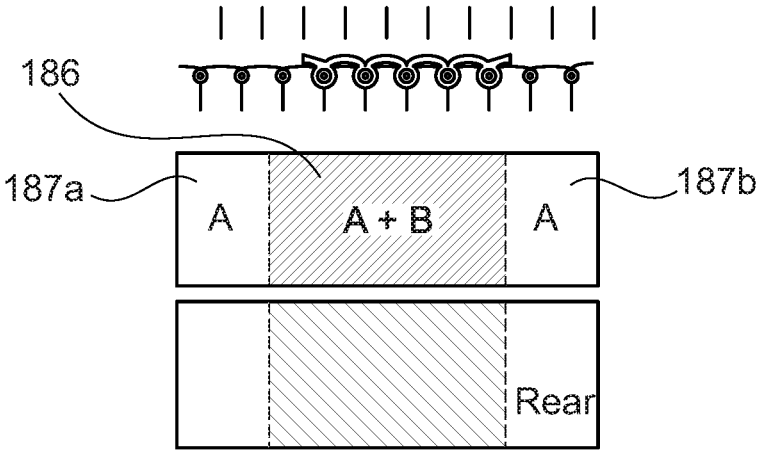
FIG. 18C shows selective merger according to some embodiments.

FIGS. 18A to 18C show combinations of different knitting techniques which can be used in the context of the present disclosure. The upper part of each of these figures represents the knitting diagram, the middle part shows a corresponding front side of a knit and the lower part shows its rear side.

FIG. 18A shows the combination of exchange with an intarsia technique, wherein two or more yarns B, C work together in one intarsia area 181. Yarns B, C are not used in neighboring areas 182 and 183. Yarns A, D are used in areas 182, 183, with yarn A appearing on the front face of area 182 and yarn B appearing on the rear face. The positioning of yarns A, D in area 183 is reversed.

FIG. 18B shows exchange alone, wherein two or more yarns 201, 203 work together in one area 184. In area 185, yarns 201, 203 change their relative position in the loops such that yarn 203 is on the outside of the loops and more visible than in area 184.

FIG. 18C shows selective merging, where two or more yarns (as shown yarns 205, 207) work together only in one selected area 186 in the same knitting row and at least one yarn 207 is also used outside the selected area 186, for example in areas 187*a* and 187*b*.

Use of independently controlled feeders allows for a full range of exchanging possibilities. Further, using independently controlled feeders reduces knitting time needed to use exchanging in a knit element.

Figure 19:
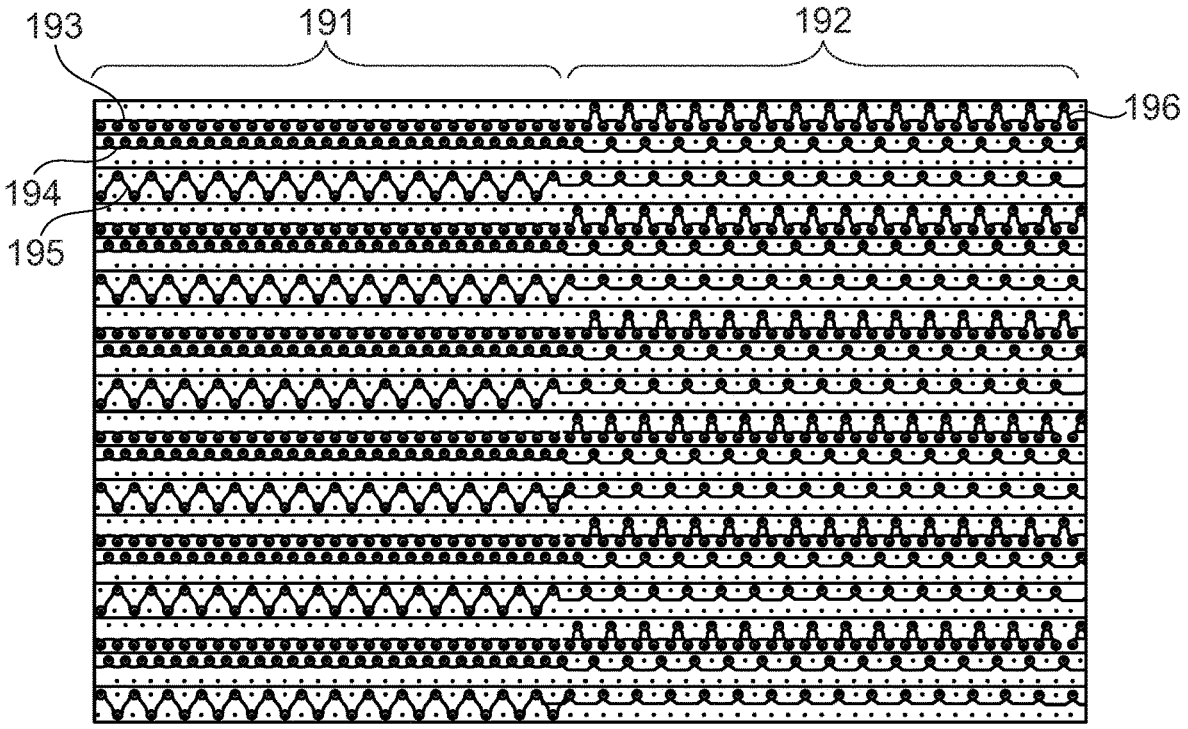
FIG. 19 shows a knitting sequence for a double needle bed flat knitting machine according to some embodiments.

FIG. 19 shows a knitting sequence for a double needle bed flat knitting machine. Each respective first row depicts the back of the fabric and each respective second row depicts the front of the fabric for every pass of the feeders. The dots depict needles and the lines depict the various yarns. This drawing depicts a knit having two sections with different knit structures, where the first section 191 is on the left side of FIG. 19 and the second section 192 is on the right side. The first section 191 is a spacer knit and the second section 192 is a jacquard knit.

In both sections 191 and 192 the yarns 193, 194, 195 and 196 are used. However, the yarn 193 is only visible in section 191, but not in section 192, whereas the yarn 196 is only visible in section 192, but not in section 191. In the section 191 the yarn 193 is merged together with the yarn 196 that was knit on the front needle bed, then the yarn 194 is knit on the back needle bed, and then both needle beds are connected using tuck stitches using the yarn 195. In the spacer section the yarn 193 is merged as the outer yarn.

In the jacquard section 192 the plating was reversed and the yarn 196 becomes the outer yarn and is thus visible. The first row in the jacquard section 192 depicts the merged yarns 193 and 196 being knit together on both the back and front layers. The yarn 194 then knits on the back every other needle and then the yarn 195 on the back every other needle. Then the sequence starts again.

In the following, further additional knitting techniques are described which can be used in the context of the present disclosure and which can be combined with the technique of the present disclosure and/or with another additional knitting technique to be discussed now.

Figure 28:
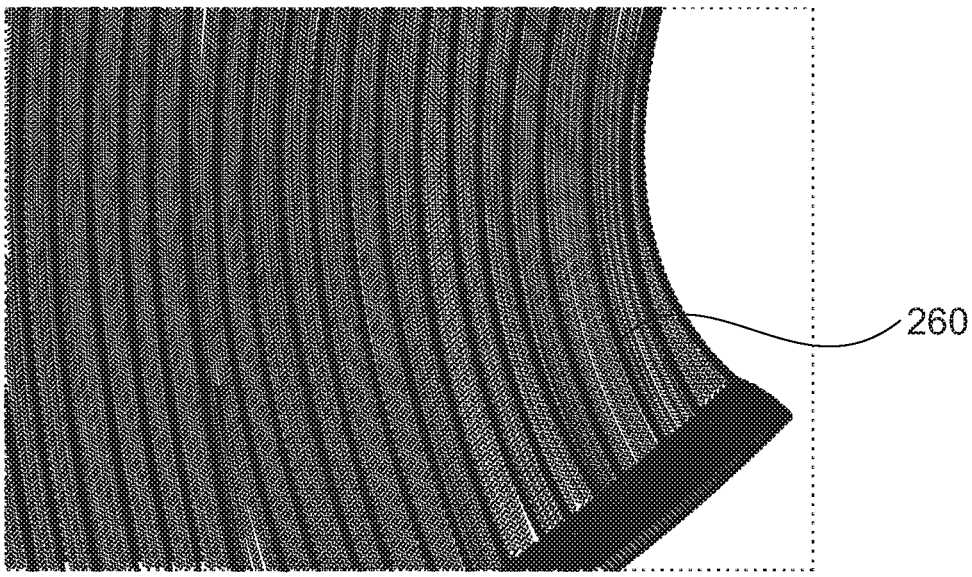
FIG. 28 shows a knit element that combines merger and divergence with partial knitting according to some embodiments.

One technique, which can be combined with merger and/or divergence according to the present disclosure is partial knitting which is used to create shaped knits. FIG. 28 shows sample 260 which is a combination of merger and divergence and partial knitting. In this illustrative example, merger and divergence is occurring while the length of knit rows increases or decreases, for example, a number of needle positions at which stitches are formed. Any knitting sequence involving merger and/or divergence may be used in combination with partial knitting. The partial knitting technique involves knitting groups of stitches while others are held in a non-knit position. One must select the needle that one would like to knit manually. To this end the selected needles are pushed into a working position and all the others into a non-working position. This technique is usually used to shape a garment with darts and heels of socks. But strong textural effects can also be produced, particularly raised patterns and random bobbles and the ability to change color/yarn in the middle of individual rows.

Another technique, which can be combined with merger and/or divergence according to the present disclosure and/or with partial knitting is intarsia merger which has been briefly discussed above. Intarsia merger creates zones with new yarns introduced into them as described with respect to FIG. 18A. The connection of two zones can be made via stitches such as a tuck stitch or a normal knit loop. Intarsia merger decreases the knitting time.

Techniques which can be combined include merger, divergence, partial knitting, intarsia, and/or exchanging merged yarns. Compared to intarsia merger, sections of fabric that include exchanged merged yarns have a higher resistance to tear at the border between the different yarns (e.g., colors and/or properties), due to the absence of tuck connections between the different yarns. For example, the crossing between a first color and a second color yarn is clean. Exchanging merged yarns is a unique method for having more colors in the same knitting row. Without the use of independently controlled feeders this is possible in a cost-effective manner only using jacquard or intarsia merger. The use of the independently controlled feeders reduces knitting time. Exchanging merged yarns can be combined for example with float insertion to achieve weave similar look fabrics. Exchanging merged yarns requires at least two yarns in a loop and changes the yarn position in the loop.

Techniques which can be combined include merger, divergence, partial knitting, intarsia merger, exchanging merged yarns, and/or float insertion.

In float insertion, a yarn, for example, a monofilament or a rigid yarn may be inserted to reduce the elasticity of the fabric. In contrast, float insertion of an elastic thread or yarn can create stretch and/or different compressions.

In some embodiments, yarn delivery systems (such as Memminger EFS 920 devices) can be programmed to change the tension of the elastic yarn or thread for float insertion in different rows. This would allow the number of such devices to be reduced, making this kind of technology more practical. With this technique, different compression forces can be achieved in different parts of an upper. Use of the independent controlled feeders allows for more consistent control of tension in the yarns throughout the various areas of the knit. Further, the yarn feeders may be controlled such that a tension in the thread can be altered based upon a position in the knit. For example, the tension in an elastic thread used for a float insertion may be varied in different rows. Thus, different compression forces can be achieved in the different rows or parts of the upper.

In some embodiments, two layers of fabrics with float insertion are created. The float insertion thread can be inserted every row or in a different order. In some embodiments, the float insertion thread is positioned between the front and the back layer, on the front face of the double jersey fabric or on a back face of the double jersey fabric.

In some embodiments, one-layer fabrics are created with float insertion where the float insertion thread extends along a row between the stitches of the same layer by transferring stitches of the layer to either the front or back needle bed to block the float insertion. This technique can also be used on a multiple layer fabric by transferring stitches from one needle bed to another and allowing the float insertion to travel on the surface of the transferred stitches.

A vertical float insertion can be achieved by positioning a yarn feeder holding the yarn used for the float insertion between the two layers of fabric as they are being knit on the front and/or back needle bed. In some embodiments, vertical float insertions are not producing stitches. Vertical float insertions can also have different angles by changing the position of the yarn feeders in different rows. Each vertical float insertion can be produced by one yarn feeder. In some embodiments, a yarn may be utilized as a vertical float for a number of rows of stitches and then knit into the knitted element at a predetermined location. In some embodiments, it may be possible to create a vertical float insertion on a surface of a knitted component by selectively transferring stitches from one needle bed to another. For example, in a single jersey fabric a float insertion may be held by a needle during the knitting of multiple rows. At preselected locations along the length of the float insertion stitches may be transferred from a first needle bed to a second needle bed.

In one-layer fabrics with float insertion the sequence of the blocking transfers can produce different visual patterns. As shown in FIGS. 10A to 10D, float insertions 101 are visible to varying extents based on the position of the transfers of the stitches. Different patterns may result by using various colors and types of yarns as shown in FIGS. 10A to 10D.

In two-layer fabrics with float insertion the float insertion 111 can be exposed and visible when looking at the fabric, for example, if semi-open holes or open holes are created in a certain pattern as shown in FIGS. 11A and 11B.

More float insertion threads can be inserted at the same time by different yarn feeders. For example, in some cases four feeders may be used to insert four different yarns as at float insertion in a given position. At the next position where a float insertion is to be made three feeders may insert three different or similar yarns to create a float insertion. Utilizing multiple feeders to deliver yarns or threads can be useful for creating areas having different properties, for example, for creating visual fading effects in a knit element.

Another technique, which can be combined with merger and/or divergence according to the present disclosure and/or with partial knitting and/or with intarsia merger and/or with exchanging and/or with float insertion is spacer knit. In a spacer knit, a tuck stitch is made between front and back side every other stitch. In a single pass of the knitting machine, the next pass is a reflection of the first. In a double pass of the carriage, connections may be made from the front to the back side at every stitch. When combining spacer knit with float insertion, the float yarn may have a particular property, such as being conductive, reflective, light emitting, structural and/or a non-stretchable yarn.

In an example of a combination of exchanging of merged yarns and intarsia (which is unique for footwear) each field is a separate merger (i.e., different yarns, threads, or strands are combined) and each field can have new feeders. For example, some field may have two new feeders. This allows for zonal knitting by inserting yarns to specific areas in particular for controlling the positioning of the yarns to influence properties of the knit.

This combination of exchanging and intarsia is made easier by the use of independently controlled feeders on a flatbed knitting machine. The precise placement that independently controlled feeders provides, allows for the creation of color fields of smaller width than on conventional knitting machines. Thus, more colors can be used in a given row, in particular on small width fabric, than would be possible without the independently controlled feeders.

In another example, single and double jersey are combined. This allows to create zones with one layer and zones with two layers in a single knit element. Additionally, float insertion may be used to selectively position the float.

The present disclosure is further described by the following examples.

In a first example, a shoe upper comprising: a flat-knit element comprising: a first section of the knit element in a first knit row comprising: a first thread (11); and a second thread (12) wherein the first and second threads are merged and form one or more first merged knit structures (10) wherein the first thread is a body thread and the second thread is the merge thread in the first merged knit structure; and a second section of the knit element comprising: at least one first knit structure (13) formed from the first thread (11) of the merged threads; and at least one second knit (14) structure formed in the first knit row from the second thread (12) of the merged threads separate from the first knit structure (13).

In a second example, a shoe upper according to example 1 further comprising a third section integrally knit with at least one of the first and second sections wherein the first thread is the merge thread and the second thread is the body thread in one or more second merged knit structures of the third section.

In a third example, a shoe upper according to one of the preceding examples, wherein at least one of the first, second, third sections or a fourth section comprises a jacquard pattern and wherein the sections are coupled using knit structures.

In a fourth example, a shoe upper according to one of the preceding examples, wherein at least a portion of the knit element is a double-layer and each of the first merged knit structure, the first (13) and/or second (14) knit structures comprise a loop, a tuck stitch, or a float insertion positioned on an external layer, an internal layer, or in an interstitial space between the layers.

In a fifth example, a shoe upper according to one of the preceding examples wherein at least a portion of the flat-knit element comprises a double layer and wherein the first knit structure is a positioned in an interstitial space between a first layer and a second layer of the knit element based on a predetermined characteristic of the first thread and wherein the second knit structure is knit in the first or second layer of the knit element.

In a sixth example, a shoe upper according to one of the preceding examples, wherein the first knit structure (13) and the second knit structure (14) are located at specific predetermined locations of the article.

In a seventh example, a shoe upper according any of the preceding examples wherein the first and second threads are positioned along a knitted row in the at least one first and second knit structures in a manner such that when a portion of at least one of the first and/or second threads is pulled, the at least one first and second knit structures inhibit snagging and/or unravelling of the knitted row in which the threads are positioned.

In an eighth example, a shoe upper according to one of the preceding examples wherein the first knit structure is a vertical float insertion such that the first thread forms a third merged knit structure in a second row of the first section of the knit element such that the first thread is substantially limited to a first zone having at least one predetermined characteristic.

In a ninth example, a shoe upper according to one of the preceding examples, wherein the first thread comprises a first predetermined characteristic and the second thread comprises a second predetermined characteristic and wherein at least one of the first and second predetermined characteristics comprise at least one of elasticity, melt temperature, thermal regulation, antistatic, antibacterial, abrasion resistance, cut resistance, heat resistance, water resistance, chemical resistance, flame resistance, grip, thermal conductivity, electrical conductivity, data transmission, strength, weight, breathability, moisture wicking capability, water-repellence, compression, shrinkability, cushioning, reflectivity, insulation, durability, washability, reactivity, energy absorption or luminescence.

In a tenth example, a shoe upper according to one of the preceding examples further comprising a fourth merged knit structure comprising a third thread and a fourth thread wherein a fifth merged knit structure is formed from the second and fourth threads.

In an eleventh example, a shoe upper having a predetermined design comprising: a flat-knit element of the shoe upper comprising: a first section comprising: one or more loops formed from a first thread positioned as a first body thread and a second thread positioned as a merge thread merged together; a second section comprising: one or more loops formed from the first thread positioned as a second merge thread and the second thread positioned as a second body thread merged together; wherein the first and second threads extend continuously from the first section into the second section; and wherein the first and second threads alternate in at least some loops of the knit element such that the predetermined design is created in the knit element.

In a twelfth example, a shoe upper according to example 11, further comprising: a divergence section of the knit element wherein the first thread and the second thread are separated; at least one first knit structure (13) formed from the first thread (11) of the merged threads; and at least one second knit (14) structure formed from the second thread (12) of the merged threads.

In a thirteenth example, a shoe upper according to one of examples 11-12 wherein the at least one first knit structure is a vertical float insertion such that the first thread forms a merged knit structure in a second row of the first or second sections of the knit element such that the first thread is substantially limited to a first zone having at least one predetermined characteristic.

In a fourteenth example, a shoe upper according to one of examples 11-13 wherein at least one of the first, second sections or a third section comprises a jacquard knit pattern that includes at least one of the first and second threads and wherein the sections are coupled using knit structures.

In a fifteenth example, a shoe upper according to one of examples 11-13, further comprising at least a third thread wherein at least one of the sections comprises at least 2 threads of the first, second, or third threads in a jacquard knit structure such that at least a portion of the predetermined design is formed.

In a sixteenth example, a shoe upper according to one of examples 11-15 further comprising a matched shoe upper wherein the threads have been positioned using at least one of exchange plating, merger, divergence, and jacquard knitting to create a paired predetermined design.

In a seventeenth example, a method of producing paired knit shoe uppers on a flat-knitting machine comprising: knitting a first thread having a first characteristic and a second thread having a second characteristic as merged threads to form a first section wherein the first thread is a first body thread and the second thread is a first merge thread; controlling the positioning of the first and second threads in a second section of the shoe upper by adjusting a position of the threads in a space inclusive of the first section and a next needle position to be knit using a first independent feeder and a second independent feeder, respectively; and knitting the first thread and the second thread having as merged threads to form a second section wherein the first thread is a second merge thread and the second thread is a second body thread; wherein the position of the threads generates a first predetermined design in a first of the shoe uppers and a paired predetermined design in a second of the shoe uppers.

In an eighteenth example, the method according to example 17 further comprising: controlling the positioning of the first and second threads in a third section of the shoe upper by adjusting a position of the threads by positioning the first independent feeder and the second independent feeder to a location that encompasses a last knit position to a next needle position to be knit; and knitting the first thread and the second thread using separate cam systems such that the first thread forms a first knit structure and the second thread forms a second knit structure.

In a nineteenth example, a method according to example 17 or 18 further comprising: knitting at least three threads to create a double-layer knit element for a shoe upper in at least one of the first, second, third sections and/or a fourth section; and knitting a jacquard pattern using at least two threads in the at least one of the first, second, third and fourth sections.

In a twentieth example, a method according to one of examples 17-19, further comprising: executing a knitting program for the knit element of each of the shoe uppers in a controller for the flat-knitting machine; and adjusting a first knit pattern for the first predetermined design of the first shoe upper to generate a paired knit pattern that determines the paired predetermined design.

In a twenty-first example, the method according to one of examples 17-20, further comprising knitting the threads within the uppers such that one or more zones having predetermined characteristics are formed; and wherein the threads each have a predetermined characteristic that comprises at least one of elasticity, melt temperature, thermal regulation, antistatic, antibacterial, abrasion resistance, cut resistance, heat resistance, water resistance, chemical resistance, flame resistance, grip, thermal conductivity, electrical conductivity, data transmission, strength, weight, breathability, moisture wicking capability, water-repellence, compression, shrinkability, cushioning, reflectivity, insulation, durability, washability, reactivity, predetermined energy absorption and/or luminescence.

In a twenty-second example, a method of forming a customized shoe upper, comprising: In a twenty-third example, controlling a first independent multi-use feeder in at least one plane of movement; controlling a second independent feeder in at least one plane of movement; controlling a plurality of needles in at least one plane of movement; controlling one or more cam systems in at least one plane of movement; providing a first thread from the first feeder to a first needle such that the first thread is positioned proximate a first hook; providing a second thread from the second feeder to the first needle such that the second thread is positioned proximate the first thread in the first hook; forming a first knit structure of a first section using the first and second threads; controlling the first and second independent feeders such that the first and second threads are separated; separating the first thread and the second threads; forming a second knit structure of a second section using the first thread; forming a first knit structure of the second section using the first thread; forming a second knit structure of the second section using the second thread; forming a third knit structure of the second section using the third thread; forming a third section of the knit element, comprising: plating at least two of the first, second and third threads; forming a first knit structure of the third section using the at least two merged threads; and forming a second knit structure of the third section using at least one of the first, second, or third threads.

In a twenty-third example, the method of example 22 wherein the first independent feeder has a first position at a first angle from a vertical plane extending through a transverse axis of a needle bed, and the second independent feeder has a second position at a second angle from a vertical plane extending through a transverse axis of a needle bed, and wherein the first angle and the second angle differ.

In a twenty-fourth example, an article comprising a flat-knit element, wherein the knit element comprises: a first section comprising at least two threads (11, 12), both threads forming a merged knit structure (10); a second section comprising the at least two threads in an exchanged merged knit structure; a third section comprising: at least one first knit structure (13) formed from a first thread (11) of the merged threads having a first predetermined characteristic; and at least one second knit (14) structure formed from a second thread (12) of the merged threads having a second predetermined characteristic, separate from the first knit structure (13); a fourth section comprising an additional thread knitted with the at least two threads in a jacquard knit sequence; wherein the positioning of the threads creates a predetermined design.

In a twenty-fifth example, an article according to example 24 wherein the first and second threads are positioned along a knitted row in the at least one first and second knit structures in a manner such that when a portion of at least one of the first and/or second threads is pulled, the at least one first and second knit structures inhibit snagging and/or unravelling of the knitted row in which the threads are positioned.

In a twenty-sixth example, the article according to one of examples 24-25 wherein the at least one first knit structure comprises a loop and wherein the at least second knit structure comprises at least one of a float insertion, a loop, or a tuck stitch.

In a twenty-seventh example, the article according to one of examples 24-26 wherein each of the first and second predetermined characteristics comprise at least one of elasticity, melt temperature, temperature regulation, abrasion resistance, cut resistance, heat resistance, water resistance, chemical resistance, fire resistance, grip, thermal conductivity, electrical conductivity, strength (e.g., tensile strength), weight, breathability, moisture wicking capability, water-repellence, compression, shrinkability, cushioning, reflectivity, insulation, durability, washability, reactivity, energy absorption or luminescence.

In a twenty-eighth example, the article according to one of examples 24-27 wherein the first predetermined characteristic is a first melting temperature and the second predetermined characteristic is a second melting temperature.

In a twenty-ninth example, the article according to one of examples 24-28 wherein the first melting temperature of the first thread is lower than the second melting temperature of the second thread, and wherein the second thread is positioned in areas that are experience high levels of friction during use.

In a thirtieth example, the article according one of examples 24-29 wherein the threads are positioned along a knitted row in the at least one first and second knit structures in a manner such that when a portion of at least one of the first and/or second threads is pulled the at least one first and second knit structures inhibit snagging and/or unravelling of the knitted row in which the threads are positioned.

In a thirty-first example, the article according to one of examples 24-30 wherein a first thread and/or a second thread provide connections between a first layer and a second layer of the knit element on a stitch by stitch basis.

In a thirty-second example, the article according to one of examples 24-31, wherein the knit element comprises a front side and a back side, and wherein at least one of the first or second knit structures is positioned on the back side to create at least one three-dimensional effect.

In a thirty-third example, the article according to one of examples 24-32, wherein the knit element comprises: a first part of the second section comprising the first thread and positioned on a front side of the knit element; and a second part of the second section comprising the second thread and positioned on a back side of the knit element; and wherein at least one of the first knit structures is positioned on the front side and the second knit structures is positioned on the back side and wherein in a first part of the second section positioned comprises at least one held stitch or missed stitch to create at least one three-dimensional effect.

In a thirty-fourth example, the article according to one of examples 24-33 wherein a first thread and/or a second thread provide connections between the first section and a third section of the knit element.

In a thirty-fifth example, the article according to the preceding example wherein each of the sections of the knit element comprise different physical properties.

In a thirty-sixth example, the article according to the preceding example wherein the first section and the third section of the knit element comprise different elasticities.

In a thirty-seventh example, a shoe upper comprising a double-layer flat-knit element comprising: a first section comprising at least two threads (11, 12), both threads forming a merged knit structure (10); and a second section comprising the at least two threads in an exchanged merged knit structure; a third section comprising: at least one first knit structure (13) formed from a first thread (11) of the merged threads having a first predetermined characteristic on a first layer of the knit element; and at least one second knit (14) structure formed from a second thread (12) of the merged threads having a second predetermined characteristic, separate from the first knit structure (13) and formed on a second layer of the knit element or between the first and second layers of the knit element.

In a thirty-eighth example, a shoe upper according to example 37 wherein each of the first and second predetermined characteristics comprise at least one of elasticity, melt temperature, abrasion resistance, cut resistance, heat resistance, water resistance, chemical resistance, fire resistance, grip, thermal conductivity, electrical conductivity, strength (e.g., tensile strength), weight, breathability, moisture wicking capability, water-repellence, compression, shrinkability, cushioning, reflectivity, insulation, durability, washability, reactivity, luminescence.

In a thirty-ninth example, the shoe upper according to one of examples 37-38 wherein the first predetermined characteristic is a first melting temperature and the second predetermined characteristic is a second melting temperature.

In a fortieth example, the shoe upper according to one of examples 37-39 wherein the first melting temperature of the first thread is lower than the second melting temperature of the second thread, and wherein the second thread is positioned in areas that are experience high levels of friction during use.

In a forty-first example, the shoe upper according to one of examples 37-40 wherein the threads are positioned along a knitted row in the at least one first and second knit structures in a manner such that when a portion of at least one of the first and/or second threads is pulled the at least one first and second knit structures inhibit snagging and/or unravelling of the knitted row in which the threads are positioned.

In a forty-second example, the shoe upper according to one of examples 37-41 wherein a first thread and/or a second thread provide connections between a first layer and a second layer of the knit element on a stitch-by-stitch basis.

In a forty-third example, the shoe upper according to one of examples 37-42 wherein a first thread and/or a second thread provide connections between the first section and a third section of the knit element.

In a forty-fourth example, the shoe upper according to the preceding example wherein the first section and the third section of the knit element comprise different physical properties.

In a forty-fifth example, the shoe upper according to the preceding example wherein the first section and the third section of the knit element comprise different elasticities.

In a forty-sixth example, a method of forming a knit element for a shoe upper, comprising: providing at least three threads to a knitting machine using separate feeders; plating at least a first thread and a second thread of the at least three threads; forming a first knit structure of a first section using the merged first and second threads; forming a second knit structure of the first section with a third thread of the at least three threads separate from the first knit structure; separating the first thread and the second thread; forming a second section of the knit element, comprising: forming a first knit structure of the second section using the first thread; forming a second knit structure of the second section using the second thread; forming a third knit structure of the second section using the third thread; forming a third section of the knit element, comprising: plating at least two of the first, second and third threads; forming a first knit structure of the third section using the at least two merged threads; and forming a second knit structure of the third section using at least one of the first, second, or third threads.

In a forty-seventh example, the method according to the preceding example, wherein the at least one of the first section, the second section and the third section comprises at least five stitch positions along a knitted row.

In a forty-eighth example, the method according to one of examples 46-47, wherein the at least one of the first section, the second section and the third section comprises a jacquard knit pattern at at least five stitch positions.

In a forty-ninth example, a knit element, comprising: a first section comprising: at least three threads wherein at least a first thread and a second thread of the at least three threads are merged and form a first knit structure; a second knit structure of the first section formed with a third thread of the at least three threads separate from the first knit structure; a second section of the knit element, comprising: a first knit structure of the second section using the first thread; a second knit structure of the second section using the second thread; a third knit structure of the second section using the third thread; a third section of the knit element, comprising: a first knit structure of the third section formed from at least two of the first, second and third threads; a second knit structure of the third section using at least one of the first, second, and third threads.

In a fiftieth example, the knit element according to the preceding example, wherein the at least one of the first section, the second section and the third section comprises at least two stitch positions.

In a fifty-first example, the knit element according to one of examples 49-50, wherein the at least one of the first section, the second section and the third section comprises at least five stitch positions along a knitted row.

In a fifty-second example, the knit element according to one of examples 49-51, wherein at least one of the first knit structure, second knit structure and/or third knit structure couples the first section to the third section.

In a fifty-third example, a knit upper comprising: a first section comprising two or more merged threads; a separation zone where the two or more merged threads are separated; a second section comprising: a first thread of the two or more merged threads are formed into a first knit structure; a second thread of the two or more merged threads are formed into a second knit structure.

In a fifty-fourth example, a knit upper according to the preceding example, wherein the knit upper comprises a front side and a back side, wherein the first knit structure is formed on the front side of the knit element and, wherein the second knit structure is formed on the back side of the knit element.

In a fifty-fifth example, a method of manufacturing a knitted component for an article of footwear, the method comprising: knitting at least a first portion of an upper with a knitting machine; holding the first portion of the upper on needles of the knitting machine; knitting a second portion with the knitting machine while the first portion of the upper is held on the needles; and joining the second portion to the first portion of the knit element.

In a fifty-sixth example, the method of the preceding example further comprising selectively controlling positioning of at least two threads using machine settings.

In a fifty-seventh example, the method of one of examples 55-56 wherein the machine settings are used to control at least one of a feeder, a sinker, a cam, or a needle.

In a fifty-eighth example, the method of one of examples 55-57 wherein at least one of the first or second portions comprises a first knitted row extending along a first direction and a second knitted row extending along a second knit direction.

In a fifty-ninth example, the method of one of examples 55-58 further comprising: providing a first thread and a second thread to the knitting machine; plating the first and second threads in a first section of the knitted component to form a first merged knit structure; and separating the first thread from the second thread; providing the first thread to a first thread holding element; manipulating the first thread such that a first knit structure of a second section is formed from the first thread; providing the second thread to a second thread holding element; and manipulating the second thread such that a second knit structure of the second section is formed from the second thread.

In a sixtieth example, a knitted shoe upper comprising: a first region comprising: a first section having a first thread and second thread merged together; and a second region comprising: a first set of knit structures formed from the first thread; and a second set of knit structures formed from the second thread.

In a sixty-first example, the knitted shoe upper of example 60 wherein the first region comprises a midfoot region and the second region comprises an insole region.

In a sixty-second example, the knitted shoe upper of example 61 further comprising a heel section coupled to at least one of the insole section and the midfoot region using one or more of linking, knitting, welding, merger, and divergence.

In a sixty-third example, the knitted shoe upper of example 60 further comprising at least one of an eyestay area, a heel section, and a toe box section in the first region and wherein at least one of the first and second threads comprises a melt material.

In a sixty-fourth example, a method of knitting a shoe upper comprising: knitting a forefoot portion of the shoe upper on a first set of knitting needles; holding the forefoot portion on a first set of holding needles; knitting a heel portion on a second set of knitting needles; holding the heel portion on a second set of holding needles; and joining at least a part of the forefoot portion to at least a part of the heel portion.

In a sixty-fifth example, a customizable knit upper for a shoe, comprising: a first section comprising two or more merged threads; and a second section comprising: a first part comprising a first melt thread of the two or more merged threads; and a second part comprising a second thread of the two or more merged threads.

In a sixty-sixth example, the knit upper of example 65 wherein the first part of the second section positioned proximate to a midsole or outsole and the second part of the second section is positioned proximate to the foot.

In a sixty-seventh example, the knit upper of one of examples 65-66 wherein the second thread comprises at least one of a cushioning thread, a breathable thread, or a moisture wicking thread.

In a sixty-eighth example, the knit upper of one of examples 65-67 wherein the first and second parts of the second section are coupled to each other at one or more positions along a knitted row.

In a sixty-ninth example, the knit upper of one of examples 65-68 further comprising a third section wherein the first and second threads are merged such that a connection between the first and second parts of the second section is formed.

In a seventieth example, the knit upper of one of examples 65-69 wherein the first section comprises at least a portion of the midfoot section of the knit upper and the second section comprises at least a portion of an insole section.

In a seventy-first example, a shoe upper comprising: a first section comprising three or more threads merged together; a second section comprising: a first part comprising at least two of the three or more threads, wherein the at least two threads are merged together; and a second part comprising a remaining thread of the three or more threads.

In a seventy-second example, the shoe upper of example 71 further comprising a third section and wherein the three or more threads comprise at least a waterproof thread, a moisture wicking thread, and a melt thread.

In a seventy-third example, the shoe upper of one of examples 71-72 wherein the waterproof thread and the moisture wicking thread may be merged together for a few stitches and then diverge for five or ten stitches. A third thread may be knit on the opposite needle bed when the threads are merged and may be positioned between the first and second parts of the knit when after the merged threads diverge and form knit structures independently.

Any of the above described techniques may be used alone or in combination with each other to create articles having customized properties. In some embodiments, consumers may be able to select properties for given regions of a knitted element, such as for example, a shoe upper. For example, a customer may be able to select performance properties and/or design properties for a particular region of a shoe upper. In particular, a user may select colors of yarns and designs for implementing which require a combination of the techniques described above. For example, exchanging merged yarns may be used to create a particular design using yarns having different colors and combined with merger and/or divergence in areas where either specific predetermined physical and/or visual properties are desired.

What is claimed is:

1. A flat-knit element for a shoe upper, comprising:

a first section comprising a first thread and a second thread merged together and forming merged knit structures in at least one layer of the first section; and a second section coupled seamlessly to the first section, the second section comprising:

a first knit layer comprising at least one first knit structure formed from the first thread of the first section on the first knit layer of the flat-knit element, wherein the first thread is separated from the second thread in the first knit layer; and a second knit layer comprising at least one second knit structure formed from the second thread of the first section formed on the second knit layer of the flat-knit element, wherein the second thread is separated from the first thread in the second knit layer.

2. The flat-knit element of claim 1, further comprising a third thread connecting the first and second knit layers of the second section using tuck stitches, loops, or a combination of tuck stitches and loops at at least some stitch positions.

3. The flat-knit element of claim 2, wherein the second section comprises a spacer mesh construction.

4. The flat-knit element of claim 1, further comprising a third thread in the second section, wherein the third thread is absent from the first section.

5. The flat-knit element of claim 1, further comprising a third thread in the first and second sections, wherein the third thread forms part of one or more of the merged knit structures in the first section and connects the layers of the second section.

6. The flat-knit element of claim 1, wherein the first thread and the second thread comprise at least one predetermined characteristic selected from elasticity, melt temperature, an ability to thermally regulate, antistatic properties, antibacterial properties, abrasion resistance, cut resistance, heat resistance, water resistance, chemical resistance, flame resistance, grip, thermal conductivity, electrical conductivity, data transmission, strength, elongation, weight, breathability, moisture wicking capability, water-repellence, compression, shrinkability, cushioning, reflectivity, insulation, durability, washability, reactivity, predetermined energy absorption and/or luminescence.

7. The flat-knit element of claim 1, wherein the first thread of the first section forms a first plurality of knitting structures on the first knit layer of the second section of the flat-knit element, and wherein the second thread of the first section forms a second plurality of knitting structures on the second knit layer of the second section of the flat-knit element.

8. The flat-knit element of claim 1, further comprising a third section seamlessly coupled to the second section and formed from the first thread and the second thread of the first section as merged threads forming one or more merged knit structures in the third section.

9. The flat-knit element of claim 1, further comprising a third section comprising one or more knit structures formed from the first thread and the second thread of the first section such that a pocket is formed in the second section.

10. The flat-knit element of claim 1, wherein the first thread and the second thread have been positioned using exchange plating, merging, diverging, intarsia, or jacquard knitting to create a predetermined design.

11. The flat-knit element of claim 1, wherein the first section connects to second section seamlessly using at least one of tuck stitches, loops, and floats.

12. The flat-knit element of claim 1, wherein at least a portion of the flat-knit element is a double-layer.

13. The flat-knit element of claim 1, wherein the flat-knit element comprises a plurality of flat-knit elements of a predetermined design each having stitch sizes within a predetermined stitch size tolerance relative to each other.

14. A custom flat-knit element for a shoe upper, comprising:

a first section comprising a first thread and a second thread merged together and forming merged knit structures; and a second section seamlessly coupled to at least a portion of the first section, the second section comprising:

a first knit layer comprising at least one first knit structure formed from the first thread of the first section on the first knit layer of the knit element, wherein the first thread is separated from the second thread in the first knit layer; and a second knit layer comprising at least one second knit structure formed from the second thread of the first section formed on the second knit layer of the knit element, wherein the second thread is separated from the first thread in the second knit layer; and wherein at least one of the first and second knit layers of the second section comprises a third thread.

15. The custom flat-knit element of claim 14, wherein the third thread connects the layers of the second section using tuck stitches, loops, or a combination of tuck stitches and loops at at least some stitch positions.

16. The custom flat-knit element of claim 14, wherein the second section comprises a spacer mesh construction.

17. The custom flat-knit element of claim 14, wherein at least a portion of the flat-knit element is a double-layer and wherein each of the first and second knit structures comprises a loop, a tuck stitch, or a float insertion positioned on an external layer, an internal layer, or in an interstitial space between the layers.

18. The custom flat-knit element of claim 14, wherein one of more of the first thread, the second thread, and the third thread comprise at least one predetermined characteristic selected from elasticity, melt temperature, an ability to thermally regulate, antistatic properties, antibacterial properties, abrasion resistance, cut resistance, heat resistance, water resistance, chemical resistance, flame resistance, grip, thermal conductivity, electrical conductivity, data transmission, strength, elongation, weight, breathability, moisture wicking capability, water-repellence, compression, shrinkability, cushioning, reflectivity, insulation, durability, washability, reactivity, predetermined energy absorption and/or luminescence.

19. The custom flat-knit element of claim 14, further comprising a third section comprising one or more knit structures formed from the first and second threads of the first section such that a pocket is formed in the second section.

20. The custom flat-knit element of claim 14, wherein each of the first and second sections of the flat-knit element has a predetermined design and at least some of the threads have been positioned using exchange plating, merging, diverging, intarsia, or jacquard knitting.

* * * * *